US007257937B2

(12) United States Patent
Nakagiri et al.

(10) Patent No.: US 7,257,937 B2
(45) Date of Patent: Aug. 21, 2007

(54) SHEET-PROCESSING APPARATUS

(75) Inventors: Masayuki Nakagiri, Shizuoka-ken (JP); Yasuhisa Watanabe, Shizuoka-ken (JP)

(73) Assignee: Fujifilm Corporation, Kanagawa (JP)

( * ) Notice: Subject to any disclaimer, the term of this patent is extended or adjusted under 35 U.S.C. 154(b) by 74 days.

(21) Appl. No.: 10/786,077

(22) Filed: Feb. 26, 2004

(65) Prior Publication Data

US 2004/0177735 A1 Sep. 16, 2004

(30) Foreign Application Priority Data

Feb. 27, 2003 (JP) ..... 2003-050630
Jun. 23, 2003 (JP) ..... 2003-178208
Jul. 17, 2003 (JP) ..... 2003-198303

(51) Int. Cl.
*B65B 25/14* (2006.01)
*B65B 35/50* (2006.01)
*B65B 63/00* (2006.01)

(52) U.S. Cl. ..... 53/520; 53/540

(58) Field of Classification Search ..... 53/520, 53/540

See application file for complete search history.

(56) References Cited

U.S. PATENT DOCUMENTS 3,144,797 A 8/1964 Pitner
4,480,742 A 11/1984 Muylle
4,602,775 A 7/1986 Calhoun et al.
4,939,888 A * 7/1990 Katz et al. ..... 53/411
5,156,384 A * 10/1992 Donahue ..... 270/58.31
5,365,817 A * 11/1994 Maeda et al. ..... 83/256
5,507,615 A * 4/1996 Uno ..... 414/788.3
6,409,008 B1 6/2002 Newsome
6,584,754 B1 * 7/2003 Neri ..... 53/540
6,907,711 B2 * 6/2005 Ishii et al. ..... 53/54

FOREIGN PATENT DOCUMENTS

AT 374 766 B 5/1984
DE 37 03 951 A1 8/1988
EP 0 819 637 A1 1/1998
EP 1 122 198 A2 8/2001
JP 48-069264 9/1973
JP 49-001109 1/1974
JP 55-151453 11/1980
JP 08-026571 1/1996

* cited by examiner

*Primary Examiner*—John Sipos
(74) *Attorney, Agent, or Firm*—Birch, Stewart, KOlasch & Birch, LLP

(57) ABSTRACT

A processing system which enables automation of processing of sheet bodies with a view to raising efficiency of operations, from stacking to packing. A plurality of paper sheaves, which have been produced by cutting and chopping, are transported in a width direction, sequentially fed to a transfer conveyor, transported from the transfer conveyor in a length direction, and fed to a cover sheet application device. At the cover sheet application device, the paper sheaves are superposed with cover sheets, and fed to an inversion apparatus. At the inversion apparatus, the paper sheaves are inverted such that the cover sheets are at upper sides, and are fed out to another cover sheet application device. At this cover sheet application device, the cover sheets are superposed with lower face sides of the paper sheaves. Hence, the paper sheaves, with the cover sheets superposed at both upper and lower faces thereof, are bagged.

19 Claims, 28 Drawing Sheets

SHEET-PROCESSING APPARATUS

CROSS-REFERENCE TO RELATED APPLICATION

This application claims priority under 35USC 119 from Japanese Patent Application Nos. 2003-50630, 2003-178208, and 2003-198303, the disclosures of which are incorporated by reference herein.

BACKGROUND OF THE INVENTION

1. Field of the Invention

The present invention relates to a sheet-processing apparatus.

2. Description of the Related Art

In recent years, with the spread of digital cameras, the spread of inkjet-type printers and the like, demand for inkjet paper has risen. Hence, increases in efficiency of a series of operations, from cutting and chopping of inkjet paper to packing (bagging up predetermined numbers of sheets), are sought after.

Sheets of inkjet paper are formed by cutting sheets, which have been drawn out from an original web (for example, an original material in the form of a roll), to a width matching a width dimension of the sheets, and chopping to a length matching a length dimension of the sheets. These sheets are then stacked and packed.

For example, Japanese Patent Application Laid-Open (JPA) No. 10-58384 discloses a sheet-processing process in which large sheets, which are produced by chopping a long sheet, are piled up, sheaves of sheets with a predetermined size are produced by cutting a sheaf of these large sheets, and these sheet sheaves are bagged up.

However, operations to move the sheaf of large sheets before steps of cutting and chopping are rather troublesome, and moreover, there are problems such as equipment becoming larger in accordance with the size of the large sheets, and the like.

As another example, JP-A No. 5-39140 discloses a sheet sheaf transport apparatus which includes gripping means, at which a gripping pawl is attached, for gripping, lifting and transporting an end portion of a sheaf of sheets which have been placed on a transport table. In this apparatus, in order to prevent a lowermost sheet from sticking to the conveyance table, air is fed between that sheet and an upper face of the transport table.

However, transporting sheaves of sheets, whose end portions are susceptible to becoming uneven, with the gripping pawl is rather difficult. Moreover, there is room for improvement in the area of transport efficiency.

SUMMARY OF THE INVENTION

An object of the present invention is to provide a sheet-processing apparatus capable of performing reasonable sheet transport.

Further, another object of the present invention is to provide a sheet-processing apparatus capable of efficiently performing a series of operations such as sheet-cutting, chopping and stacking, up to packing.

In order to achieve these objects, according to a first aspect of the present invention, a sheet-processing apparatus is provided which includes: a cutting apparatus which slits a long sheet member into a plurality of narrower strips; a chopping apparatus which chops the strips with a predetermined spacing, for forming pluralities of sheets; a stacking apparatus which piles up a predetermined number of the sheets for each strip, for forming sheet sheaves; a transport apparatus which transports the sheet sheaves; and a packing apparatus which packs the sheet sheaves.

According to a second aspect of the present invention, a stacking and transport apparatus is provided which includes: a stacking section including a plurality of sheet-receiving portions, each sheet-receiving portion stacking a plurality of substantially rectangular sheets, which are fed therein in a first direction, for forming sheet sheaves, in which each sheet is inclined, and the plurality of sheet-receiving portions being disposed substantially in a row in a second direction, which is substantially perpendicular to the first direction, in plan view; and a transport section for transporting the sheet sheaves which are formed at each sheet-receiving portion in a transport direction which is substantially parallel to the first direction.

According to a third aspect of the present invention, a stacking and transport method is provided which includes: stacking a plurality of substantially rectangular sheets which are fed in in a predetermined direction for forming a sheet sheaf in which each sheet is inclined; and transporting the sheet sheaf in a transport direction which is substantially parallel to the predetermined direction.

The foregoing, and other objects, features and advantages of the present invention will be apparent from the following description of preferred embodiments of the invention as illustrated in the accompanying drawings, and the accompanying claims.

DETAILED DESCRIPTION OF THE INVENTION

Figure 1:
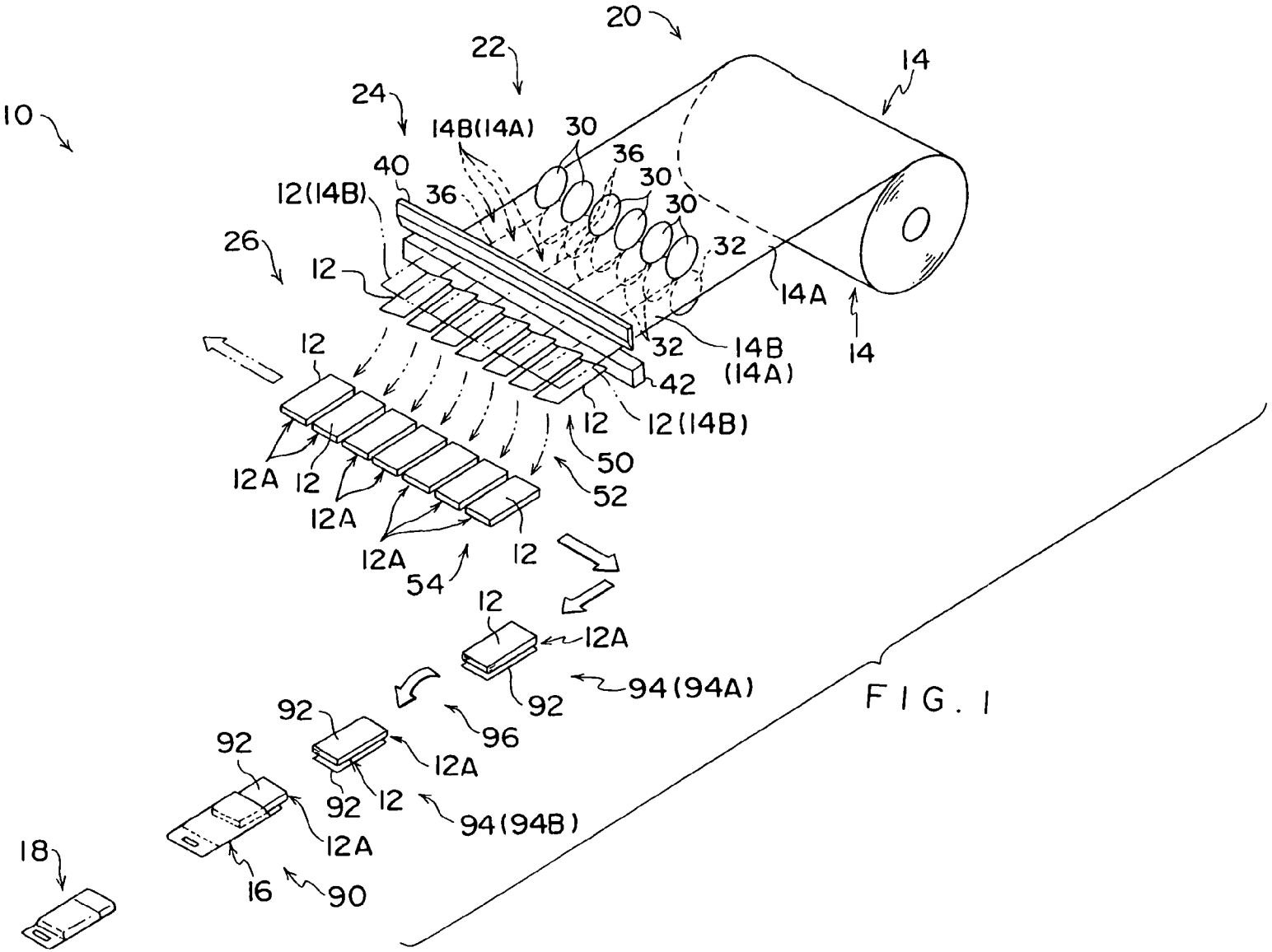
FIG. 1 is an overall schematic perspective view showing a flow of processing in a processing system of a first embodiment.

Herebelow, a first embodiment of the present invention will be described with reference to the drawings. FIG. 1 shows schematic structure of a processing system 10 relating to the first embodiment.

The processing system 10 implements, on an original web 14, a cutting process and a chopping process of papers 12, which are sheets of inkjet paper or the like. The processing system 10 produces the papers 12 in predetermined sizes, and bags up (packs) sets of predetermined numbers of these papers 12 in wrappers 16. Thus, the processing system 10 produces packages 18 of the papers 12. Further, the packages 18 of the papers 12 that are produced by the processing system 10 are prepared for shipping by being packaged in cardboard boxes or the like (outer packing).

Figure 2:
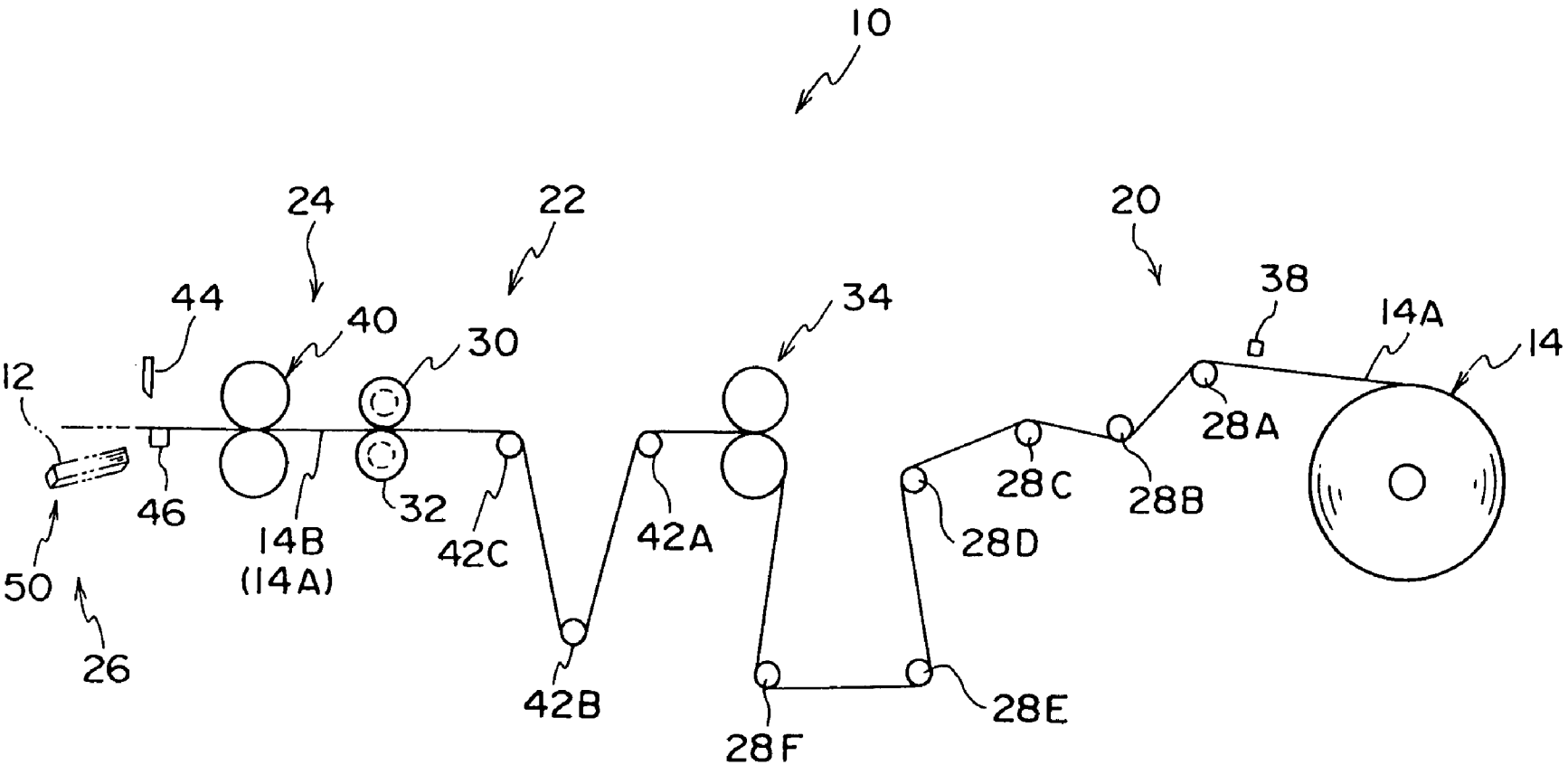
FIG. 2 is a schematic structural view of a principal portion of the processing system of the first embodiment.

As shown in FIGS. 1 and 2, the processing system 10 is equipped with a feeding apparatus 20, a cutting apparatus 22, a chopping apparatus 24 and a stacking apparatus 26. The original web 14 is loaded at the feeding apparatus 20.

The original web 14 is formed by winding a web-form sheet material, which forms the papers 12 (below referred to as a 'web 14A') in the form of a roll. The feeding apparatus 20 draws out the web 14A from an outer periphery end of this original web 14.

As shown in FIG. 2, a plurality of path rollers 28 (path rollers 28A to 28F) are provided at the feeding apparatus 20. A transport path of the web 14A is formed by the path rollers 28A to 28F. The feeding apparatus 20 winds the web 14A that is drawn out from the original web 14 round the path rollers 28A to 28F in sequence, and transports the web 14A. At this feeding apparatus 20, unillustrated curl-removing means is provided partway along the transport path of the web 14A. By transporting the web 14A while winding the web 14A round the path rollers 28A to 28F, the curl-removing means eliminates curl which is caused by the web 14A having been wound up in the roll.

At the feeding apparatus 20, a pair of feed rollers 34 are disposed upward of the path roller 28F. The two feed rollers 34 are rotated by driving force of unillustrated driving means while nipping the web 14A, and feed the web 14A at a predetermined speed.

The cutting apparatus 22 is provided at a downstream side of the pair of feed rollers 34. At the cutting apparatus 22, as an example of cutting means, slitting blades 30 and 32 are provided as a plurality of pairs. The slitting blades 30 and 32 are disposed in pairs sandwiching the transport path of the web 14A from above and below, respectively. The slitting blades 30 and 32 are formed so as to cut along a length direction of the web 14A when the web 14A passes therebetween.

Specifically, as shown in FIG. 1, the slitting blades 30 and 32 are disposed with a predetermined spacing along a width direction of the web 14A, which is a direction intersecting the transport direction of the web 14A. The web 14A is cut (slitted) to the predetermined spacing by being passed between the slitting blades 30 and 32, and slits 36 are formed in the web 14A. Here, the spacing of the slitting blades 30 is a lateral dimension of the papers 12 that are being produced by the processing system 10.

Therefore, in accordance with characteristics of inkjet printers and the like which will use the papers 12, the length dimension of the web 14A which is wound in a roll will be the length dimension of the papers 12.

As shown in FIG. 2, a web edge control sensor 38 is provided at the feeding apparatus 20. A position of the original web 14 along an axial direction is controlled such that a width direction end portion of the web 14A, which is detected by this web edge control sensor 38, passes the web edge control sensor 38 at a certain position. Consequently, the slits 36 can be formed by the slitting blades 30 and 32 at predetermined positions along the width direction of the web 14A.

As shown in FIG. 1, the web 14A in which the slits 36 have been formed (i.e., webs 14B) is fed toward the chopping apparatus 24, which is disposed at a downstream side of the cutting apparatus 22.

As shown in FIG. 2, a pair of feed rollers 40 is provided at the chopping apparatus 24, at the cutting apparatus 22 side thereof. Moreover, a plurality of path rollers 42 (path rollers 42A, 42B and 42C) are disposed between the cutting apparatus 22 at the upstream side of the chopping apparatus 24 and the feed rollers 34. The web 14A that has been fed by the feed rollers 34 is wound round the path rollers 42A, 42B and 42C in sequence, and transported.

The feed rollers 40, which are provided at the chopping apparatus 24, grip the webs 14B and feed the webs 14B in units of a certain amount. Here, a certain tension can be applied to the webs 14B to absorb variations in length of the webs 14B by, for example, moving the path roller 42B in a direction of lengthening/shortening a length along the transport path of the web 14A. Thus, slackness will not occur. The feed amount of the webs 14B is set to a length in accordance with a dimension along the length direction of the papers 12 (a longitudinal dimension).

As shown in FIGS. 1 and 2, an upper blade 44 and a lower blade 46, which opposes the upper blade 44, are provided at the chopping apparatus 24 to serve as chopping means. The feed rollers 40 feed the webs 14B to between the upper blade 44 and the lower blade 46.

In the chopping apparatus 24, when a certain length of the webs 14B has been fed between the upper blade 44 and the lower blade 46 by the feed rollers 40 and the predetermined length of the webs 14B has emerged from between the upper blade 44 and the lower blade 46, the upper blade 44 is moved downward, and the plurality of webs 14B are respectively chopped.

Here, by setting the feed amount of the webs 14B by the path rollers 42 to an amount corresponding to the longitudinal dimension of the papers 12, the papers 12 are produced with a predetermined size (the predetermined lateral direction and longitudinal direction).

Further, in the processing system 10, the stacking apparatus 26 is provided adjacent to a downstream side of the chopping apparatus 24.

Figure 3:
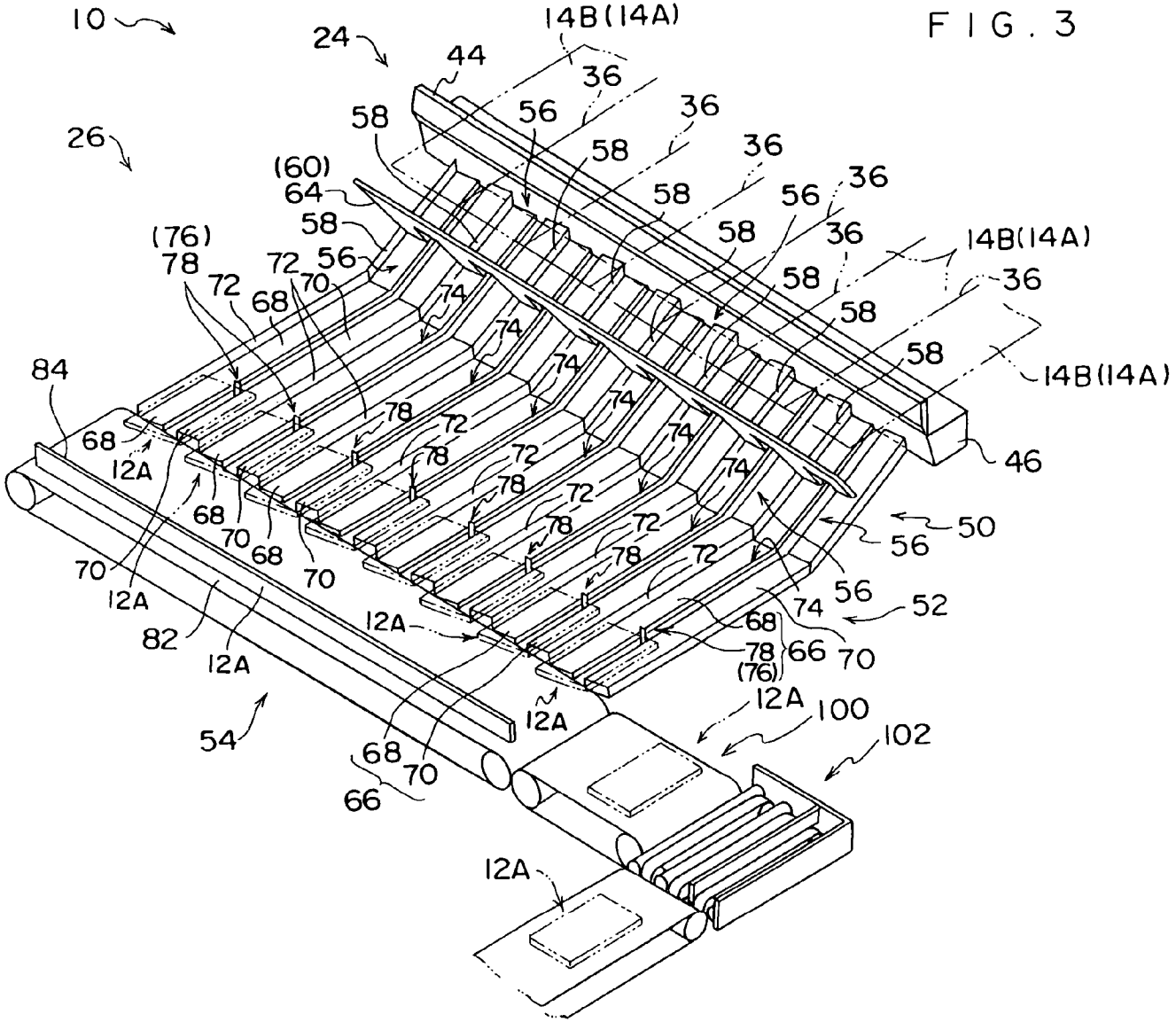
FIG. 3 is an overall schematic perspective view of a stacking apparatus.

As shown in FIGS. 1 and 3, the stacking apparatus 26 is formed by a stacking section 50, an alignment movement section 52 and an alignment conveyor 54. Now, an example of the stacking apparatus 26 which can be utilized subsequent to the cutting apparatus 22 and the chopping apparatus 24 in the processing system 10 will be described with reference to FIGS. 3 to 5.

Figure 4:
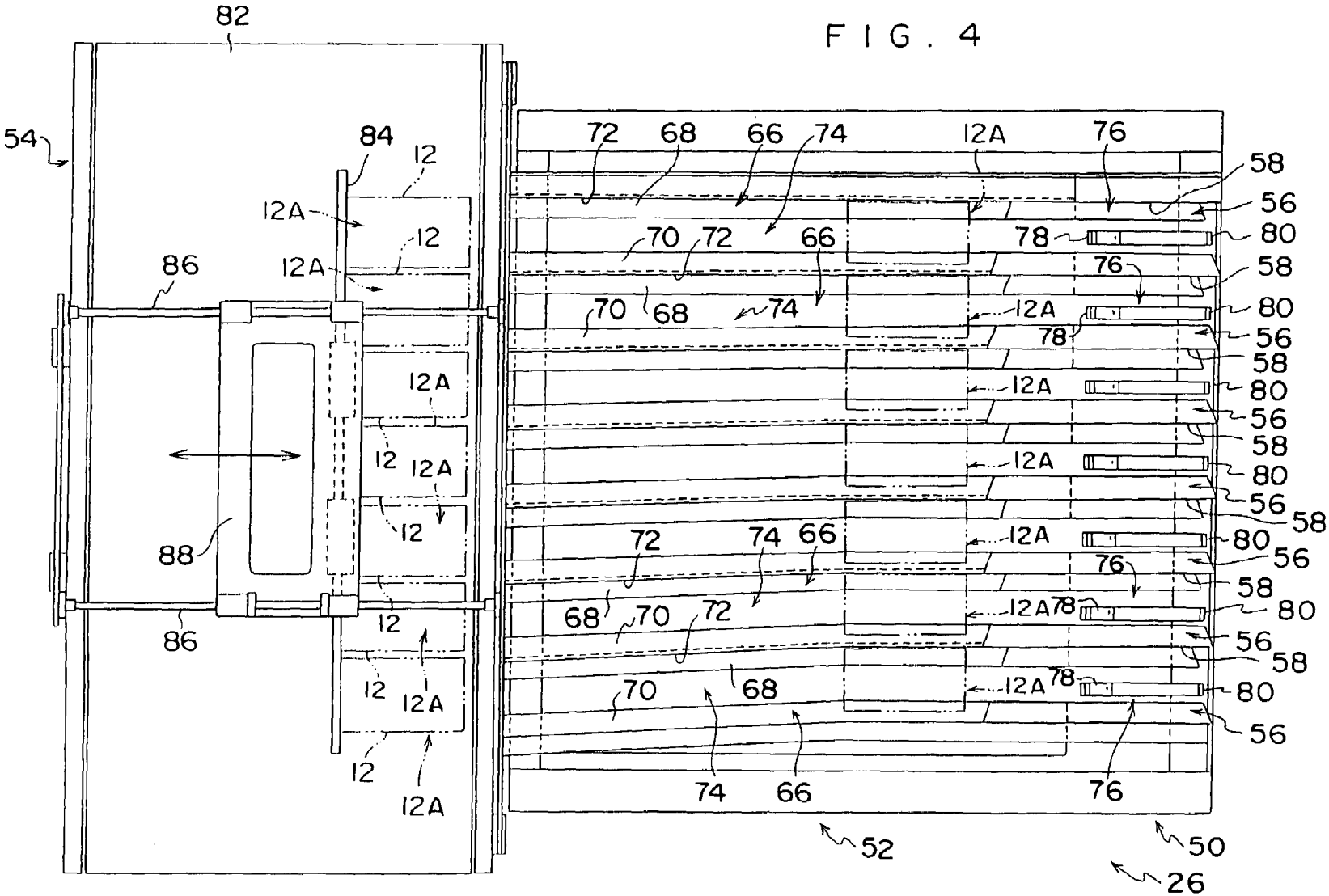
FIG. 4 is an overall schematic plan view of the stacking apparatus.

As shown in FIGS. 3 and 4, tray portions 56 are provided at the stacking section 50 of the stacking apparatus 26. The papers 12, which have been formed by the webs 14B being chopped by the upper blade 44, drop down and are thus placed in the tray portions 56.

As shown in FIG. 3, the tray portions 56 are provided so as to respectively oppose the small-width webs 14B that are produced by the cutting apparatus 22 (which is not shown in FIGS. 3 and 4). At the stacking apparatus 26, a plurality of the papers 12 that are formed at the same time by the plurality of webs 14B being chopped by the chopping apparatus 24 can be respectively placed on the individual tray portions 56.

The tray portions 56 are disposed with an inclination such that one end sides of the papers 12 in the lateral direction thereof are lower. Further, at each of the tray portions 56, a standing wall 58 is formed at a lower end side of the inclination along the lateral direction of the papers 12. The papers 12 that fall into the respective tray portions 56 move along the lateral direction inclinations, and are disposed in the tray portions 56 in a state in which one lateral direction end abuts against the standing wall 58.

Therefore, in the stacking section 50, the respective papers 12 do not straddle between neighboring tray portions 56 in the lateral direction, and when the plurality of papers 12 are placed in the tray portions 56, the respective lateral direction one end sides of the papers 12 are aligned.

Figure 5:
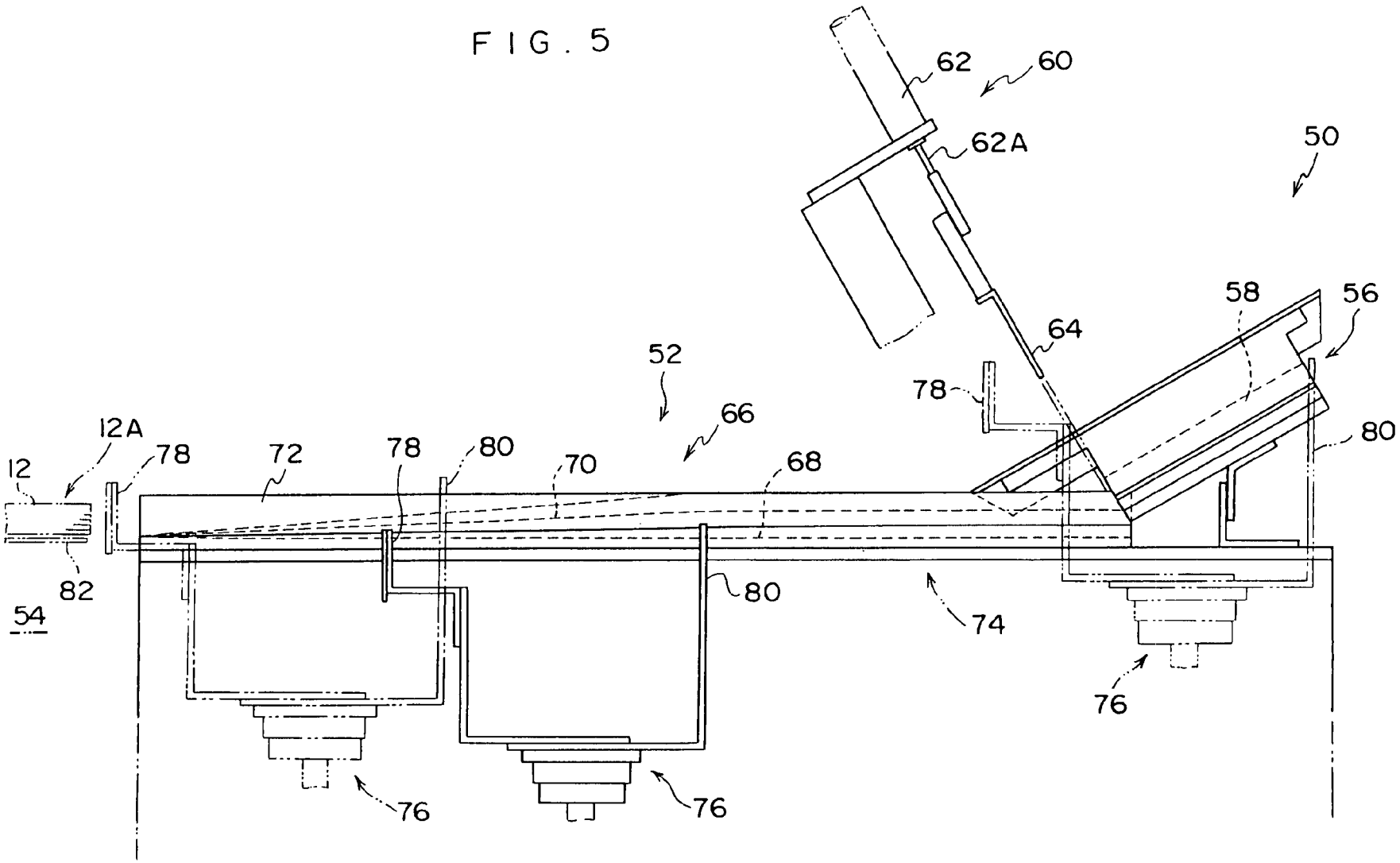
FIG. 5 is a schematic side view of a stacking section and an alignment movement section, viewed from a horizontal direction which substantially intersects a transport direction.

As shown in FIG. 5, the tray portions 56 are inclined such that a downstream side thereof in the transport direction of the papers 12, which is a side thereof away from the upper blade 44 in the length direction of the papers 12, is lower. A stopper 60 is also provided at the stacking section 50, at an upper side of the tray portions 56. This stopper 60 is equipped with a stopping plate 64, which is extendable/retractable by an air cylinder 62, and this stopping plate 64 is coupled with a rod 62A.

The stopping plate 64 is disposed with a length direction thereof along the lateral direction of the papers 12, such that the stopping plate 64 faces the respective tray portions 56. A lower end portion of the stopping plate 64 has a substantially sawtooth form whose teeth are inclined along the inclinations of the respective tray portions 56 along the lateral direction of the papers 12 (not shown in FIG. 5).

At the stacking section 50, when the papers 12 are to be stacked at the respective tray portions 56, the rod 62A of the air cylinder 62 extends, and a lower end of the stopping plate 64 abuts against paper placing surfaces of the tray portions 56. Here, when the papers 12 are placed in the tray portions 56, the stopping plate 64 of the stopper 60 faces positions which are at lower ends (transport direction downstream side end portions) of the papers 12.

In the tray portions 56, length direction distal ends of the papers 12 that have dropped down are placed so as to abut against the stopping plate 64. That is, in the stacking section 50, because the papers 12 are abutted against the stopping plate 64, the papers 12 in the respective tray portions 56 are aligned in the length direction.

Thus, in the stacking section 50, predetermined numbers of the papers 12 are stacked while being aligned in the width direction and length direction (transport direction) of the papers 12. Thus, sheaves 12A of the papers 12 are formed. Hereafter, the sheaves 12A of predetermined numbers of the papers 12 are referred to as paper sheaves 12A. Stacking numbers of the papers 12 at this time are specified in advance in correspondence with the size of the papers 12 or the like.

At the stacking section 50, when the rod 62A of the air cylinder 62 is contracted and the stopping plate 64 is raised, the papers 12 that have been stacked in the tray portions 56 (the paper sheaves 12A) descend along the inclination of the tray portions 56 in the paper length direction.

As shown in FIGS. 3 and 4, substantially channel-like guides 66 are provided at the alignment movement section 52. The guides 66 communicate the respective tray portions 56 provided at the stacking section 50 with the alignment conveyor 54.

As shown in FIG. 5, the guides 66 are gently inclined such that the alignment conveyor 54 sides thereof are lower, and the paper sheaves 12A that have been stacked in the tray portions 56 move along these guides 66 onto the alignment conveyor 54. When the stopping plate 64 moves upward and the paper sheaves 12A that have been stacked in the tray portions 56 descend along the inclination of the tray portions 56, the sheaves 12A stop upon reaching the guides 66.

As shown in FIGS. 3 and 4, the guides 66 are formed by guide plates 68 and guide plates 70. The guide plates 68 face one width direction end portions of the papers 12 and the guide plates 70 face the other width direction end portions of the papers 12. The paper sheaves 12A straddle between these guide plates 68 and 70 and are supported thereat.

At these guides 66, upper faces of the guide plates 68 and 70 are inclined such that the guide plate 68 sides of the guides 66, which correspond to the standing wall 58 sides of the tray portions 56, are lower. Furthermore, at the guides 66, standing walls 72 are formed between end portions of the guide plates 68 and end portions of the guide plates 70 of the guides 66 that are adjacent to the corresponding guide plates 68. The standing walls 72 are continuous with the standing walls 58 of the tray portions 56. Further, the inclinations of the guides 66 along the width direction of the papers 12 gradually ease off toward the alignment conveyor 54 side, and the guides 66 become substantially horizontal at the alignment conveyor 54 side thereof.

Therefore, when the paper sheaves 12A are fed into the guides 66, the width direction one ends thereof abut against the standing walls 72 and the width directions are aligned. Furthermore, when the paper sheaves 12A move toward the alignment conveyor 54 side, the inclinations of the papers 12 along the width direction gradually level off, and the sheaves 12A are fed onto the alignment conveyor 54 in substantially horizontal states.

Channel portions 74 are formed between the guide plates 68 and the guide plates 70 at the guides 66. These channel portions 74 oppose central portions of the papers 12 along the width direction thereof, and reach from the guides 66 to the tray portions 56.

As shown in FIG. 5, pushers 76 are provided at the alignment movement section 52. These pushers 76 are equipped with pushing arms 78 and stopping arms 80. As shown in FIGS. 3 and 4, the pushers 76 are respectively provided in correspondence with the channel portions 74 formed in the guides 66 (only portions of the pushers 76 are shown in FIG. 3).

The respective pushers 76 are vertically movable as a unit by unillustrated raising/lowering means such as, for example, a plurality of air cylinders or the like, and are also movable along the channel direction of the channel portions 74 as a unit, between the alignment conveyor 54 and the tray portions 56, by unillustrated moving means.

Accordingly, as shown in FIG. 5, distal end portions of the pushing arms 78 and stopping arms 80 of the pushers 76 can be protruded/retracted from the channel portions 74 to an upper face side of the guide plates 68 and 70, and can be moved along the channel portions 74 toward the alignment conveyor 54.

As shown in FIG. 4, at the alignment movement section 52, because the inclinations of the guides 66 along the width direction of the papers 12 gradually ease off, widths of the guides 66 are wider at the alignment conveyor 54 side than at the tray portions 56 side. As a result, inclinations relative to the transport direction of the papers 12 differ slightly between the guides 66. The channel portions 74 formed at the guides 66 are formed such that the pushers 76 can be moved in straight lines.

At the alignment movement section 52, before the stopping plate 64 of the stopper 60 is raised, the pushers 76 move and the distal end portions of the stopping arms 80 protrude from the channel portions 74 at the paper 12 transport direction downstream side relative to the stopping plate 64.

Accordingly, when the stopping plate 64 of the stopper 60 is raised, the paper sheaves 12A stacked at the tray portions 56 abut against the distal end portions of the stopping arms 80 and downward movement due to the inclinations of the tray portions 56 along the transport direction is blocked.

In the state in which the paper sheaves 12A abut against the distal end portions of the stopping arms 80, the pushers 76 move in the channel portions 74 toward the alignment conveyor 54 side, as far as a predetermined position. Accordingly, the paper sheaves 12A are moved into the guides 66 due to the inclinations of the tray portions 56, and the sheaves 12A are supported by the guide plates 68 and 70.

Subsequently, the pushers 76 retract the stopping arms 80 into the channel portions 74, move the distal end portions of the pushing arms 78 so as to face transport direction upstream sides of the papers 12, and protrude the distal end portions of the pushing arms 78 from the channel portions 74. In this state, the pushing arms 78 move toward the alignment conveyor 54 side.

Accordingly, the paper sheaves 12A are pushed by the pushing arms 78 and moved in the guides 66 toward the alignment conveyor 54. At this time, the width direction one end sides of the paper sheaves 12A abut against the standing walls 72, and length direction one end sides (transport direction upstream sides) of the paper sheaves 12A abut against the pushing arms 78. As a result, the aligned state is preserved.

As shown in FIG. 4, a conveyor belt 82 is provided at the alignment conveyor 54. The conveyor belt 82 is arranged so as to be movable along the width direction of the papers 12. As shown in FIG. 5, the paper sheaves 12A that have been pushed by the pushers 76 and moved along the guides 66 are pushed onto the conveyor belt 82 of the alignment conveyor 54.

As shown in FIG. 4, a stopper 84 is disposed at the alignment conveyor 54, at an upper face side of the conveyor belt 82. This stopper 84 is formed substantially in a strip plate shape, and is disposed with a length direction thereof along the width direction of the papers 12. Length direction distal ends of the paper sheaves 12A, which are fed onto the conveyor belt 82 from the guides 66 by the pushers 76 (the pushing arms 78), abut against this stopper 84, and thus the sheaves 12A are placed on the conveyor belt 82 with the length direction distal ends thereof in an aligned state.

A pair of shafts 86 span across the alignment conveyor 54 at a side upward of the conveyor belt 82. These shafts 86 are disposed such that axial directions thereof are along the length direction of the papers 12, which is a direction intersecting the movement direction of the conveyor belt 82. A baseplate 88 spans across between the pair of shafts 86. The baseplate 88 is movable in the axial direction of the shafts 86, and the stopper 84 is mounted at this baseplate 88.

Accordingly, at the alignment conveyor 54, the stopper 84 is disposed at a position corresponding to the dimension of the papers 12 along the length direction thereof. Thus, whatever the dimension along the length direction, the sheaves 12A can be placed on the stopper 84 such that the length direction one end sides thereof are at a predetermined position.

Thus, in the processing system 10, by changing the spacing of the slitting blades 30 and 32 provided at the cutting apparatus 22 (a cutting spacing) and a chopping spacing of the papers 12 at the chopping apparatus 24, it is possible to produce the papers 12 with freely selected longitudinal and lateral dimensions. At the same time, because the tray portions 56 and guides 66 at the stacking apparatus 26 are disposed in accordance with the lateral dimension of the papers 12 being produced and the stopper 84 is disposed at a position according to the longitudinal dimension of the papers 12 being produced, it is possible to stack arbitrary sizes of the papers 12.

At the alignment conveyor 54, the plurality of paper sheaves 12A that are placed on the conveyor belt 82 in the aligned state can be sequentially fed out when the conveyor belt 82 is driven by unillustrated driving means.

Figure 6:
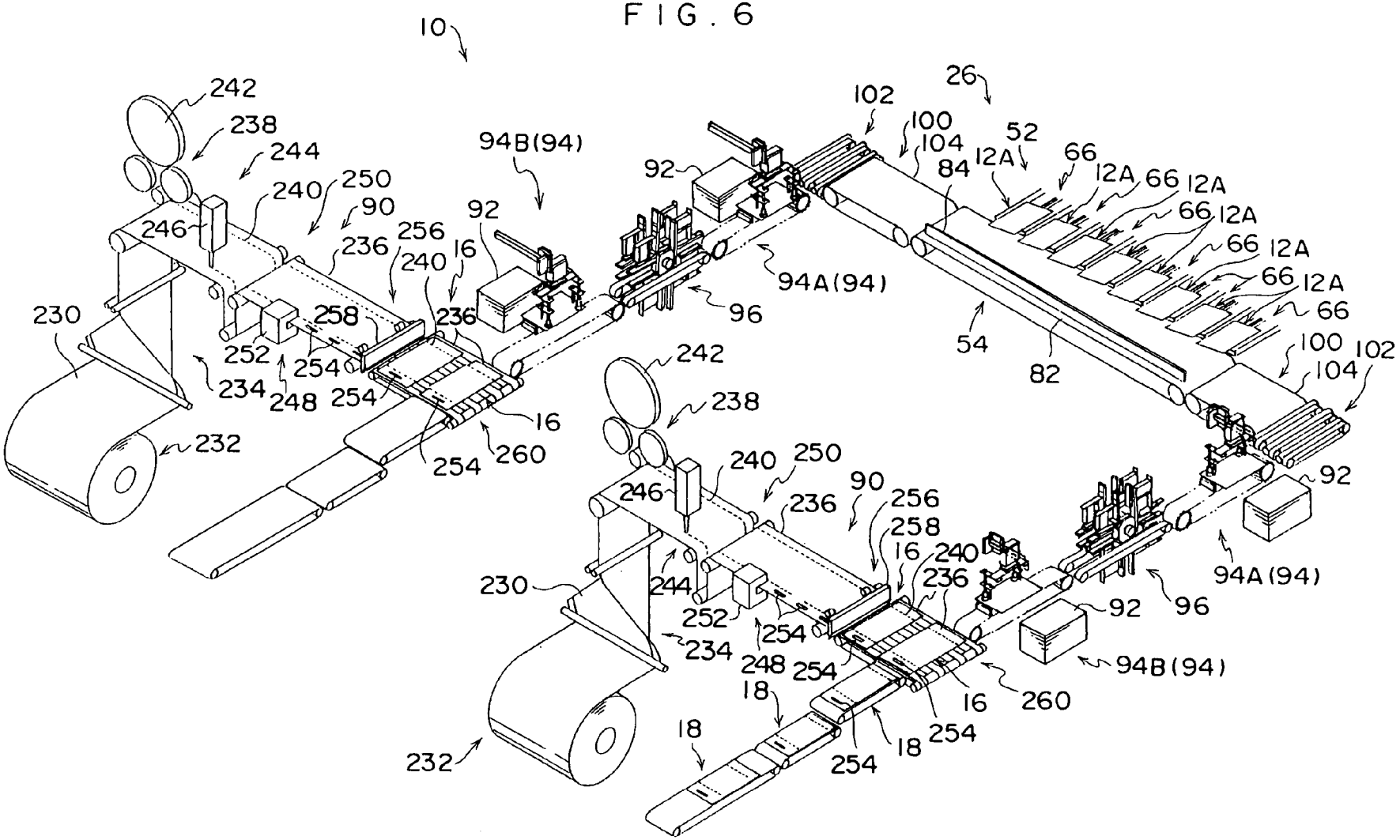
FIG. 6 is a schematic perspective view showing principal portions of the system, from the stacking apparatus to a bagging apparatus.

Anyway, as shown in FIG. 1, packing processing is carried out in the processing system 10 for accommodating the paper sheaves 12A in the wrappers 16. As shown in FIG. 6, a bagging apparatus 90 is provided in the processing system 10 at a downstream side of the stacking apparatus 26. The paper sheaves 12A are fed out from the alignment conveyor 54 and hence transported to the bagging apparatus 90.

However, in the processing system 10, before the paper sheaves 12A are collected in the wrappers 16, cover sheets 92 are superposed on upper and lower faces of the paper sheaves 12A, with the intention of protecting surfaces of the papers 12, and preventing damage such as creasing and the like. Accordingly, two cover sheet application devices 94A and 94B are provided in the processing system 10, partway along a transport path to the bagging apparatus 90. An inversion apparatus 96 is also provided in the processing system 10, between the two cover sheet application devices 94A and 94B. Devices having the same functionality can be employed for the cover sheet application devices 94A and 94B (which are hereafter referred to when speaking generally as "cover sheet application devices 94"). Thus, the sheaves 12A are sandwiched by the cover sheets 92.

Below, a process for packing of the papers 12 (the paper sheaves 12A) in the processing system 10 relating to the first embodiment will be described.

As shown in FIG. 6, from the alignment conveyor 54 provided at the stacking apparatus 26, the paper sheaves 12A can be fed out in two directions by switching a direction of driving of the conveyor belt 82. Hence, by employing two of the bagging apparatus 90 in the processing system 10, the sheaves 12A of the papers 12 can be divided into two lines for implementing the packing process. Here, the respective lines may be for applying the packing process to a common size of the papers 12, and may be for applying the packing process to different sizes of the papers 12. Because basic structures of the lines can be the same, explanations are given for one line hereafter, as is shown in FIG. 1.

Figure 7:
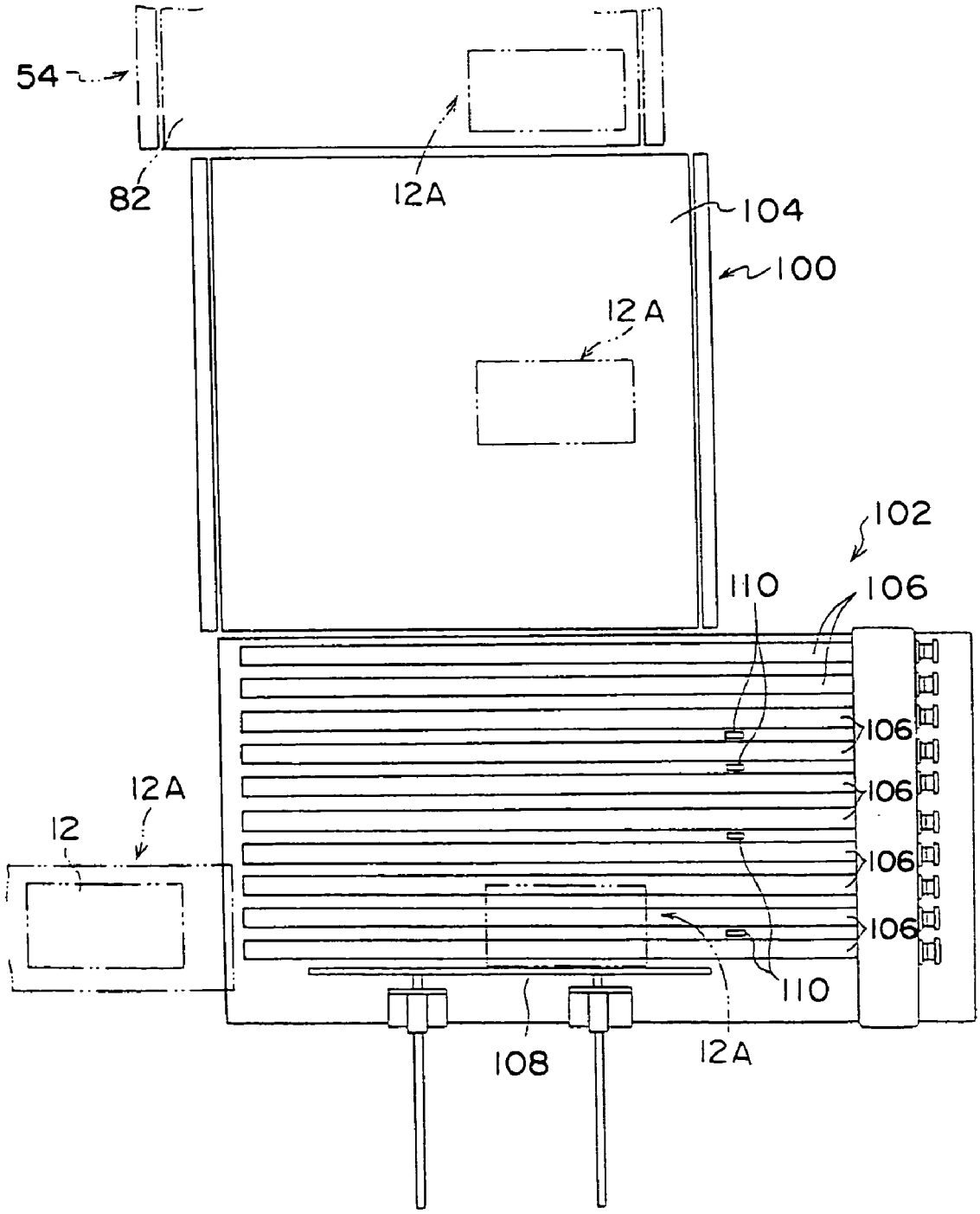
FIG. 7 is a schematic plan view showing a transport conveyor and a transfer conveyor.

As shown in FIGS. 6 and 7, a transport conveyor 100 and a transfer conveyor 102 are provided at a downstream side of the alignment conveyor 54, which is provided at the stacking apparatus 26 of the processing system 10. Note that the transport conveyor 100 may be omitted, with the transfer conveyor 102 being disposed adjacent to the alignment conveyor 54.

As shown in FIG. 7, a transport belt 104 is provided at the transport conveyor 100. When the conveyor belt 82 at the alignment conveyor 54 is driven to turn, the paper sheaves 12A are transported in the width direction, and are sequentially fed onto the transport belt 104 of the transport conveyor 100.

When the transport belt 104 of the transport conveyor 100 is driven to turn by driving force of unillustrated driving means, the paper sheaves 12A that are fed from the alignment conveyor 54 are transported further in the width direction, and are fed to the transfer conveyor 102.

Here, a transport speed at the transport conveyor 100 (a cycling rate of the transport belt 104) is higher than a transport speed at the alignment conveyor 54. Consequently, spacing between the paper sheaves 12A is greatly increased while the paper sheaves 12A are being fed to the transfer conveyor 102.

A plurality of small rollers 106 are provided at the transfer conveyor 102 with a predetermined spacing. The small rollers 106 are respectively disposed such that axial directions thereof are along the length direction of the papers 12 that are fed in from the transport conveyor 100 (the left-right direction of the drawing of FIG. 7). The small rollers 106 are rotated by driving force of unillustrated driving means.

Accordingly, the paper sheaves 12A that are fed to the transfer conveyor 102 from the transport conveyor 100 are supported by the small rollers 106 and transported in the width direction (the vertical direction in the drawing of FIG. 7).

Further, at the transfer conveyor 102, a stopper 108 is provided at a predetermined position at a downstream side relative to the direction of transport of the papers 12 by the small rollers 106. The stopper 108 is formed in a strip plate form, and is disposed such that a length direction thereof is along the length direction of the papers 12, which is the axial direction of the small rollers 106. Width direction end portions of the paper sheaves 12A that are transported by the small rollers 106 abut against the stopper 108. Thus, the paper sheaves 12A are stopped at a predetermined position on the transfer conveyor 102.

Pushing members 110 are also provided at the transfer conveyor 102, between mutually adjacent small rollers 106. The pushing members 110 move in the axial direction of the small rollers 106. These pushing members 110 are provided at, for example, predetermined positions of an endless chain. When this chain is driven to turn, the pushing members 110 protrude at one end side in the axial direction of the small rollers 106, move toward the other end side thereof, and then withdraw downward.

When the pushing members 110 protruding from between the small rollers 106 move between the small rollers 106, the paper sheaf 12A that has been stopped at the predetermined position of the transfer conveyor 102 by the stopper 108 is pushed by the pushing members 110, moves in the length direction, and is fed out from the transfer conveyor 102.

At this time, because the small rollers 106 are being driven to rotate, one width direction end side of the paper sheaf 12A abuts against the stopper 108 while the paper sheaf 12A is moving. Thus, the paper sheaf 12A is fed out from the transfer conveyor 102 in a state in which the length direction and width direction thereof are aligned. Furthermore, because the paper sheaf 12A abuts against the stopper 108 in this manner, the paper sheaf 12A is fed out from the transfer conveyor 102 in a state in which the paper sheaf 12A is positioned in the width direction.

Thus, consequent to the paper sheaves 12A that have been lined up along the width direction on the alignment conveyor 54 being fed in at the transfer conveyor 102, the paper sheaves 12A are transported in the length direction and fed out.

Anyway, as shown in FIG. 6, the cover sheet application device 94A (94), the inversion apparatus 96 and the cover sheet application device 94B (94) are provided in the processing system 10, at a downstream side in the direction in which the paper sheaves 12A are fed out by the transfer conveyor 102, and the bagging apparatus 90 is provided at a downstream side of the cover sheet application device 94B. As mentioned above, the cover sheet application devices 94A and 94B have the same basic structure, and are described as the cover sheet application device 94 for the present embodiment.

Figure 8:
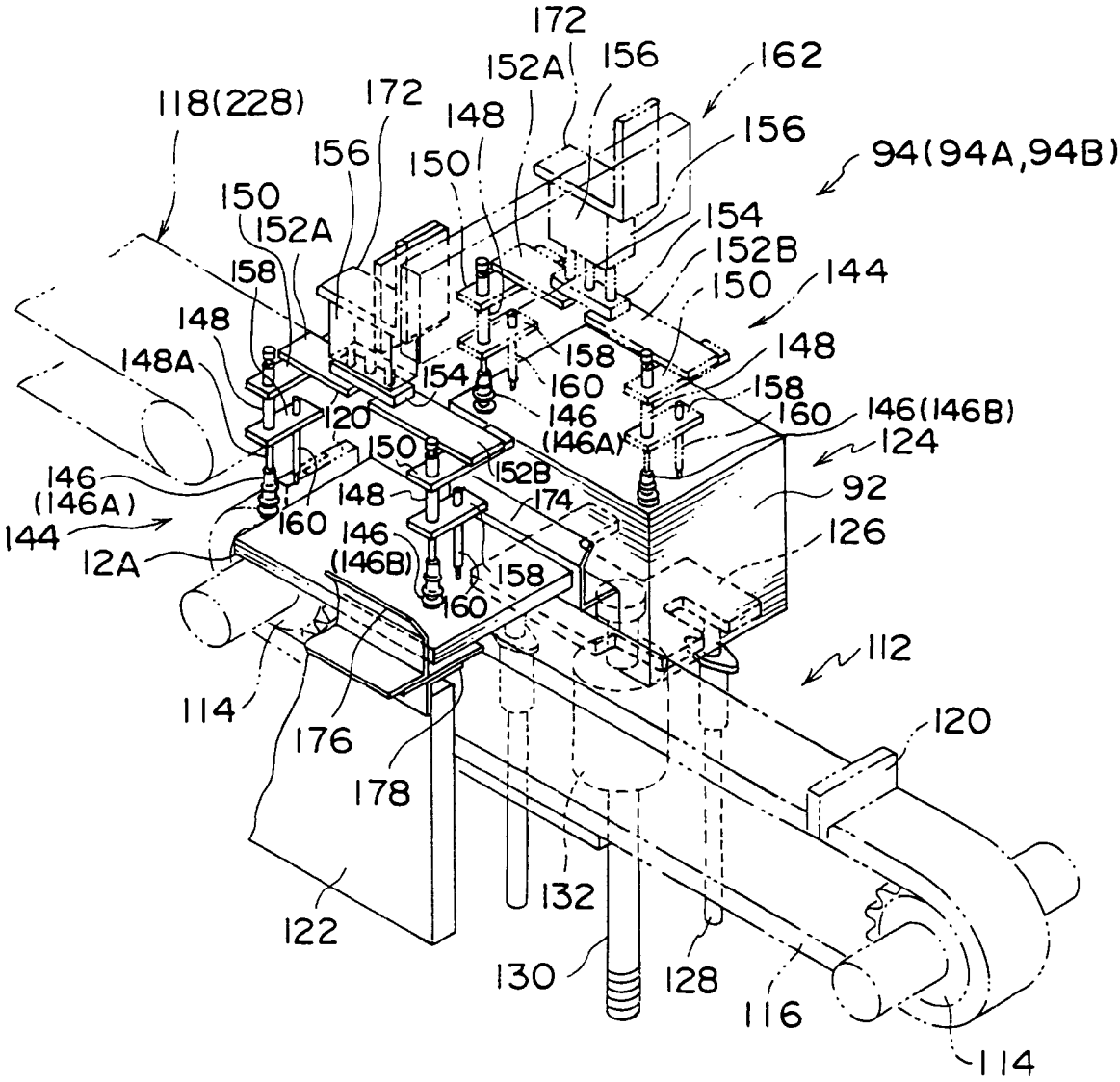
FIG. 8 is a schematic perspective view of a cover paper application device.
Figure 9:
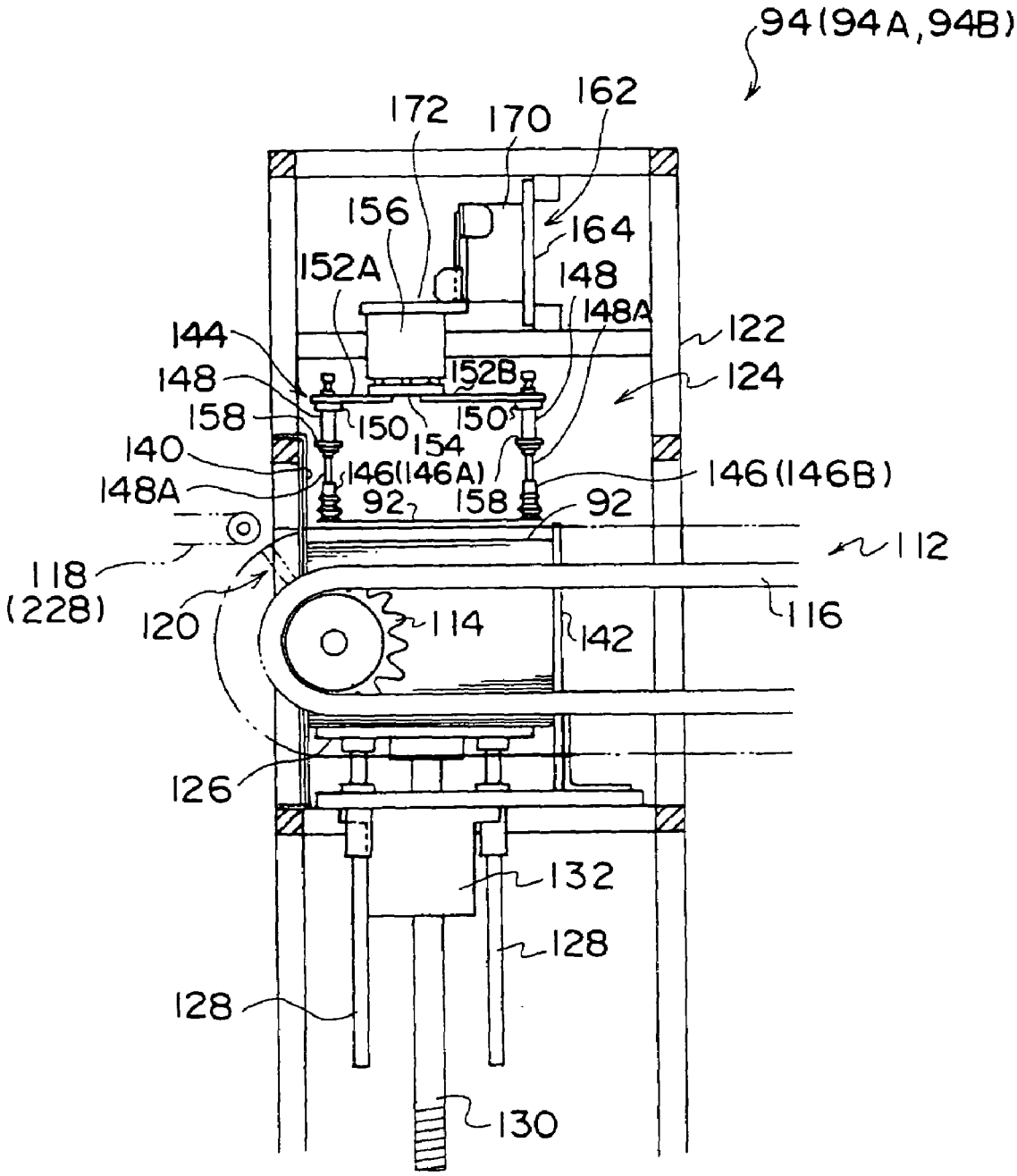
FIG. 9 is a schematic side view of the cover paper application device, viewed from a paper width direction side.
Figure 10:
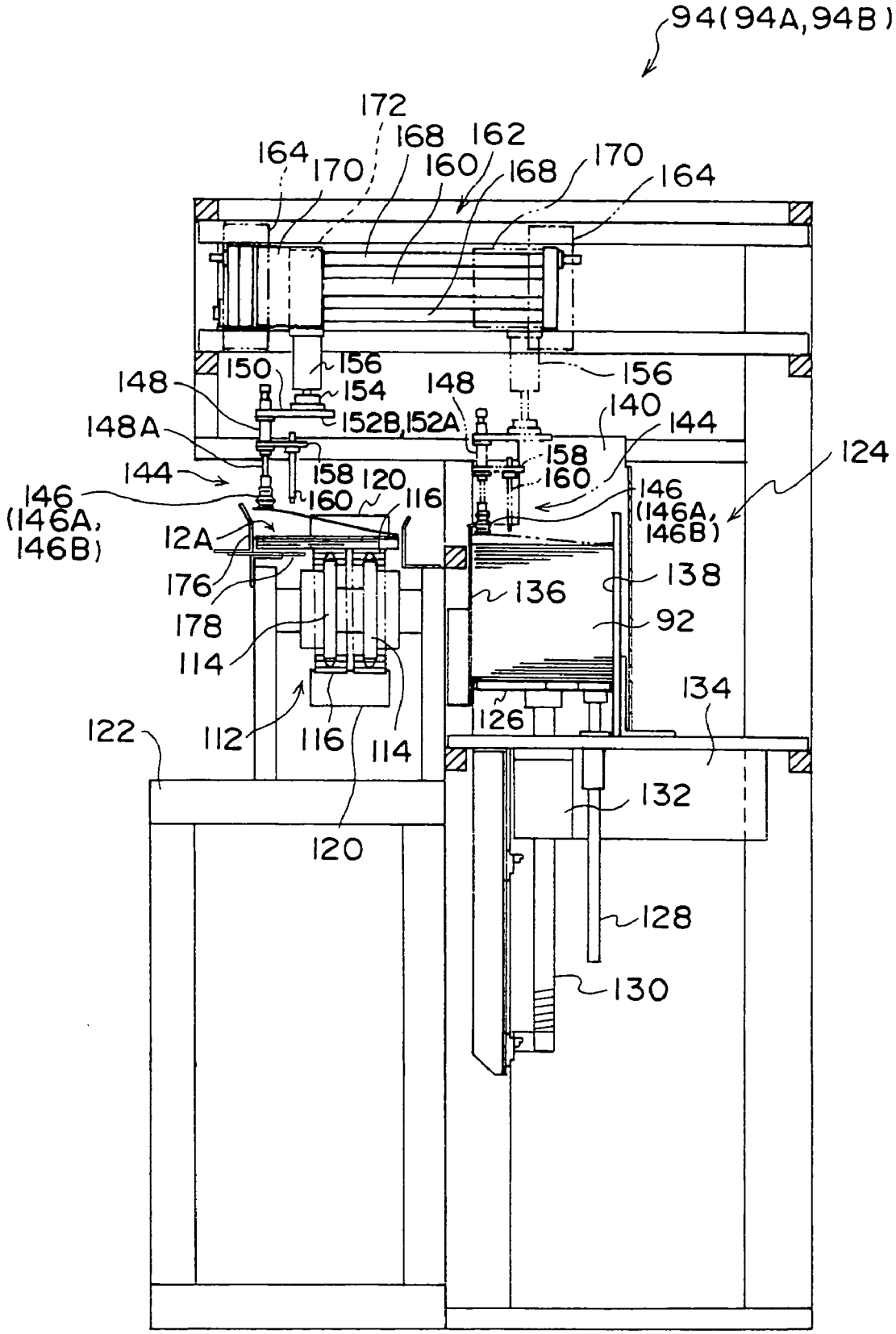
FIG. 10 is a schematic view of the cover paper application device, viewed from a paper transport direction downstream side.

As shown in FIGS. 8 to 10, the cover sheet application device 94 is equipped with a transport conveyor 112. At both of end portions of this transport conveyor 112, sprockets 114 (only one of which is shown in FIGS. 9 and 10) are provided. An endless transport belt 116 is wound round these sprockets 114. As shown in FIG. 10, the sprockets 114 are provided, for example, as pairs along the width direction of the papers 12. At the transport belt 116, unillustrated chains are wound around the respective sprockets 114, and the transport belt 116 is driven to turn by driving force of driving means (not shown).

As shown in FIGS. 8 and 9, the paper sheaf 12A is fed in to the cover sheet application device 94A by a transport conveyor 118, which is provided between the cover sheet application device 94A and the transfer conveyor 102, and this paper sheaf 12A is placed on the transport conveyor 112.

Hence, when the paper sheaf 12A has been placed on the transport belt 116 of the transport conveyor 112, the transport conveyor 112 transports this paper sheaf 12A in the length direction. It is also possible to feed the paper sheaf 12A onto the transport conveyor 112 from the transfer conveyor 102 without utilizing the transport conveyor 118.

As shown in FIGS. 8 to 10, pushing blocks 120 are provided at the transport belt 116 with a predetermined spacing. The pushing blocks 120 move integrally with the transport belt 116 in accordance with the turning of the transport belt 116. It is also possible for two transport belts to be joined by the pushing blocks 120 and moved integrally to serve as the transport conveyor 112.

The transport conveyor 112 is mounted at a frame 122 of the cover sheet application device 94. A cover sheet loading section 124 is provided adjacent to the transport conveyor 112 at the cover sheet application device 94. In FIG. 8, the frame 122 is only partially shown in the drawing.

As shown in FIGS. 8 and 10, a baseplate 126 is provided at the cover sheet loading section 124. The cover sheets 92, with a size corresponding to the size of the papers 12, are stacked and loaded on this baseplate 126. The cover sheet application device 94 takes the topmost of these cover sheets 92 and superposes the same with the sheaf 12A of the papers 12 that has been fed to the transport conveyor 112 by placing that cover sheet 92 on the transport conveyor 112.

The cover sheet application device 94 is formed such that the paper sheaf 12A is transported along the length direction thereof by the transport conveyor 112. The cover sheet loading section 124 is disposed adjacent to this transport conveyor 112, and the cover sheets 92 are disposed with a length direction thereof along the transport direction of the paper sheaf 12A.

The baseplate 126 is joined to a pair of guide shafts 128, at a lower face of the baseplate 126, and a distal end of a lead screw 130. The pair of guide shafts 128 and the lead screw 130 are disposed with length directions thereof parallel with one another along a vertical direction. The guide shafts 128 are vertically movably mounted at the frame 122.

A gearbox 132 is also mounted at the frame 122. The lead screw 130 passes through this gearbox 132. An unillustrated feed nut is provided inside the gearbox 132. The lead screw 130 is vertically movably supported by screwingly engaging with this feed nut. The baseplate 126 is supported to be vertically, levelly movable by the lead screw 130 and the guide shafts 128.

As shown in FIG. 10, a raising/lowering motor 134 is coupled with the gearbox 132. This raising/lowering motor 134 drives the feed nut in the gearbox 132 to rotate, and thus vertically moves the lead screw 130 and the baseplate 126.

In the cover sheet loading section 124, the raising/lowering motor 134 drives such that the topmost of the cover sheets 92 that are stacked on the baseplate 126 is substantially at a certain height. In other words, in the cover sheet loading section 124, the topmost of the cover sheets 92 is set substantially to the certain height by driving of the raising/lowering motor 134 in accordance with a quantity of the cover sheets 92 that are piled up on the baseplate 126.

As shown in FIG. 10, a guide plate 136 is provided at the cover sheet loading section 124, at the transport conveyor 112 side thereof. A movable guide 138, which is horizontally movable in a direction toward/away from this guide plate 136, is provided facing the guide plate 136. As shown in FIG. 9, a guide plate 140 is provided at the cover sheet loading section 124, at an upstream side in the direction of transport of the papers 12. A movable guide 142, which is horizontally movable in a direction toward/away from this guide plate 140, is provided facing the guide plate 140.

Thus, in the cover sheet loading section 124, the guide plate 136 serves as a width direction reference point, and the guide plate 140 serves as a length direction reference point, and the cover sheets 92 are positioned when loaded. Further, by moving the movable guide 138 and the movable guide 142 of the cover sheet loading section 124, positioning is possible when loading the cover sheets 92 with a freely selected size.

Anyway, as shown in FIGS. 8 to 10, a leaf unit 144 is disposed at the cover sheet application device 94, above the baseplate 126. At the cover sheet application device 94, this leaf unit 144 is movable between a drawing position, which opposes the topmost of the cover sheets 92 that are loaded in the cover sheet loading section 124, and a placing position, which opposes the transport conveyor 112.

A plurality of suction pads 146 are provided at this leaf unit 144. In the cover sheet application device 94, the topmost of the cover sheets 92 that are stacked on the baseplate 126 is suction-adhered and drawn out by the suction pads 146 at the drawing position, and transported onto the transport conveyor 112.

The leaf unit 144 of the present embodiment is provided with, as an example, two suction pads 146A and 146B (below referred to when speaking generally as "the suction pads 146"). The suction pads 146A and 146B are respectively attached to distal ends of rods 148A of air cylinders 148. These air cylinders 148 are attached to support plates 150 such that the rods 148A are oriented downward.

Accordingly, it is possible to raise the plurality of suction pads 146 respectively individually by retracting the rods 148A of the air cylinders 148.

The support plates 150 at which the suction pads 146 are provided are attached to bases 152A and 152B. The bases 152A and 152B are respectively attached to a joining plate 154. Here, the base 152B, at which the suction pad 146B is attached, is attached to the joining plate 154 so as to be movable in the length direction of the cover sheets 92 (and of the papers 12).

Accordingly, a spacing of the suction pad 146A and the suction pad 146B at the leaf unit 144 can be altered in accordance with a length dimension of the cover sheets 92 without changing a position of the suction pad 146A, such that both end portions in the length direction of the cover sheets 92 will be suction-adhered. Further, when the leaf unit 144 moves to the drawing position, the suction pads 146 oppose the guide plate 136 side end portion of the cover sheets 92.

A raising/lowering cylinder 156 is disposed upward of the joining plate 154. The raising/lowering cylinder 156 is equipped with a rod 156A and a pair of shafts 156B. Distal ends of the rod 156A and the shafts 156B are joined to the joining plate 154. Thus, the leaf unit 144 is supported.

The suction pads 146 of the leaf unit 144 descend when the rod 156A of the raising/lowering cylinder 156 is extended. Thus, suction-adherence of the cover sheet 92 is enabled.

Further, at the leaf unit 144, brackets 158 are attached to the air cylinders 148. As shown in FIGS. 8 and 10, pins 160 are attached at these brackets 158. When the leaf unit 144 is lowered and the cover sheet 92 is suction-adhered by the suction pads 146, distal ends of the pins 160 abut against the cover sheet 92.

At the leaf unit 144, when the cover sheet 92 has been suction-adhered by the suction pads 146, the rods 148A of the air cylinders 148 are retracted and the suction pads 146 are raised. At this time, because the distal ends of the pins 160 abut against the cover sheet 92, the suction pads 146 can lift a width direction end portion of the cover sheet 92 while the next cover sheet 92 is separated from the topmost cover sheet 92, which is suction-adhered by the suction pads 146. Thus, the topmost of the cover sheets 92 can be reliably drawn out alone.

As shown in FIG. 10, a sliding unit 162 is provided at the frame 122. Bases 164 are disposed, as a pair, at the transport conveyor 112 side and the cover sheet loading section 124 side of the sliding unit 162. A rodless cylinder 166 and a pair of guide shafts 168 are disposed between these bases 164. The rodless cylinder 166 and the guide shafts 168 are mounted so as to be parallel with one another along the width direction of the papers 12.

A driving block 170 is provided at the rodless cylinder 166 and the guide shafts 168. The driving block 170 is moved along the width direction of the papers 12 by operation of the rodless cylinder 166.

As shown in FIGS. 9 and 10, a substantially 'L'-shaped bracket 172 is attached to the driving block 170. The raising/lowering cylinder 156 is mounted at this bracket 172.

Thus, the leaf unit 144 is moved between the drawing position and the placing position by operation of the rodless cylinder 166.

Meanwhile, as shown in FIGS. 8 and 10, guide plates 174 and 176 are disposed at the frame 122, as a pair sandwiching the transport conveyor 112. The guide plate 174, at the cover sheet loading section 124 side of the transport conveyor 112, is fixed at a predetermined position relative to the transport conveyor 112. The guide plate 176, which opposes the guide plate 174, is movable toward and away from the guide plate 174.

In the cover sheet application device 94, a spacing between the guide plates 174 and 176 is adjusted in accordance with the width dimension of the papers 12 by moving the guide plate 176.

A support plate 178 is provided extending from the guide plate 176 toward the transport conveyor 112.

At the cover sheet application device 94, before the sheaf 12A of the paper 12 is fed on to the transport conveyor 112, the cover sheet 92 which has been loaded at the cover sheet loading section 124 is drawn out by the leaf unit 144, transported to between the guide plates 174 and 176, and brought down on to the transport conveyor 112. At this time, positioning of the cover sheet 92 in the width direction is implemented by the guide plates 174 and 176.

The cover sheet 92 that has been disposed between the guide plates 174 and 176 is supported at the support plate 178. Thus, mispositioning of the cover sheet 92 due to movement of the transport belt 116 of the transport conveyor 112 is prevented.

In the cover sheet application device 94, the cover sheet 92 is disposed on the transport conveyor 112 before the paper sheaf 12A is fed on to the transport conveyor 112, and when the sheaf 12A of the papers 12 is fed on to the transport conveyor 112, the sheaf 12A of the papers 12 is superposed with the cover sheet 92. At this time, the sheaf 12A of the papers 12 and the cover sheet 92 are aligned by the guide plates 174 and 176.

In this state, when the transport belt 116 is driven to turn, the cover sheet 92, together with the sheaf 12A of the papers 12, is pushed by the pushing block 120, removed from the support plate 178 and placed on the transport belt 116, and transported in a state which has been aligned in the length direction.

The transport conveyor 112 provided at the cover sheet application device 94 feeds this paper sheaf 12A toward the inversion apparatus 96.

Figure 11:
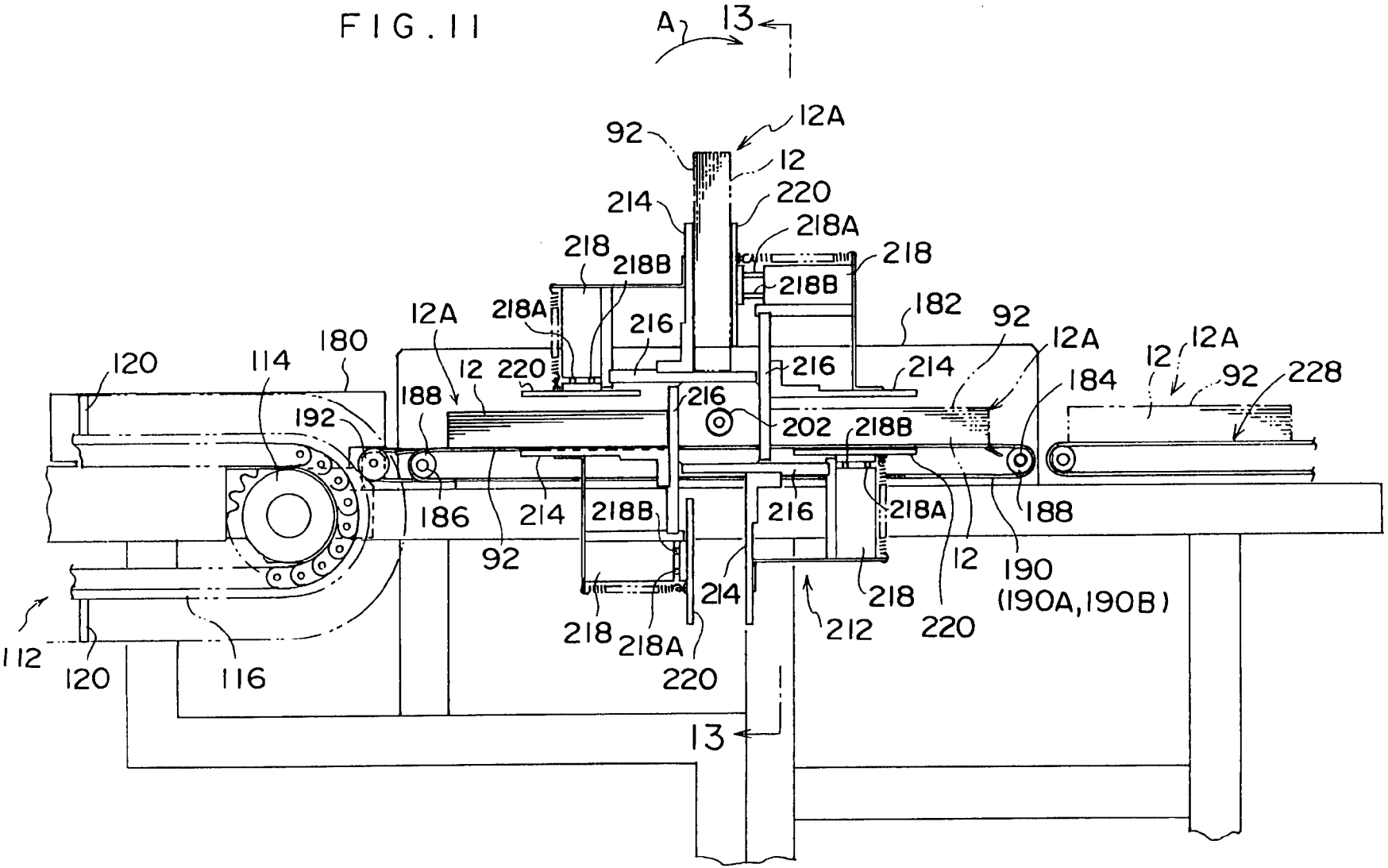
FIG. 11 is a schematic side view of an inversion apparatus, viewed from a paper width direction side.
Figure 12:
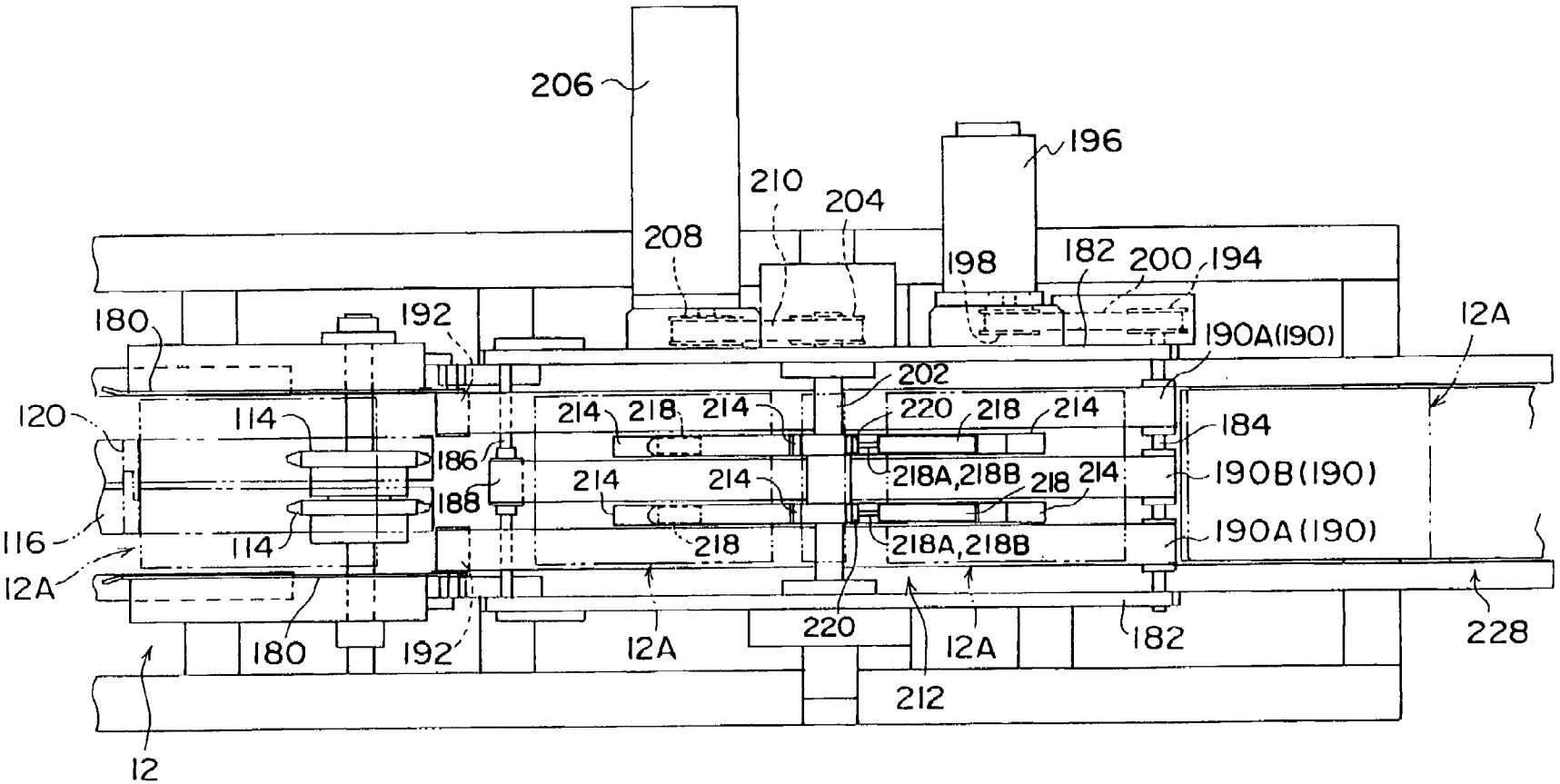
FIG. 12 is a schematic plan view of the inversion apparatus

As shown in FIGS. 11 and 12, the inversion apparatus 96 is joined to, for example, a downstream side end portion of the transport conveyor 112. The paper sheaf 12A with the cover sheet 92 disposed at the lower face thereof is transported and fed to the inversion apparatus 96 by the transport conveyor 112. Here, guides 180 are disposed at the transport conveyor 112, as a pair at both sides in the width direction of the papers 12. Thus, the paper sheaf 12A is fed in to the inversion apparatus 96 while being positioned in the width direction.

Figure 13:
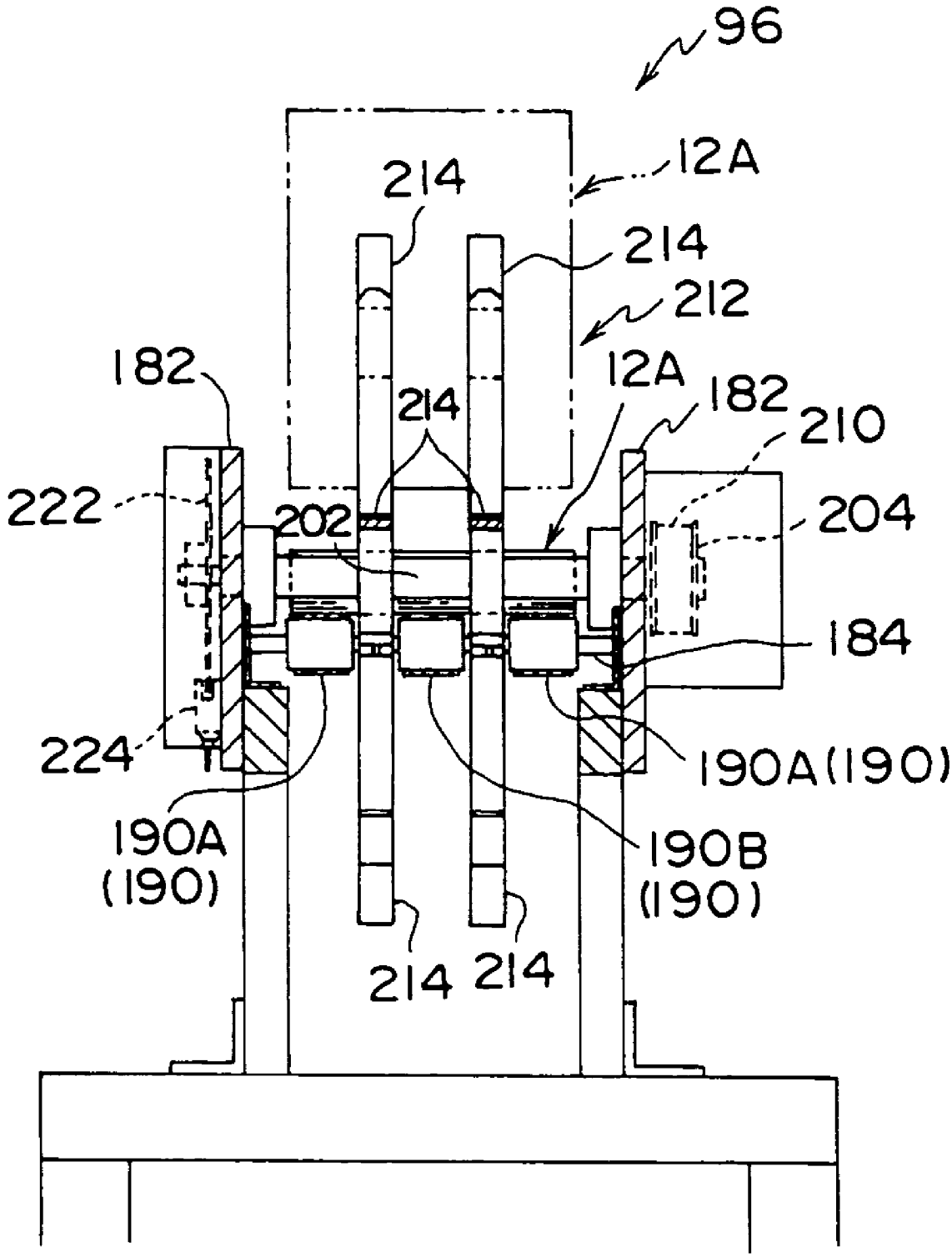
FIG. 13 is a schematic sectional view along line 13—13 of FIG. 11.

As shown in FIGS. 11 to 13, the inversion apparatus 96 is equipped with a pair of side plates 182, which are respectively disposed along the length direction of the papers 12. The paper sheaf 12A is fed in between this pair of side plates 182.

As shown in FIGS. 11 and 12, a shaft 184 spans between the side plates 182 at an end portion thereof at a downstream side in the transport direction of the papers 12 (the right side of the drawings of FIGS. 11 and 12), and a shaft 186 spans between the side plates 182 at the upstream side thereof.

As shown in FIG. 12, three of small rollers 188 are mounted at the shaft 184 with a predetermined spacing, so as to rotate integrally. Transport belts 190A are wound round at the small rollers 188 which are at the two end sides in the axial direction of the shaft 184, and a transport belt 190B is wound round at the small roller 188 in the middle.

Another of the small rollers 188 is mounted at a central portion of the shaft 186 in the length direction thereof, and the transport belt 190B is wound round at this small roller 188. Rollers 192 are axially supported at the side plates 182 in opposition with the small rollers 188 that are at the two end sides in the axial direction of the shaft 184. The transport belts 190A are wound round at the respective rollers 192.

At the inversion apparatus 96, the paper sheaf 12A is placed on these transport belts 190A and 190B (below referred to when speaking generally as transport belts 190). Here, as shown in FIG. 12, the rollers 192 protrude at the transport conveyor 112 side relative to the shaft 186. Thus, in plan view, the transport belt 116 of the transport conveyor 112 approaches so as to enter in between the rollers 192. As a result, the paper sheaf 12A is reliably fed on to the transport belts 190 from the transport conveyor 112.

A pulley 194 is mounted at a distal end portion of the shaft 184, which protrudes through one of the side plates 182. A transport motor 196 is mounted at this side plate 182. An endless timing belt 200 is wound round between a pulley 198, which is mounted at a driving shaft of this transport motor 196, and the pulley 194 of the shaft 184.

Accordingly, at the inversion apparatus 96, when the transport motor 196 drives, the shaft 184 rotates and drives the transport belts 190. Thus, the paper sheaf 12A that has been placed on the transport belts 190 is transported.

Further, as shown in FIGS. 11 to 13, a rotary shaft 202 spans between the pair of side plates 182 in the inversion apparatus 96. This rotary shaft 202 is axially supported at a side upward of the transport belts 190.

As shown in FIG. 12, a pulley 204 is mounted at a distal end portion of the rotary shaft 202, which protrudes through the one of the side plates 182. An inversion motor 206 is mounted at this side plate 182, adjacent to the transport motor 196. An endless timing belt 210 is wound round between a pulley 208, which is mounted at a driving shaft of this inversion motor 206, and the pulley 204.

Accordingly, when the inversion motor 206 operates, the rotary shaft 202 rotates in the direction of arrow A in FIG. 11 (clockwise in the drawing of FIG. 11).

As shown in FIGS. 11 to 13, a paper-gripping portion 212 is formed at the rotary shaft 202. The paper-gripping portion 212 is equipped with four support bars 214 sets, which are respectively equipped with the support bars 214.

As shown in FIG. 11, the support bars 214 are respectively provided standing perpendicularly from length direction central portions of strip plate-like base portions 216, and are assembled in substantial 'T' shapes. Each of the base portions 216 is mounted such that one end side thereof opposes the length direction central portion of a neighboring one of the base portions 216.

Thus, the support bars 214 that are adjacent in the direction of rotation of the rotary shaft 202 are substantially perpendicular, and each of the support bars 214 is mounted so as to be substantially parallel to the base portion 216 that is adjacent at the downstream side thereof in the direction of rotation.

As shown in FIGS. 12 and 13, the support bars 214 are disposed in pairs along the axis of the rotary shaft 202, and respectively oppose gaps between the transport belts 190A and 190B.

Consequently, when the support bars 214 rotate integrally with the rotary shaft 202, interference with the transport belts 190 is avoided, and the sheaf 12A of the papers 12 that spans across and is supported by the transport belts 190 can be received from the transport belts 190 and supported by the support bars 214.

As shown in FIG. 11, at the inversion apparatus 96, the inversion motor 206 is driven such that the rotary shaft 202 rotates in 90° increments, such that the support bars 214 are either parallel or perpendicular with respect to the transport belts 190. As shown in FIG. 13, a slit plate 222 and a sensor 224 are provided. The slit plate 222 is provided at a distal end of the rotary shaft 202, at a side thereof that is opposite to the end at which the pulley 204 is provided. The sensor 224 detects unillustrated slit holes which are formed with a certain spacing at an outer peripheral portion of the slit plate 222. By rotating the rotary shaft 202 in accordance with results of detection from this sensor 224, the support bars 214 can be stopped at predetermined positions.

At the inversion apparatus 96, when a set of the support bars 214 are substantially parallel to the transport belts 190, the base portion 216 at which those support bars 214 are mounted protrudes substantially perpendicularly from between the transport belts 190 (the transport belts 190A and the transport belt 190B).

Further, in the inversion apparatus 96, when a set of the support bars 214 are parallel with the transport belts 190 at the upstream side in the transport direction of the papers 12, upper faces of the support bars 214 are substantially coplanar with the transport belts 190 or slightly lower than upper faces of the transport belts 190, and when the support bars 214 are parallel with the transport belts 190 at the downstream side in the transport direction of the papers 12, a spacing between the support bars 214 and the upper faces of the transport belts 190 is slightly wider than a thickness of the sheaf 12A of the papers 12 at which the cover sheet 92 has been superposed.

Accordingly, the paper sheaf 12A, which has been fed in from the cover sheet application device 94A, placed on the transport belts 190 and transported, abuts against the base portion 216 at a position at which the cover sheet 92 at the lower face side of the sheaf 12A opposes the support bars 214, and the paper sheaf 12A stops.

Air cylinders 218 are provided at the respective base portions 216 and oppose the support bars 214 that are at the rotation direction upstream side thereof. At the air cylinders 218, rods 218A and guide shafts 218B are disposed in pairs. At respective distal ends of the air cylinders 218, facing plates 220 are mounted. The respective facing plates 220 oppose the support bars 214 that are adjacent at the rotation direction upstream side, and are substantially parallel therewith.

Thus, when one of the air cylinders 218 operates and the rods 218A extend, the facing plates 220 move toward the support bars 214, being parallel therewith, and the paper sheaf 12A that has stopped abutting against the base portion 216 is sandwichingly retained (gripped) by being pushed against the support bars 214.

When the paper sheaf 12A is gripped by the support bars 214 and the facing plates 220 in the inversion apparatus 96, the inversion motor 206 drives and rotates the rotary shaft 202. As a result, the paper sheaf 12A is inverted, and at the same time is opposed with the transport belts 190 at the paper transport direction downstream side relative to the rotary shaft 202.

At this time, operation of the air cylinders 218 stops and gripping force on the paper sheaf 12A is released. Hence, the paper sheaf 12A is placed on the transport belts 190 with the cover sheet 92 at the upper face side of the paper sheaf 12A. The paper sheaf 12A is transported by driving of the transport belts 190, and is fed out from the inversion apparatus 96 to, for example, a transport conveyor 228.

Tension coil springs 226 are provided adjacent to the air cylinders 218 at the base portions 216. When the operation of the air cylinders 218 is released, the rods 218A and the guide shafts 218B are promptly retracted by urging force of these tension coil springs 226. Thus, the facing plates 220 are separated from the paper sheaf 12A.

Hence, it is possible to commence transport by the transport belts 190 without disrupting the paper sheaf 12A.

The paper sheaf 12A that has been inverted in this manner and fed out from the inversion apparatus 96 is fed to the cover sheet application device 94B, which is disposed at a downstream side of the inversion apparatus 96. Specifically, at the cover sheet application device 94B, the transport conveyor 118 shown in FIGS. 8 and 9 is equivalent to the transport conveyor 228 which feeds the paper sheaf 12A out from the inversion apparatus 96. Note that the transport conveyor 228 need not be provided and the paper sheaf 12A may be fed to the cover sheet application device 94B (i.e., the transport conveyor 112 thereof) by the transport belts 190 of the inversion apparatus 96.

At the cover sheet application device 94B, the cover sheets 92 are superposed with lower faces of the paper sheaves 12A that have been fed in from the inversion apparatus 96, and are fed out. Thus, the cover sheets 92 are superposed with both upper and lower face sides of the paper sheaves 12A that are fed out from the cover sheet application devices 94.

As shown in FIG. 6, the bagging apparatus 90 is provided at a downstream side of the cover sheet application device 94B. Note that a bagging apparatus is not limited to the apparatus shown, and freely selected structures may be employed (although not described herein).

At this bagging apparatus 90, wrapping pouches (the wrappers 16) are formed using a long belt of wrapping film 230 with a predetermined width. A wrapping material roll 232, in which the wrapping film 230 is wound up in the form of a roll, is loaded at the bagging apparatus 90. The wrapping film 230 is drawn out from this wrapping material roll 232 and is fed to a folding section 234.

At the folding section 234, the wrapping film 230 is folded over at a width direction central portion thereof and superposed. Here, because the folding direction is longer, a cap portion 236 is formed.

A sealing tape application device 238 is provided at a downstream side of the folding section 234 (i.e., a downstream side in a transport direction of the wrapping film 230). The sealing tape application device 238 draws out sealing tape, such as an adhesive tape or the like, from a tape roll 242, and adheres the sealing tape along the length direction of the wrapping film 230 at a width direction end portion thereof at the cap portion 236 side, at which the wrapping film 230 is superposed with itself.

A sealing section 244 is also disposed at the downstream side of the folding section 234. A melt-adhesion device 246 is provided at the sealing section 244. At the sealing section 244, upper and lower layers of the superposed wrapping film 230 are melt-adhered and joined continuously along the length direction of the wrapping film 230, at a position which is separated by precisely a predetermined distance from the folded portion of the wrapping film 230.

A punching section 248 is provided at a downstream side of the sealing section 244. A buffer section 250 is formed between the sealing section 244 and the punching section 248.

A puncher 252 is provided at the punching section 248. The wrapping film 230 is fed into the punching section 248 in increments of a certain amount. At the punching section 248, punch holes 254 are formed between the folded portion of the wrapping film 230 and the joined portion that has been formed by the melt-adhesion device 246.

Here, the feed amount of the wrapping film 230 is an amount corresponding to the width dimension of the papers 12. Accordingly, the punch holes 254 are formed with a spacing corresponding to the width dimension of the papers 12. The buffer section 250 absorbs a difference in speed of the wrapping film 230 between the folding section 234 and the punching section 248 (a difference in transport amounts).

A cutting section 256 is provided at a downstream side of the punching section 248. The cutting section 256 is equipped with a sealing cutter 258, which is disposed along the width direction of the wrapping film 230. The cutting section 256 chops the wrapping film 230, which is transported in increments of the certain amount. At this time, the sealing cutter 258 joins together the chopped position of the wrapping film 230.

Thus, the cap portion 236 side is open, and the wrappers 16 are formed in accordance with the size of the papers 12.

These wrappers 16 are transported in the width direction of the papers 12, which is the length direction of the wrapping film 230, and the wrappers 16 are fed to a packing section 260 in a state in which the cap portion 236 sides of the wrappers 16 are oriented toward the upstream side in the direction of transport of the papers 12.

At the packing section 260, the paper sheaf 12A that has been sandwiched between the cover sheets 92 is fed in from the cover sheet application device 94B. In the packing section 260, the paper sheaf 12A is fed into the wrapper 16 through the cap portion 236 side opening thereof. Thereafter, the cap portion 236 is folded over by the packing section 260 so as to close the opening, the opening is closed, and sealing tape 240 is applied to the folded-over cap portion 236. Thus, the packages 18 in which the paper sheaves 12A are packed in the wrappers 16 are produced. The packages 18 are fed out from the packing section 260, are packaged in cardboard boxes or the like in predetermined numbers to complete packaging, and are stored, shipped and the like.

In the processing system 10 of the papers 12 that is structured thus, when the long web 14A is drawn out from the original web 14 that is loaded at the feeding apparatus 20, this web 14A is wound round the path rollers 28A to 28F while being transported, with a view to eliminating curl, and is then fed into the cutting apparatus 22 by the feed rollers 34.

The pluralities of slitting blades 30 and 32, which are disposed with a spacing corresponding to the width dimension of the papers 12 that are being produced, are provided at the cutting apparatus 22. The web 14A is nipped by these slitting blades 30 and 32, and the slits 36 are formed. As a result, the webs 14B with widths corresponding to the width dimension of the papers 12 are produced. These webs 14B are fed to the chopping apparatus 24 as a unit.

At the chopping apparatus 24, the webs 14B are fed in between the upper blade 44 and the lower blade 46 by the feed rollers 40 in increments of an amount corresponding to the length dimension of the papers 12. Further, at the chopping apparatus 24, when the webs 14B have been fed between the upper blade 44 and the lower blade 46 in the amount corresponding to the length dimension of the papers 12, the upper blade 44 operates and the plurality of webs 14B are chopped simultaneously.

Hence, when the papers 12 with the predetermined width dimension and length dimension have been produced, the produced papers 12 are stacked in the stacking apparatus 26.

At the stacking apparatus 26, the tray portions 56 and guides 66 corresponding to the width dimension of the papers 12 are provided in the same number as the webs 14B that were produced by the cutting apparatus 22. At the stacking section 50, the papers 12 that have been formed by being chopped by the chopping apparatus 24 respectively drop to the tray portions 56. Hence, these papers 12 are stacked in the inclined state.

Therefore, at the stacking section 50, the papers 12 can be stacked while overlapping of the papers 12 that have been produced from neighboring webs 14B is prevented.

When the papers 12 have been stacked in predetermined numbers at the respective tray portions 56, the stacking apparatus 26 causes the stopping arms 80 of the pushers 76 to protrude at the downstream side of the stopping plate 64, and by raising the stopping plate 64, allows the papers 12 that have been stacked in the tray portions 56 to move in the form of the paper sheaves 12A and abut against the stopping arms 80.

Thereafter, by moving the stopping arms 80 along the channel portions 74 to the predetermined position at the guides 66 side, the respective paper sheaves 12A move in the guides 66 while the inclination eases off, without the paper sheaves 12A being disrupted. Then, the pushing arms 78 of the pushers 76 are caused to oppose the tray portion 56 sides of the paper sheaves 12A, and these pushing arms 78 move toward the alignment conveyor 54.

Accordingly, the paper sheaves 12A are respectively pushed against the pushing arms 78, move in the guides 66 toward the alignment conveyor 54, and are pushed onto the conveyor belt 82 of the alignment conveyor 54.

At the alignment conveyor 54, the stopper 84 is disposed at the position corresponding to the length dimension of the papers 12. The papers 12 that have been fed onto the conveyor belt 82 by the pushing arms 78 are abutted against the conveyor belt 82, and thus the papers 12 are lined up along the width direction when placed on the conveyor belt 82.

Thus, in the processing system 10, by providing the cutting apparatus 22, which cuts the web 14A to match the width dimension of the papers 12, and the chopping apparatus 24, which chops the webs 14B to match the length dimension of the papers 12, the papers 12 can be produced smoothly and efficiently at the predetermined size.

In the stacking apparatus 26, the papers 12 that have been produced in parallel in this manner are stacked in the separate tray portions 56. At this time, because the respective tray portions 56 are inclined along the width direction of the papers 12, the papers 12 can be aligned in the width direction when stacked, while the papers 12 are prevented from straddling across neighboring tray portions 56 and overlapping.

Further, at the stacking apparatus 26, because the tray portions 56 are inclined along the length direction of the papers 12, the papers 12 can be aligned in both the width direction and the length direction when stacked.

At the stacking apparatus 26, when the paper sheaves 12A have been thus arranged on the conveyor belt 82, the conveyor belt 82 is driven, and the paper sheaves 12A are moved in the width direction and fed to the transport conveyor 100.

At the transport conveyor 100, the transport belt 104 is driven at a speed which is faster than a speed of movement of the conveyor belt 82, and the paper sheaves 12A that are fed onto the transport belt 104 are fed out to the transfer conveyor 102. Thus, the paper sheaves 12A are fed to the transfer conveyor 102 one after another while intervals between the paper sheaves 12A are widened.

At the transfer conveyor 102, the paper sheaf 12A that is fed in from the transport conveyor 100 is placed on the small rollers 106 and moved in the width direction, and is positioned in the width direction by being stopped at the stopper 108. Then, the paper sheaf 12A is moved in the length direction and fed out by movement of the pushing members 110.

Thus, in the processing system 10, because the transfer conveyor 102 is provided, the plurality of paper sheaves 12A which have been lined up along the width direction on the alignment conveyor 54 can be transported along the length direction one after another, and fed out to the next stage.

The cover sheet application device 94 (94A) is provided in the processing system 10 at the downstream side of the transfer conveyor 102. The paper sheaves 12A are fed in to the cover sheet application device 94.

At the cover sheet application device 94, the cover sheets 92 are stacked in the cover sheet loading section 124. At the cover sheet application device 94, when the topmost of the cover sheets 92 is suction-adhered and drawn out by the suction pads 146 of the leaf unit 144, this cover sheet 92 is transported to the frame 122 side and disposed between the guide plates 174 and 176. At this time, the cover sheet 92 is placed on and supported by the support plate 178 which is provided extending from the guide plate 176.

At the cover sheet application device 94, the spacing of the guide plates 174 and 176 matches the width dimension of the paper sheaves 12A. The paper sheaf 12A is fed in between the guide plates 174 and 176.

Hence, in the cover sheet application device 94, the paper sheaf 12A is superposed on the cover sheet 92 while being positioned in the width direction of the paper sheaves 12A.

The paper sheaf 12A that has been superposed on the cover sheet 92 is pushed against by the pushing block 120 which is formed at the transport belt 116 when the transport conveyor 112 is driven and, having been aligned in the length direction, the paper sheaf 12A is placed on the transport belt 116, transported and fed out to the inversion apparatus 96.

At the inversion apparatus 96, the paper sheaf 12A that has been fed in from the cover sheet application device 94 is placed on the transport belts 190 and transported in the length direction of the paper sheaf 12A.

The paper-gripping portion 212 is provided at the inversion apparatus 96. The paper-gripping portion 212 is formed to include the base portions 216, the support bars 214 and the facing plates 220. The base portions 216 are provided protruding substantially perpendicularly from between the transport belts 190. The support bars 214 are mounted at the base portions 216 and rotatingly move between the transport belts 190, and the facing plates 220 oppose the support bars 214. The paper sheaf 12A is transported by the transport belts 190, abuts against the base portion 216 and stops. Thus, the paper sheaf 12A is disposed between the support bars 214 and the facing plates 220.

When an unillustrated sensor in the inversion apparatus 96 detects that the paper sheaf 12A has abutted against the base portion 216 and stopped, the air cylinders 218 operate, the facing plates 220 move toward the support bars 214, and the paper sheaf 12A is gripped between the support bars 214 and the facing plates 220. Then, the rotary shaft 202 at which the paper-gripping portion 212 is provided is rotated by driving of the inversion motor 206.

As a result, the paper sheaf 12A rotates about the rotary shaft 202, the cover sheet 92 that was disposed at the lower face side of the paper sheaf 12A is oriented to the upper face side thereof, and the paper sheaf 12A is placed on the transport belts 190 at the downstream side of the rotary shaft 202. Here, the operation of the air cylinders 218 is terminated by the inversion apparatus 96 at the time at which the inverted paper sheaf 12A makes contact with the transport belts 190, and the gripping by the support bars 214 and the facing plates 220 is released.

In the state in which the paper sheaf 12A that has been inverted in this manner has the cover sheet 92 superposed at the upper face side, the paper sheaf 12A is transported by the transport belts 190, and is fed out to the cover sheet application device 94 that is disposed at the downstream side of the inversion apparatus 96 (the cover sheet application device 94B).

At the cover sheet application device 94B, one of the cover sheets 92 is taken out from the cover sheet loading section 124 and is disposed between the guide plates 174 and 176. When the paper sheaf 12A is fed in from the inversion apparatus 96 to between these guide plates 174 and 176, the paper sheaf 12A is superposed with this cover sheet 92.

Accordingly, the paper sheaf 12A is superposed at both upper and lower sides by the cover sheets 92, and is fed out from the cover sheet application device 94B.

Thus, in the processing system 10, the two cover sheet application devices 94 (94A and 94B) for applying the cover sheets 92 to the paper sheaves 12A are provided, in addition to which the inversion apparatus 96 is provided between the two cover sheet application devices 94.

Accordingly, with the processing system 10, the paper sheaves 12A can be smoothly superposed with the cover sheets 92 at both upper and lower faces, utilizing the cover sheet application devices 94 that have the same basic structure.

The paper sheaves 12A to which the cover sheets 92 have been applied are fed to the packing section 260 of the bagging apparatus 90. At the bagging apparatus 90, the wrappers 16 are formed using the wrapping film 230, and the wrappers 16 are also fed to the packing section 260.

At the packing section 260, the paper sheaf 12A is fed into the wrapper 16 through the opening formed in the wrapper 16. Then, the cap portion 236 of the wrapper 16 is folded over, the opening is closed, and the wrapper 16 is sealed by the folded-over cap portion 236 being joined up by the sealing tape 240. Thus, the packages 18, in which the paper sheaves 12A with the cover sheets 92 applied to both upper and lower faces are sealed, are formed.

Thus, in the processing system 10 of the present embodiment, processing of the long, broad web 14A—from production of the papers 12 of the predetermined size from the original web 14, stacking, and application of the cover sheets 92 to the sheaves (paper sheaves) 12A of the stacked papers 12, to subsequent sealing of the paper sheaves 12A in the wrappers 16 to produce the packages 18—an be implemented smoothly with automatic transportation.

Further, because the inversion apparatus 96 is provided between the two cover sheet application devices 94A and 94B in the processing system 10, the cover sheets 92 can be reliably and smoothly applied to both upper and lower faces of the paper sheaves 12A using the cover sheet application devices 94 that have the same structure.

Further still, because the winding direction of the web 14A is set to be the length direction of the papers 12 in the processing system 10, inkjet paper which is produced in the form of the papers 12 facilitates smooth printing by inkjet printers.

Note that the embodiment described above simply illustrates an example of the present invention and is not limiting to the present invention. For example, although an example in which the papers 12 are produced as inkjet paper or the like has been described, the present invention is not limited to kinds of recording paper such as inkjet paper and the like. The present invention may be applied to a freely selected structure for producing sheet members of predetermined size from a long belt of sheet material with a broad width.

Furthermore, each of the feeding apparatus 20, the cutting apparatus 22, the chopping apparatus 24, the stacking apparatus 26, the transfer conveyor 102, the bagging apparatus 90, the cover sheet application devices 94 and the inversion apparatus 96 of the present embodiment does not limit a corresponding stage: i.e., a cutting stage, a chopping stage, a stacking stage, a transporting stage and a packing stage, respectively, and numerous variations thereof are possible.

According to the present invention as described above, numerous sheets with predetermined sizes are produced in parallel by the cutting process and the chopping process, while being stacked, and sheaves of the stacked sheets are packaged while being transported in sequence. Because large area sheets, which are troublesome to handle, are not produced as intermediate products, an excellent effect is obtained in that smooth, automated operations, from processing of the sheets to packing, are enabled.

Further yet, with the present invention, because inverting means is provided between application means, cover sheets can be simply and smoothly applied to both upper and lower faces of the sheet sheaves.

Next, a second embodiment of the present invention will be described with reference to FIGS. 14 to 21. A processing system 310 of the present embodiment is equipped with a drawing apparatus 316, a cutting apparatus 318 and a chopping apparatus 320.

In the processing system 310, as an example of a sheet material, the original web 14 is loaded in the drawing apparatus 316. Hence, the web 14A, which is drawn out from this original web 14, is processed to the sheet-form papers 12 with predetermined sizes. Using inkjet paper as this web 14A (the original web 14), the papers 12 may be produced in various sizes, such as L-size, postcard size, etc. The sheet material is not limited to inkjet paper, and various recording papers, printing papers, photographic light-sensitive materials such as film or the like, and the like may be utilized.

A plurality of path rollers 324A, 324B, 324C, 324D, 324E, 324F and 324G are provided in the drawing apparatus 316. The web 14A that is drawn out from the original web 14 is wound round each of the path rollers 324A to 324G in that order. With this drawing apparatus 316, curl of the web 14A that is drawn out from the original web 14 is eliminated while the web 14A is being fed to the cutting apparatus 318.

At the cutting apparatus 318, slitting blades 326 and 328 are disposed as pairs sandwiching the transport path of the web 14A from above and below. The web 14A that has wound round the path roller 324G is nipped by the slitting blades 326 and 328. A pair of feed rollers 330 are provided at a downstream side of the slitting blades 326 and 328. The web 14A is nipped at the feed rollers 330.

These feed rollers 330 are driven to rotate by driving force of unillustrated driving means, and feed out the web 14A. Thus, the web 14A is drawn out from the original web 14 while being transported toward the cutting apparatus 318, and is fed out from the cutting apparatus 318.

The slitting blades 326 and 328 oppose predetermined positions along the width direction of the web 14A, and are driven to rotate by driving force of unillustrated driving means. By forming slits 332 (see FIG. 15) in the web 14A that is being transported by the feed rollers 330, the web 14A is cut (slitted) to predetermined widths. Thus, by providing at least one pair of the slitting blades 326 and 328 at the cutting apparatus 318, the web 14A drawn out from the original web 14 is slitted into at least two divisions.

A web edge control sensor 334 is provided at the drawing apparatus 316. A position of the web 14A along an axial direction is controlled such that a width direction end portion of the web 14A, which is detected by this web edge control sensor 334, passes the web edge control sensor 334 at a certain position. Thus, slits can be formed by the slitting blades 326 and 328 at constant positions along the width direction of the web 14A.

A pair of feed rollers 336 is provided at the chopping apparatus 320. Path rollers 338A, 338B and 338C are disposed between these feed rollers 336 and the feed rollers 330. The web 14A that is fed out from the feed rollers 330 is wound round the path rollers 338A, 338B and 338C and hence transported, and is nipped by the feed rollers 336.

These feed rollers 336 are driven to rotate by driving force of unillustrated driving means, and feed out the web 14A in increments of a certain amount. Here, a certain tension can be applied to the web 14A such that slackness will not occur by, for example, moving the path roller 338B in a direction of lengthening/shortening a length along the transport path of the web 14A.

Figure 14:
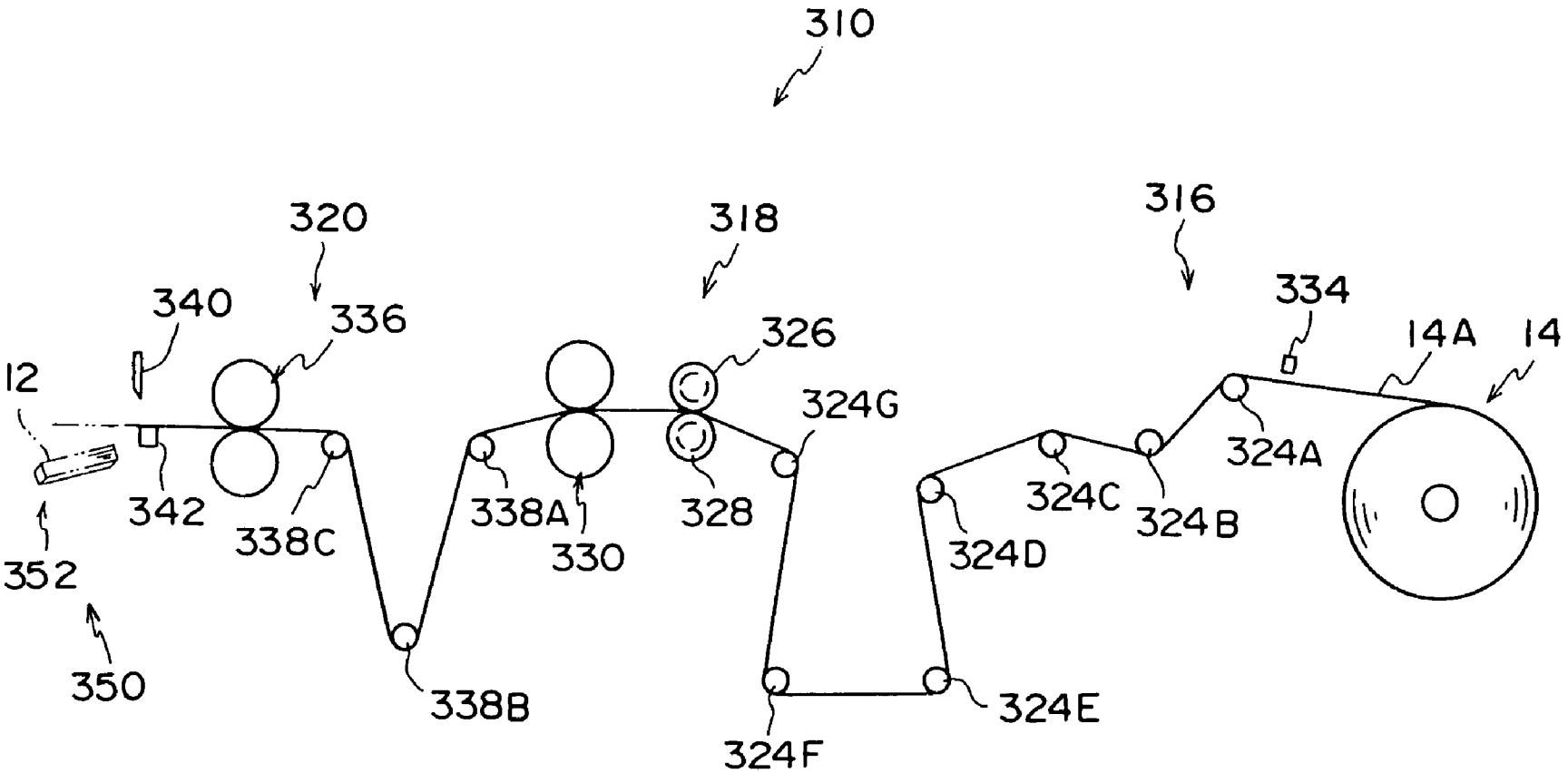
FIG. 14 is a schematic structural view of a principal portion of a processing system of a second embodiment.

A cutting blade 340 and a lower blade 342 are provided at a downstream side of the feed rollers 336 in the chopping apparatus 320 (the leftward side in the drawing of FIG. 14). The lower blade 342 opposes the cutting blade 340. The web 14A is fed to between the cutting blade 340 and the lower blade 342 by the feed rollers 336.

The cutting blade 340 descends toward the lower blade 342 in a state in which a predetermined amount of the web 14A has been fed between the cutting blade 340 and the lower blade 342. As a result, the web 14A is sandwiched between the cutting blade 340 and the lower blade 342, and the web 14A is chopped along the width direction.

In the processing system 310, the web 14A is slitted to predetermined widths by the formation of the slits 332 in the web 14A at the slitting blades 326 and 328, and the web 14A is chopped into predetermined lengths by the cutting blade 340. Thus, sheets of predetermined sizes are processed and the papers 12 are formed.

Figure 15:
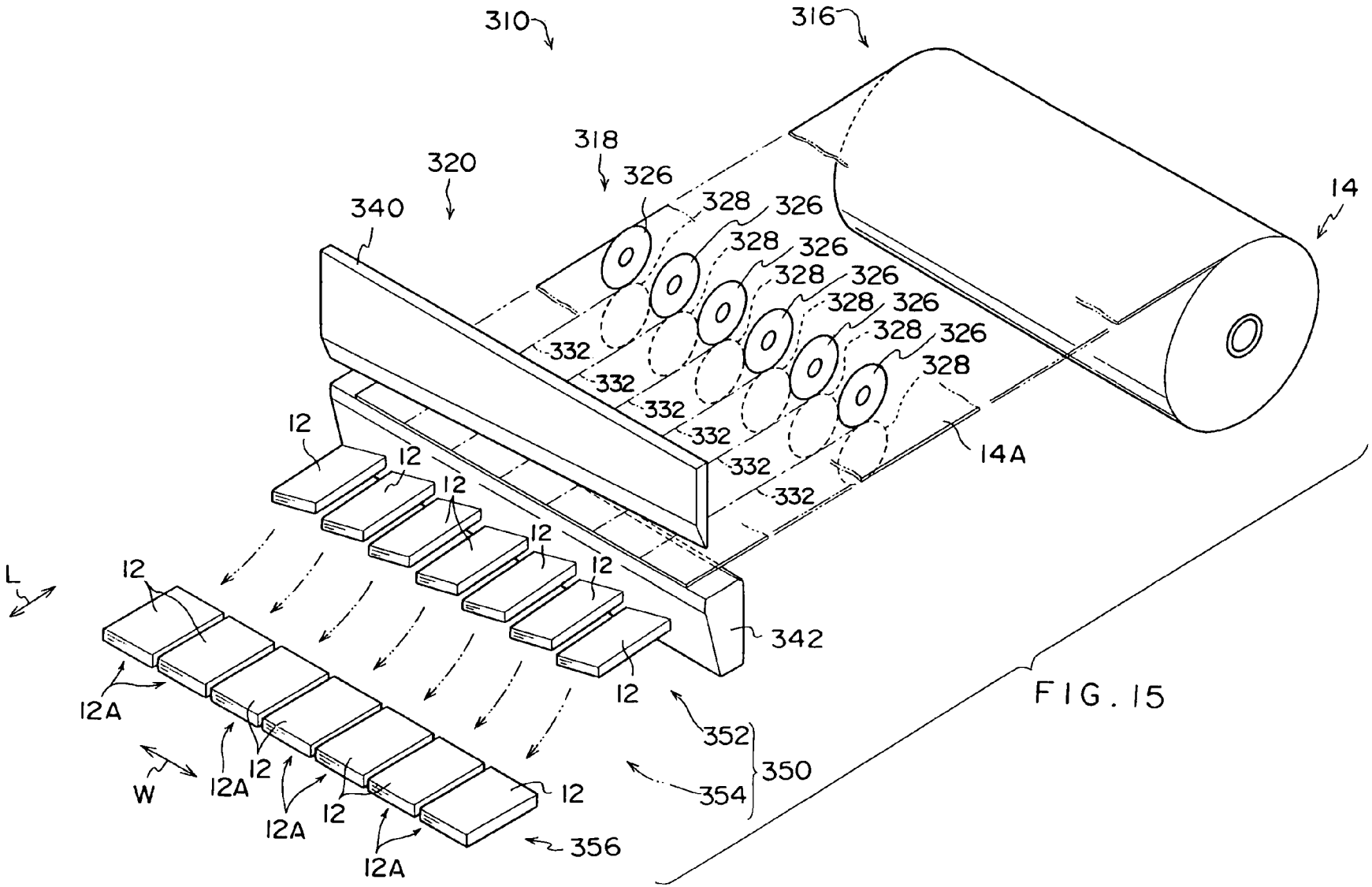
FIG. 15 is a schematic perspective view showing principal portions of the system, from cutting to transport.

In other words, as shown in FIG. 15, in the processing system 310, the web 14A is drawn out from the original web 14 that has been loaded in the drawing apparatus 316, the web 14A is slitted to the predetermined widths by the plurality of pairs of slitting blades 326 and 328 provided at the cutting apparatus 318, the web 14A that has been slitted to the predetermined widths is cut along the width direction by the cutting blade 340 provided at the chopping apparatus 320, and the papers 12 are produced.

Here, because the web 14A is cut to size along the width direction, which is a direction intersecting the length direction of the papers 12, by the cutting apparatus 318 and is cut to size along the length direction of the papers 12 by the chopping apparatus 320, the length direction of the papers 12 corresponds to the length direction of the web 14A, and when these papers 12 are loaded in, for example, a printer (such as an inkjet printer) or the like, even if some curl remains in the papers 12, smooth printing processing of the papers 12 is possible.

In the present embodiment, six pairs of the slitting blades 326 and 328 are provided, as an example, and six of the slits 332 are formed. Therefore, the papers 12 are produced in sets of seven sheets. However, production numbers of the papers 12 are not limited to this.

Next, stacking of the papers 12 that are produced by the processing system 310 and transport of the stacked papers 12 are described.

Figure 16:
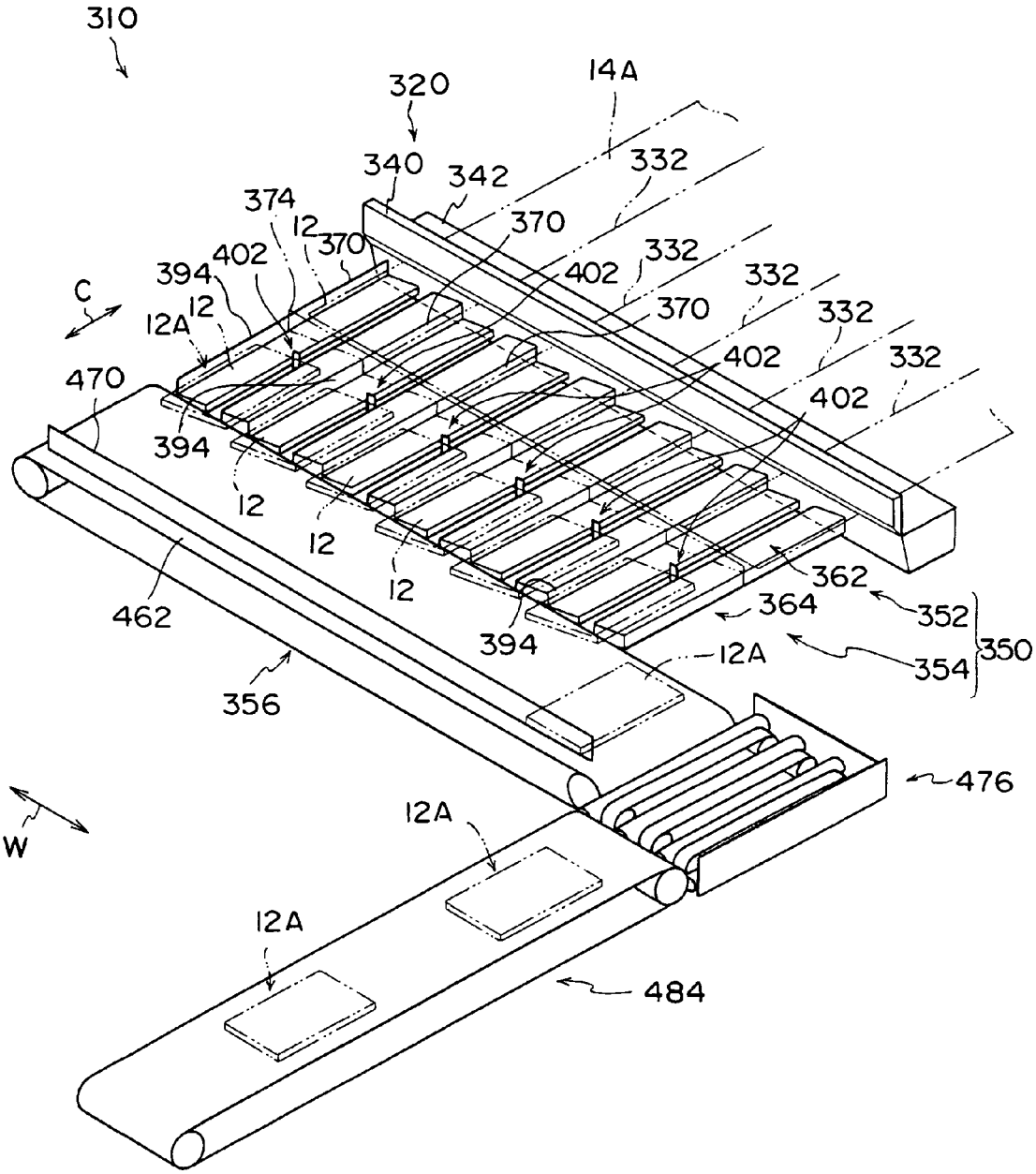
FIG. 16 is an overall schematic perspective view of a stacking and transport apparatus.

As shown in FIGS. 15 and 16, a stacking and transport apparatus 350 is provided in the processing system 310, at a downstream side of the chopping apparatus 320. This stacking and transport apparatus 350 is equipped with a stacking section 352 and a transport section 354. As shown in FIGS. 14 to 16, the stacking section 352 is disposed adjacent to the downstream side of the chopping apparatus 320. In the following descriptions, the transport direction of the web 14A is the length direction of the papers 12 (arrow L), and a direction intersecting this transport direction is the width direction of the papers 12 (the direction of arrow W).

As shown in FIG. 16, the papers 12 that have been chopped to the predetermined size by the chopping apparatus 320 are stacked at the stacking section 352. An alignment conveyor 356 is provided at a downstream side of the stacking and transport apparatus 350. The transport section 354 moves the sheaves 12A of the papers 12, which have been formed by the papers 12 being stacked in predetermined numbers in the stacking section 352, toward the alignment conveyor 356, and feeds the sheaves 12A out from the alignment conveyor 356 to subsequent stages, such as a packing stage and the like.

Now, the stacking and transport apparatus 350 will be described with reference to FIGS. 17 to 21.

Figure 17:
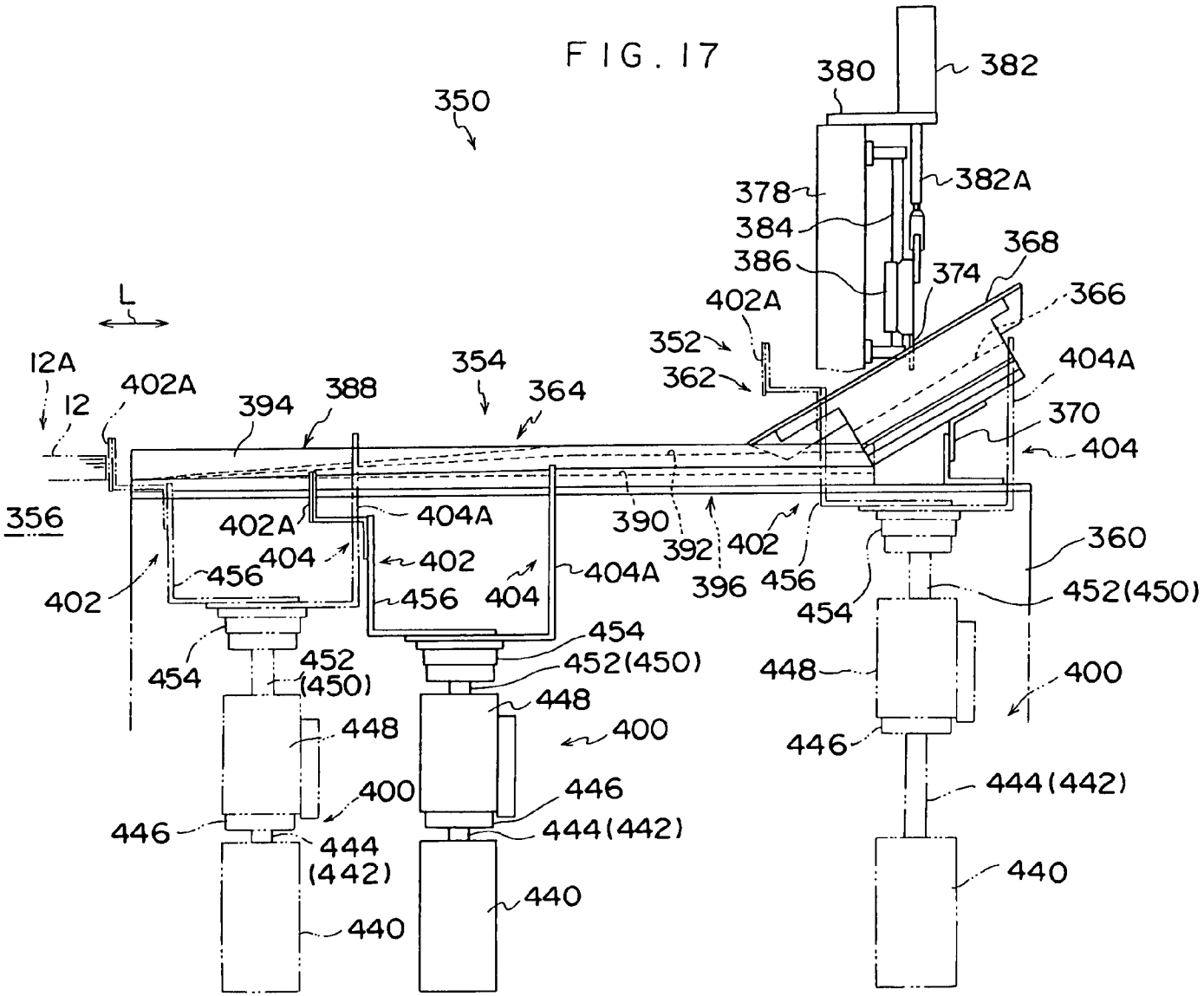
FIG. 17 is a schematic side view of principal portions of the stacking and transport apparatus.
Figure 19:
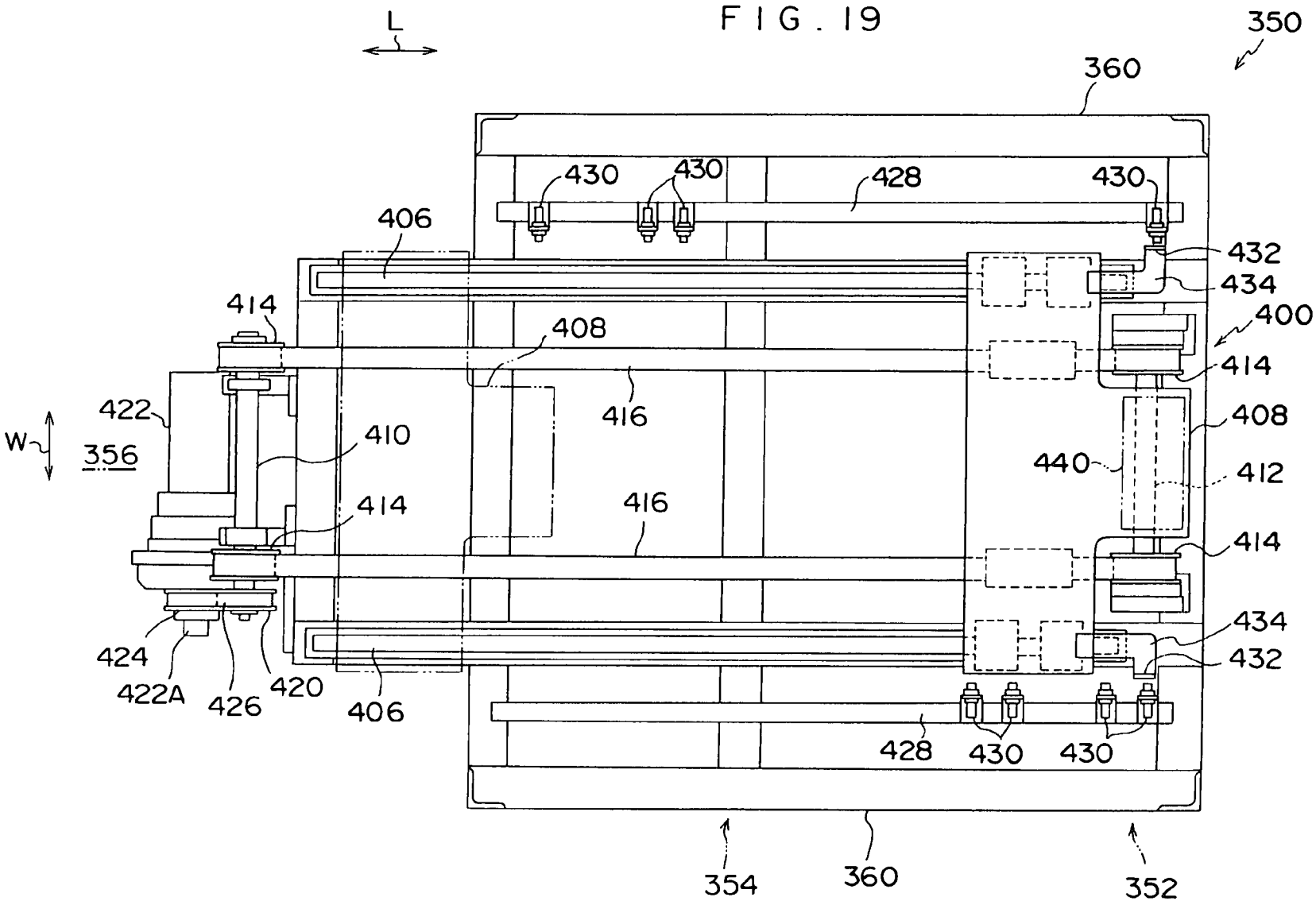
FIG. 19 is a schematic plan view of a principal portion of the stacking and transport apparatus.
Figure 20:
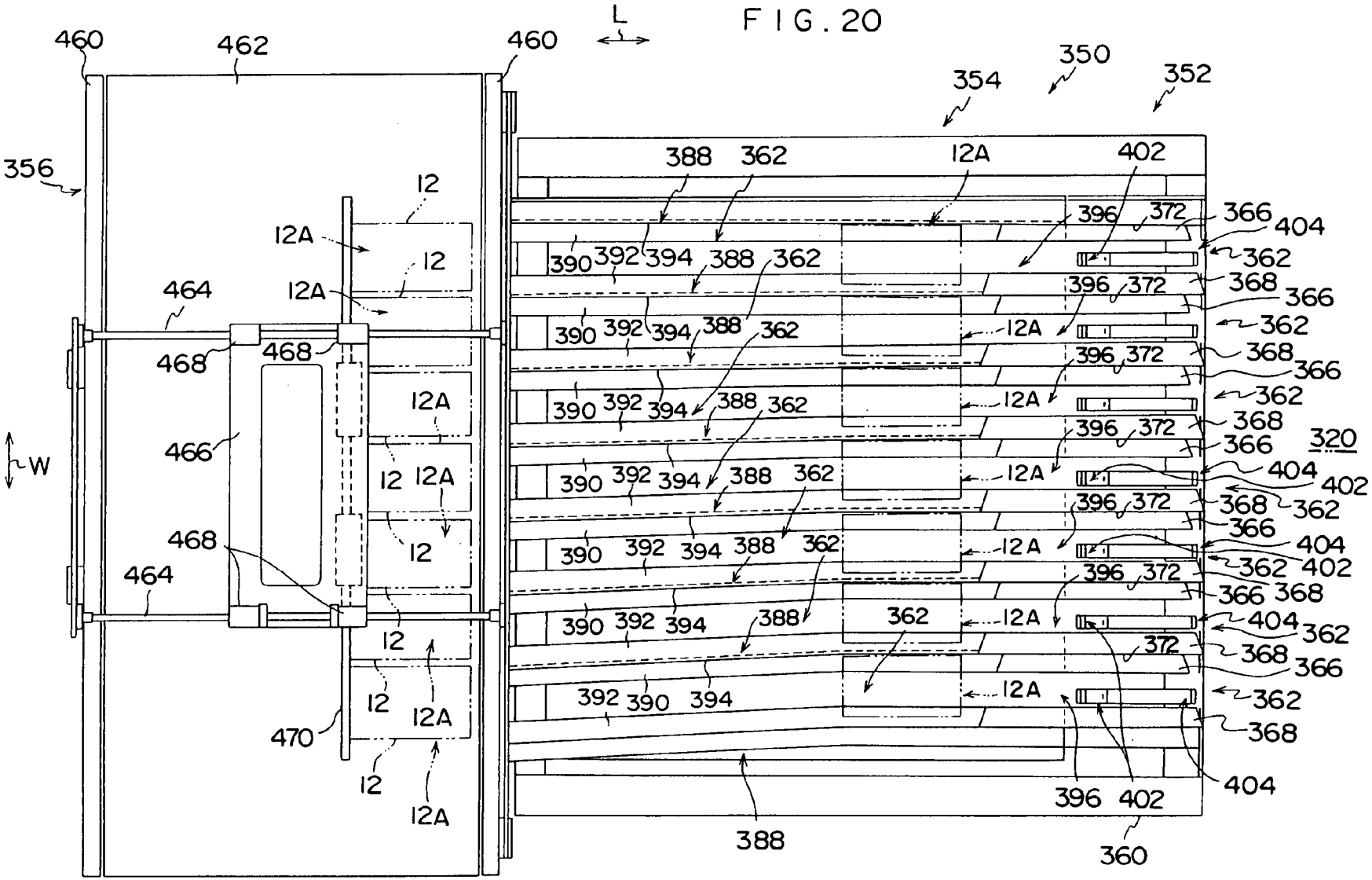
FIG. 20 is a schematic plan view of the stacking and transport apparatus and an alignment conveyor.

As shown in FIGS. 19 and 20, the stacking and transport apparatus 350 is equipped with a frame 360, which is formed in a rectangular box shape. As shown in FIG. 17, the stacking section 352 and transport section 354 are formed at an upper portion of the frame 360 (the upward side of the drawing of FIG. 17).

Figure 18:
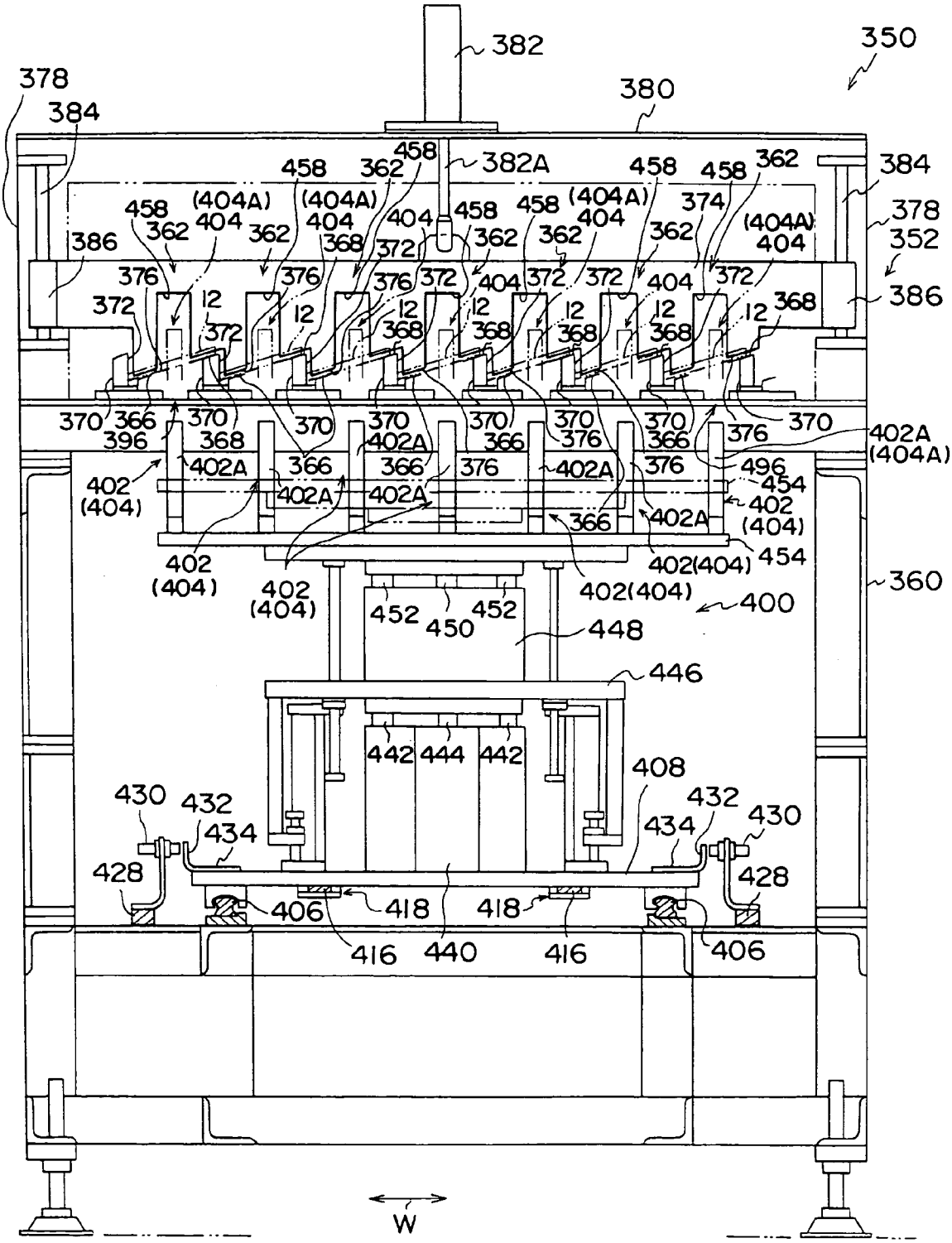
FIG. 18 is a schematic structural view of the stacking and transport apparatus, a stacking section side thereof being viewed from a feeding direction side.

As shown in FIGS. 16 and 18, trays 362 are formed at the stacking section 352 to match the number of the papers 12 that are produced in parallel by the chopping apparatus 320 (which is not shown in FIG. 18). Further, as shown in FIG. 20, guide channels 364 are formed at the transport section 354 in respective correspondence with the trays 362. Basic structures of the trays 362 and guide channels 364 are the same. Thus, a single pair of the trays 362 and guide channels 364 will be principally described hereafter.

As shown in FIGS. 17, 18 and 20, guide plates 366 and 368, which are separated by predetermined spacings, are disposed at the trays 362, in pairs along the width direction of the papers 12. The guide plates 366 and 368 are formed to be mounted at the frame 360 via brackets 370 (see FIGS. 17 and 18). When the papers 12 drop to the trays 362, the papers 12 are supported straddling the guide plates 366 and 368.

The guide plates 366 and 368 are respectively inclined such that the transport section 354 sides thereof are lower, as shown in FIG. 17, and are inclined substantially in parallel such that, of the guide plates 366 and 368, the guide plates 366 are lower, as shown in FIG. 18.

Further, as shown in FIGS. 18 and 20, standing walls 372 are provided between each guide plate 366 and the guide plate 368 of the tray 362 that is adjacent to the guide plate 366.

Therefore, when the papers 12 are supported at the guide plates 366 and 368, the papers 12 are inclined so as to be lowest at one end sides in the width direction, at the transport section 354 sides thereof. Here, the one end sides in the width direction of the papers 12 abut against the standing walls 372. As a result, the papers 12 are aligned in the width direction. In addition, overlapping of the papers 12 with the neighboring papers 12 in the width direction is prevented.

As shown in FIGS. 17 and 18, a stopper 374, which serves as a stopping plate, is provided upward of the trays 362 at the stacking section 352. As shown in FIG. 18, the stopper 374 is formed substantially in a strip plate shape, a width direction of which is substantially along the vertical direction and a length direction of which is along the width direction of the papers 12. The stopper 374 is disposed to oppose predetermined positions at the transport section 354 side (the paper front side of the drawing of FIG. 18) of the guide plates 366 and 368.

Cutaways 376 are formed in the stopper 374, at a width direction end portion thereof which opposes the trays 362, so as to be angled along upper faces of the guide plates 366 and 368. Thus, the stopper 374 substantially has a sawblade shape.

As shown in FIGS. 17 and 18, support pillars 378 are provided standing at both sides, in the width direction of the papers 12, of the frame 360. A support bar 380 spans across at upper end portions of the pair of support pillars 378. An air cylinder 382 is provided at a central portion in a length direction of this support bar 380.

The air cylinder 382 is mounted at the support bar 380 in a state in which a rod 382A thereof is oriented substantially downward. An upper end portion of the stopper 374 is joined to a distal end of this rod 382A. Thus, the stopper 374 is supported.

Guide shafts 384 are disposed along the vertical direction at the respective support pillars 378. Sliders 386 are attached to the stopper 374 at both end portions in the length direction thereof. These sliders 386 are engaged with the guide shafts 384 so as to be movable along an axial direction of the guide shafts 384.

Accordingly, when the rod 382A of the air cylinder 382 extends or retracts, the stopper 374 moves in a substantially vertical direction, which is a direction of approaching or moving away from the upper faces of the guide plates 366 and 368 in accordance with the extension or retraction of the rod 382A.

Now, in a state in which the rod 382A of the air cylinder 382 is retracted, the stopper 374 has moved to upward of the trays 362 (the guide plates 366 and 368). Accordingly, the trays 362 communicate with the guide channels 364, and the papers 12 that have dropped onto the guide plates 366 and 368 can move into the guide channels 364.

When the rod 382A of the air cylinder 382 extends, the stopper 374 moves downward, approaches the upper faces of the guide plates 366 and 368, and divides the trays 362 from the guide channels 364. Accordingly, the papers 12 that drop to the trays 362 and straddle between the guide plates 366 and 368 abut against the standing walls 372 at length direction distal ends of the papers 12, and downward movement of the papers 12 is obstructed.

Hence, at the stacking section 352, the stopper 374 is caused to descend and the papers 12 are stacked. At this time, because the length direction distal ends of the papers 12 abut against the stopper 374, the length direction distal ends of the papers 12 are substantially uniformly aligned. In other words, at the trays 362 formed in the stacking section 352, because width direction one end sides of the papers 12 are abutted against the standing walls 372 and length direction one end sides of the papers 12 are abutted against the stopper 374, the papers 12 are stacked while being aligned in the length direction and in the width direction. Then, when the stopper 374 is raised, the papers 12 that have stacked in the trays 362 are allowed to descend into the guide channels 364 along the inclination of the guide plates 366 and 368.

Note that although the stopper 374 is moved in a vertical direction in the present embodiment, this is not limiting. For example, a stopper which moves along a direction which is substantially perpendicular to the upper faces of the guide plates 366 and 368 on which the papers 12 are placed is also possible.

Anyway, as shown in FIG. 20, the guide channels 364 are formed by guide members 388, which are disposed in pairs along the width direction of the papers 12. The guide members 388 are disposed along the length direction of the papers 12, so as to communicate the trays 362 with the alignment conveyor 356. Guide portions 390 are formed at the respective guide members 388, at one end sides thereof in the width direction of the papers 12, and guide portions 392 are formed at the other end sides of the same. The guide portions 390 and 392 are disposed to be separated by predetermined intervals along the width direction of the papers 12. Thus, the guide channels 364 are formed.

Sidewalls 394 are formed at the guide members 388 between the guide portions 390 and 392. That is, the guide members 388 are formed with the sidewalls 394 interposed between the guide portions 390 and 392.

The guide portions 390 are inclined such that upper face sides thereof become gradually lower away from the guide plate 366 sides thereof, and the guide portions 392 are inclined such that upper face sides thereof become gradually lower away from the guide plate 368 sides thereof. The sidewalls 394 are formed between these guide portions 390 and 392.

The inclinations of the upper faces of the guide portions 390 and 392 along the length direction of the papers 12 are shallower than the inclinations of the upper faces of the guide plates 366 and 368. Further, the inclinations of the upper faces of the guide portions 390 and 392 become even shallower at the guide plates 366 and 368 sides thereof (the trays 362 side). Accordingly, when the papers 12 slide down from the trays 362, these papers 12 stop upon reaching the guide portions 390 and 392.

The upper faces of the guide portions 390 and 392 become horizontal, with substantially the same height, at the alignment conveyor 356 side thereof. At an intermediate portion of the guide portions 390 and 392 along the length direction of the papers 12, the guide portions 392 are higher than the guide portions 390. At this portion, the guide portions 390 and 392 are inclined such that lines along and joining both the upper faces are straight lines.

That is, at the trays 362 side, the upper faces of the guide portions 390 and 392 are inclined to match the upper faces of the guide plates 366 and 368. However, toward the alignment conveyor 356 side, these inclinations gradually ease off, and become horizontal in the vicinity of the alignment conveyor 356.

A spacing of the sidewalls 394 of the guide members 388, which is a width of the guide channels 364, gradually broadens in accordance with the easing of the width direction inclinations of the upper faces of the guide portions 390 and 392. At the alignment conveyor 356 side end portions of the sidewalls 394, the spacing of the sidewalls 394 is wider than the width dimension of the stacked papers 12.

Therefore, when the sheaves 12A of the papers 12 that have been stacked in predetermined numbers at the trays 362 are moved in the guide channels 364 from the trays 362 toward the alignment conveyor 356 side, inclinations of the sheaves 12A along the width direction of the papers 12 are gradually eased.

At this time, because the sidewalls 394 are formed at the guide members 388, shifting of the papers 12 in the width direction is prevented.

Along the trays 362 and the guide channels 364, the guide plates 366 and guide plates 368 of the trays 362 are spaced apart, and the guide portions 390 and 392 formed at the guide channels 364 are spaced apart. Thus, channels 396 are formed with straight line forms along the length direction of the papers 12.

As shown in FIGS. 17 and 18, pushers 400 are provided in the frame 360 at the stacking and transport apparatus 350. Pushing arms 402 and support arms 404 of these pushers 400 are formed so as to pass through the channels 396.

As shown in FIG. 19, guide rails 406 are mounted in the frame 360 as a pair. Length directions of the respective guide rails 406 are disposed along the length direction of the papers 12, and distal ends of the guide rails 406 protrude to below the alignment conveyor 356. A baseplate 408 spans across and is supported between this pair of guide rails 406.

A shaft 410 is disposed at one end side of the guide rails 406, and a shaft 412 is disposed at the other end side of the guide rails 406. Two pulleys 414 are mounted at each of the shafts 410 and 412.

Endless belts 416 are disposed as a pair between the guide rails 406. Each of these endless belts 416 is wound round between one of the pulleys 414 at the shaft 410 and one of the pulleys 414 at the shaft 412.

As shown in FIGS. 18 and 19, mounting members 418 are attached to a lower face side (the paper rear side of the drawing of FIG. 19) of the baseplate 408. The endless belts 416 are fixed to the baseplate 408 by these mounting members 418.

As shown in FIG. 19, a pulley 420 is mounted at one end side in an axial direction of the shaft 410. An endless timing belt 426 is wound round between this pulley 420 and a pulley 424 which is attached to a driving shaft 422A of a motor 422.

Hence, when the motor 422 drives, the baseplate 408 is moved along the guide rails 406 in the length direction of the papers 12.

As shown in FIGS. 18 and 19, in the frame 360, sensor rails 428 are mounted at outer sides of the guide rails 406. The sensor rails 428 are mounted in parallel with the guide rails 406 and separated therefrom by a predetermined spacing. Pluralities of position detection sensors 430 are attached to the respective sensor rails 428 at predetermined positions.

Arms 434 are attached to the baseplate 408 at predetermined positions. Detected portions 432 are attached at distal ends of these arms 434. When the baseplate 408 moves along the guide rails 406, the detected portions 432 oppose the position detection sensors 430.

The respective position detection sensors 430 are attached at positions which detect the detected portions 432 when the baseplate 408 moves to predetermined positions. Thus, in the stacking and transport apparatus 350, a movement position of the baseplate 408 is judged by these position detection sensors 430, and driving, stopping and driving force of the motor 422 are controlled accordingly.

Further, as shown in FIGS. 18 and 19, an air cylinder 440 is mounted at the baseplate 408. As shown in FIG. 18, this air cylinder 440 is equipped with a rod 444 between a pair of guide shafts 442, and the rod 444 is disposed so as to extend upward.

An intermediate base 446 is disposed upward of the air cylinder 440. Distal ends of the pair of guide shafts 442 and the rod 444 are joined to the intermediate base 446, and support the intermediate base 446.

An air cylinder 448 is mounted at the intermediate base 446. The air cylinder 448 is provided with a rod 452 between a pair of guide shafts 450. The rod 452 is disposed so as to extend upward.

A support bar 454 is disposed upward of this air cylinder 448 such that a length direction of the support bar 454 is along the width direction of the papers 12. Distal ends of the guide shafts 450 and rod 452 are joined to this support bar 454. Thus, the support bar 454 is supported to be vertically movable.

The sets of pushing arms 402 and 404 are provided at the pushers 400 in correspondence with the sets of trays 362 and guide channels 364 (see FIGS. 18 and 20). These pushing arms 402 and 404 are mounted at the support bar 454, at positions corresponding to the respective channels 396.

As shown in FIG. 17, the pushing arms 402 are attached to substantially L-shaped brackets 456. Distal end portions of the pushing arms 402, toward the alignment conveyor 356 sides thereof, are again inflected upward. These inflected distal end portions serve as pushing portions 402A, which oppose the sheaves 12A of the papers 12.

Distal end portions of the support arms 404, toward the chopping apparatus 320 sides thereof, are formed in substantial 'L' shapes which are inflected upward. These upward inflected distal end portions serve as support portions 404A, which oppose the sheaves 12A of the papers 12.

As shown by solid lines in FIG. 17, in a state in which the rod 444 of the air cylinder 440 and the rod 452 of the air cylinder 448 are retracted, the pushing portions 402A and support portions 404A of the pushing arms 402 and the support arms 404 are accommodated in the channels 396.

As shown by broken lines in FIG. 17, when the rod 444 of the air cylinder 440 and/or the rod 452 of the air cylinder 448 are extended, the respective pushing arms 402 and support arms 404 move upward, and the pushing portions 402A and support portions 404A protrude from the guide channels 364. Accordingly, the pushing portions 402A of the pushing arms 402 and the support portions 404A of the support arms 404 can face the length direction end portions of the sheaves 12A of the papers 12.

As shown in FIG. 18, incisions 458 are formed in the stopper 374 at positions opposing the support portions 404A of the support arms 404. As a result, interference of the stopper 374 with the pushing arms 402 and support arms 404, particularly the support portions 404A of the support arms 404, is prevented.

At the pushers 400, the rods 444 and 452 of the air cylinders 440 and 448 are usually retracted. However, when the stopper 374 rises, the support portions 404A of the support arms 404 are moved toward the guide channels 364 side of the stopper 374 and protruded.

Thus, when the stopper 374 is raised, the sheaves 12A of the papers 12 that have been stacked in the trays 362 abut against the support portions 404A of the support arms 404. The papers 12, which have been aligned and stacked on the trays 362 (the guide plates 366 and 368), descend smoothly on the guide plates 366 and 368, and disturbance of the papers 12 is avoided.

Then, the pushers 400 move the support arms 404 to predetermined positions at which the distal end portions of the papers 12 have been removed from the guide plates 366 and 368. Thus, the sheaves 12A of the papers 12 are stopped, while disruption of the sheaves 12A of the papers 12 is prevented.

In this state, the pushers 400 move the pushing arms 402 toward the alignment conveyor 356 in a state in which the pushing portions 402A of the pushing arms 402 are caused to oppose the chopping apparatus 320 sides (the right side in the drawing of FIG. 17) of the sheaves 12A of the papers 12. Hence, the sheaves 12A of the papers 12 are pushed by the pushing arms 402, and moved along the guide channels 364. In other words, the sheaves 12A of the papers 12 are transported along the guide channels 364. Here, the papers 12 and the sheaves 12A are not shown in FIG. 17.

As shown in FIG. 20, a belt 462, which guides between a pair of side frames 460, is provided at the alignment conveyor 356. One of these side frames 460 is provided at the stacking and transport apparatus 350 side of the alignment conveyor 356. The transport belt 462 is moved along the width direction of the papers 12 by driving force of an unillustrated motor.

At this alignment conveyor 356, an upper face of the side frame 460 at the stacking and transport apparatus 350 side and an upper face of the transport belt 462 are at substantially the same height. This height is slightly lower than the upper faces of the guide portions 390 and 392 near the side frame 460. At the pushing arms 402 of the pushers 400, the pushing portions 402A are slightly higher than the upper face of the side frame 460.

Accordingly, the sheaves 12A of the papers 12 that are pushed by the pushing arms 402 and transported in the guide channels 364 are pushed out onto the transport belt 462 from in the guide channels 364 by the pushing arms 402, and are received by the alignment conveyor 356 (see FIG. 17).

Shafts 464 are disposed at the alignment conveyor 356 at an upper side of the transport belt 462. The shafts 464 are respectively mounted such that axial directions (length directions) thereof are along the length direction of the papers 12, which is a width direction of the transport belt 462.

A rectangular plate-form baseplate 466 spans across between the shafts 464. Sliders 468 are attached to the baseplate 466 at positions which oppose the pair of shafts 464, respectively. These sliders 468 engage with the shafts 464 so as to be movable along the axial direction thereof. Thus, the baseplate 466 is supported.

A stopper 470 is provided at this baseplate 466. The stopper 470 serves as stopping means and opposes the upper face of the transport belt 462. This stopper 470 is formed in a strip plate shape. The stopper 470 is mounted such that a length direction of the stopper 470 runs along the width direction of the papers 12, which is a direction intersecting the axial direction of the shafts 464, and so as to face respective openings of the guide channels 364 of the transport section 354.

When the baseplate 466 moves along the axial direction of the shafts 464, a separation of the stopper 470 from a transport section 354 side end portion of the transport belt 462 changes.

Thus, at the stacking and transport apparatus 350, alterations of the guide plates 366, the guide plates 368, the guide members 388 (the guide portions 390 and 392) and the pushers 400 (the pushing arms 402 and support arms 404) and changes in position of the stopper 470 of the alignment conveyor 356 are implemented in accordance with the size of the papers 12 that are to be stacked.

At the alignment conveyor 356, the position of this stopper 470 is fixed to correspond with the length of the papers 12 in the length direction. Hence, the sheaves 12A of the papers 12 that are pushed from the guide channels 364 of the transport section 354 onto the transport belt 462 by the pushing arms 402 are abutted against the stopper 470.

Thus, at the alignment conveyor 356, the sheaves 12A of the papers 12 are respectively stopped and placed in a state in which the length direction distal ends thereof are lined up. In other words, the sheaves 12A of the papers 12 are aligned and placed on the transport belt 462 in a state in which both the width directions and length directions thereof are aligned.

The alignment conveyor 356 feeds out the sheaves 12A of the papers 12 by moving the transport belt 462.

A transport conveyor 472 is disposed at a downstream side in a direction of movement of the papers 12 by the alignment conveyor 356. This transport conveyor 472 is equipped with a transport belt 474 which is driven to turn (rotatingly moved) by driving force of an unillustrated motor. When the sheaves 12A of the papers 12 that are fed from the alignment conveyor 356 are placed on this transport belt 474, the sheaves 12A are transported by the transport belt 474.

A movement speed of the transport belt 474 of the transport conveyor 472 is greater (faster) than a movement speed of the transport belt 462 provided at the alignment conveyor 356. As a result, the sheaves 12A of the papers 12 are transported on the transport belt 474 with a spacing therebetween being opened up.

A transfer conveyor 476 is disposed adjacent to this transport conveyor 472, and the sheaves 12A of the papers 12 are fed from the transport conveyor 472 to the transfer conveyor 476. Note that, as shown in FIG. 16, the transport conveyor 472 may be not provided, with the sheaves 12A of the papers 12 being fed from the alignment conveyor 356 to the transfer conveyor 476.

Figure 21:
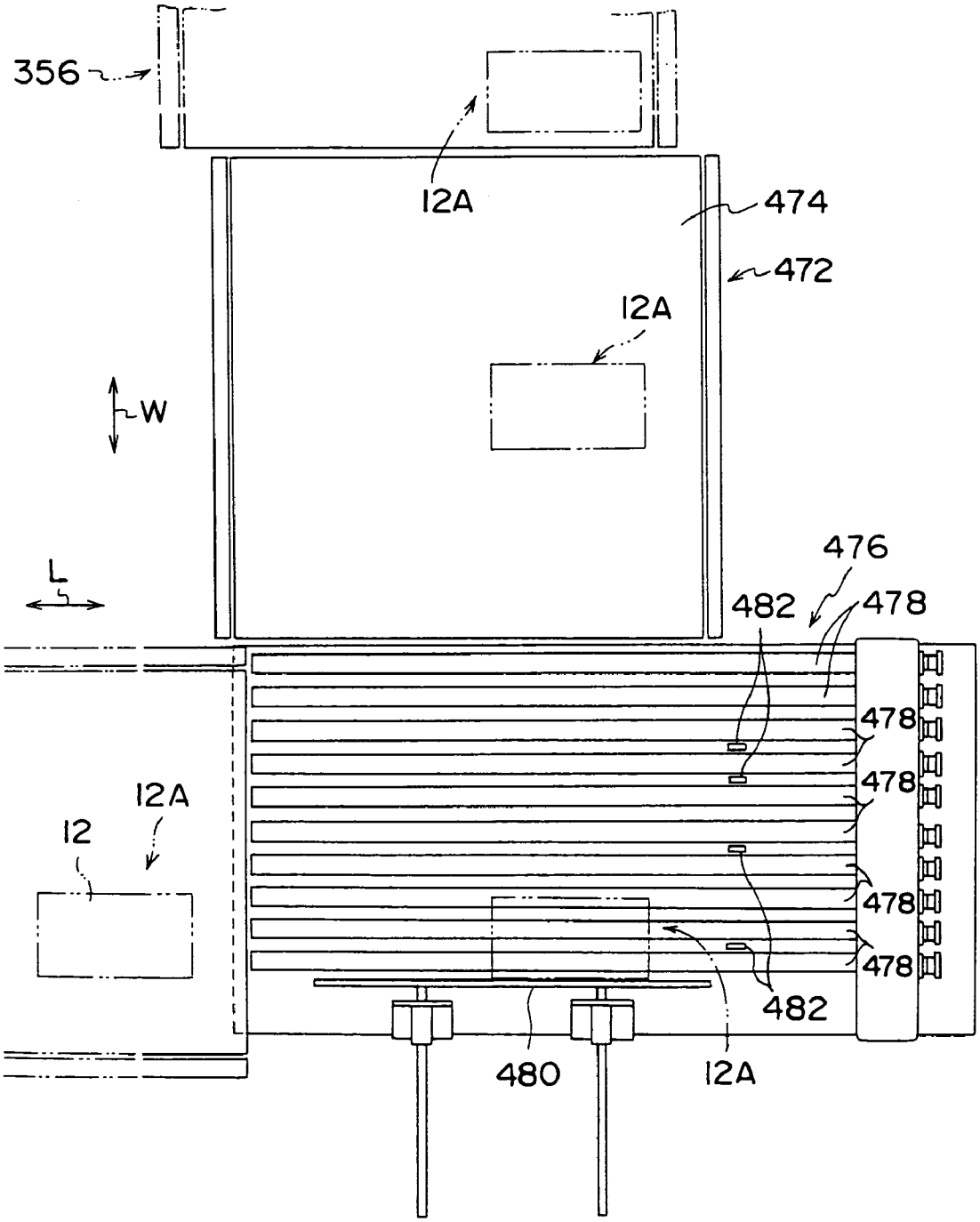
FIG. 21 is a schematic plan view showing a transport conveyor and a transfer conveyor.

As shown in FIG. 21, the transfer conveyor 476 is equipped with a plurality of small rollers 478. The small rollers 478 are disposed such that axial directions thereof are along the length direction of the papers 12, and are mounted with a predetermined spacing in the width direction of the papers 12.

Further, at the transfer conveyor 476, a stopper 480 is provided at an end portion of the transfer conveyor 476 at a side opposite to the side thereof at which the transport conveyor 472 is disposed. The stopper 480 is disposed such that a length direction thereof is along the length direction of the papers 12, which is the axial direction of the small rollers 478.

The small rollers 478 are rotated by driving force of unillustrated driving means. The sheaves 12A of the papers 12 that are fed from the transport conveyor 472 are moved toward the stopper 480. Accordingly, at the transfer conveyor 476, the sheaves 12A of the papers 12 are abutted against the stopper 480 and stopped.

Pushing members 482 protrude from between mutually adjacent small rollers 478 at the transfer conveyor 476. The pushing members 482 are respectively attached to an endless belt. When this endless belt is driven to turn, the pushing members 482 move between the small rollers 478 from one end side in the axial direction of the small rollers 478 toward the other end side thereof.

When the pushing members 482 move at transfer conveyor 476, the sheaves 12A of the papers 12, which have abutted against the stopper 480 and stopped, are pushed, and move while sliding against the stopper 480. Hence, the sheaves 12A of the papers 12 are provided to a transport conveyor 484, which is provided extending to the next stage.

Next, operation of the present embodiment will be described.

In the processing system 310 of the present embodiment, the web 14A is drawn out from an outer peripheral end of the original web 14 that has been loaded in the drawing apparatus 316, and at the same time the web 14A is transported to the cutting apparatus 318 at a predetermined speed.

At the cutting apparatus 318, this web 14A is nipped by the slitting blades 326 and 328, and slitting processing to form the slits 332 in the web 14A with the predetermined spacing is implemented by the slitting blades 326 and 328 being driven to rotate. Also at the cutting apparatus 318, the web 14A that has been slitted to the predetermined widths is nipped by the feed rollers 330 and fed out toward the chopping apparatus 320, while overlapping of the web 14A with itself is prevented.

At the chopping apparatus 320, the web 14A that has been fed in from the cutting apparatus 318 is nipped by the feed rollers 336 and fed toward the cutting blade 340 and lower blade 342. In addition, at the chopping apparatus 320, transportation of the web 14A is stopped each time a predetermined amount of the web 14A has been transported, and the web 14A is chopped by the cutting blade 340 being operated. That is, at a time at which the predetermined amount of the web 14A has been fed through between the cutting blade 340 and lower blade 342, the lower blade 342 is operated (lowered) and the web 14A is chopped. Thus, sets of a plurality (for example in the present embodiment, seven) of the papers 12 with the predetermined size are formed.

The stacking and transport apparatus 350 is provided in the processing system 310, and the stacking section 352 of this stacking and transport apparatus 350 is disposed adjacent to the chopping apparatus 320.

At the stacking section 352, the trays 362 are formed to match the number of the papers 12 which have been produced in parallel by the chopping apparatus 320. The papers 12 that have been produced by operation of the cutting blade 340 respectively descend onto the corresponding trays 362.

The respective trays 362 are equipped with the guide plates 366 and 368, which are inclined at a predetermined angle, and the papers 12 are sequentially stacked on the guide plates 366 and 368. Here, because the papers 12 are respectively inclined along the width direction and length direction thereof, the papers 12 will not overlap between neighboring trays 362.

Further, at the trays 362, the standing walls 372 are provided at the lower side of the inclination of the guide plates 366 and 368, and the stopper 374 is lowered. The width direction end portions of the papers 12 abut against the standing walls 372, the length direction end portions thereof abut against the stopper 374, and the papers 12 are stacked with the width directions and length directions aligned.

At the stacking and transport apparatus 350, when the predetermined number of the papers 12 have been stacked at each of the trays 362, the support portions 404A of the support arms 404 provided at the pushers 400 are protruded from the channels 396 between the guide plates 366 and 368 at the transport section 354 side of the stopper 374. Here, the support portions 404A (the support arms 404) may have been protruded in advance, during stacking of the papers 12.

At the stacking and transport apparatus 350, from this state, the air cylinder 382 is operated and raises the stopper 374. Consequently, the distal end portions of the sheaves 12A of the papers 12 abut against the support portions 404A of the support arms 404. In this state, by moving the support arms 404 to the predetermined position of the transport section 354, the sheaves 12A of the papers 12 are slid on the guide plates 366 and 368, are transferred to the upper faces of the guide portions 390 and 392 that form the guide channels 364, and stop.

When, by moving the support portions 404A of the support arms 404 to the predetermined position, the pushers 400 have moved the sheaves 12A of the papers 12 into the guide channels 364 and stopped the sheaves 12A, both the support arms 404 and the pushing arms 402 are moved downward. Hence, the support arms 404 and pushing arms 402 are withdrawn from inside the channels 396 and moved toward the chopping apparatus 320 side, and the pushing portions 402A of the pushing arms 402 are caused to oppose the sheaves 12A of the papers 12 from the tray 362 sides thereof.

Thereafter, the motor 422 operates and moves the pushing arms 402 toward the alignment conveyor 356. As a result of these pushing arms 402 moving in the channels 396 between the guide portions 390 and 392, the sheaves 12A of the papers 12 that have been transferred to the guide portions 390 and 392 are pushed by the pushing portions 402A and transported in the guide channels 364.

At this time, at the guide portions 390 and 392, the inclination along the width direction of the papers 12 is gradually eased off. As a result, the sheaves 12A of the papers 12 have returned substantially to the horizontal when the sheaves 12A reach the alignment conveyor 356 side end portions of the guide portions 390 and 392. Further, the sidewalls 394 are provided at the guide members 388 that form the guide portions 390 and 392. Because the papers 12 move while width direction end portions thereof are in contact with the sidewalls 394, shifting of the papers 12 in the sheaves 12A will not occur.

The sheaves 12A of the papers 12, which have been made horizontal by passing along the guide channels 364, are pushed out from the guide channels 364 onto the transport belt 462 of the alignment conveyor 356 by the pushing portions 402A provided at the pushing arms 402 of the pushers 400 protruding toward the alignment conveyor 356.

The stopper 470 is provided at the alignment conveyor 356. This stopper 470 has been fixed beforehand at a predetermined position corresponding to the size of the papers 12 (i.e., the size along the length direction).

The plurality of the sheaves 12A of the papers 12 that have been pushed out onto the transport belt 462 of the alignment conveyor 356 are stopped by the respective length direction end portions thereof abutting against the stopper 470, and are alignedly placed on the transport belt 462.

When the sheaves 12A of the papers 12 are fed in from the stacking and transport apparatus 350, the alignment conveyor 356 drives the transport belt 462 and these sheaves 12A of the papers 12 are sequentially fed to the transport conveyor 472.

The transport conveyor 472 feeds the sheaves 12A of the papers 12 that have been received from the alignment conveyor 356 to the transfer conveyor 476. The transfer conveyor 476 moves these sheaves 12A of the papers 12 along the width direction, the sheaves 12A of the papers 12 are re-aligned by abutting against the stopper 480, and are pushed out to the transport conveyor 484 by the pushing members 482. Thus, the sheaves 12A of the papers 12 are transported by the transport conveyor 484 and fed to the next stage in the state in which width directions and length directions thereof are aligned.

With the present embodiment structured thus, because the plurality of the papers 12 that are produced in parallel by the chopping apparatus 320 are respectively stacked in inclined states in the trays 362, the sheaves 12A of the papers 12 can be formed with both the width direction and the length direction uniformly aligned.

Furthermore, according to the stacking and transport apparatus 350, large numbers of the papers 12 which form the sheaves 12A can be fed while maintaining the aligned states thereof.

Note that, although the guide plates 366 and 368 are respectively inclined in the width direction and the transport direction (the length direction) of the papers 12, it is sufficient that the guide plates 366 and 368 are inclined at least in the width direction. If such is the case, because the stopper 374 suppresses shifting along the length direction of the papers 12, when these sheaves 12A of the papers 12 are pushed to move by the pushing portions 402A, the length direction of the sheaves 12A of the papers 12 can be aligned.

Further, for the present embodiment, production of the papers 12, which are ink-jet paper, has been described as an example, but this is not limiting. The present invention may be applied to stacking and transport when producing various kinds of sheet body, such as various recording papers, printing papers, photographic light-sensitive materials such as film or the like, and the like.

According to the present invention as described above, sheet bodies are stacked while being aligned at least in a width direction thereof, and pushing members are abutted against sheaves of these sheet bodies and moved to push in a transport direction. Thus, alignment in both the width direction and the transport direction and transportation are possible.

Furthermore, with the stacking and transport apparatus of the present invention, excellent effects can be obtained in that each of a plurality of sheet bodies, which are produced in parallel, is uniformly aligned and stacked and can be transported to subsequent stages while maintaining the aligned states thereof.

Below, a third embodiment of the present invention will be described with reference to FIGS. 22 to 28.

Figure 22:
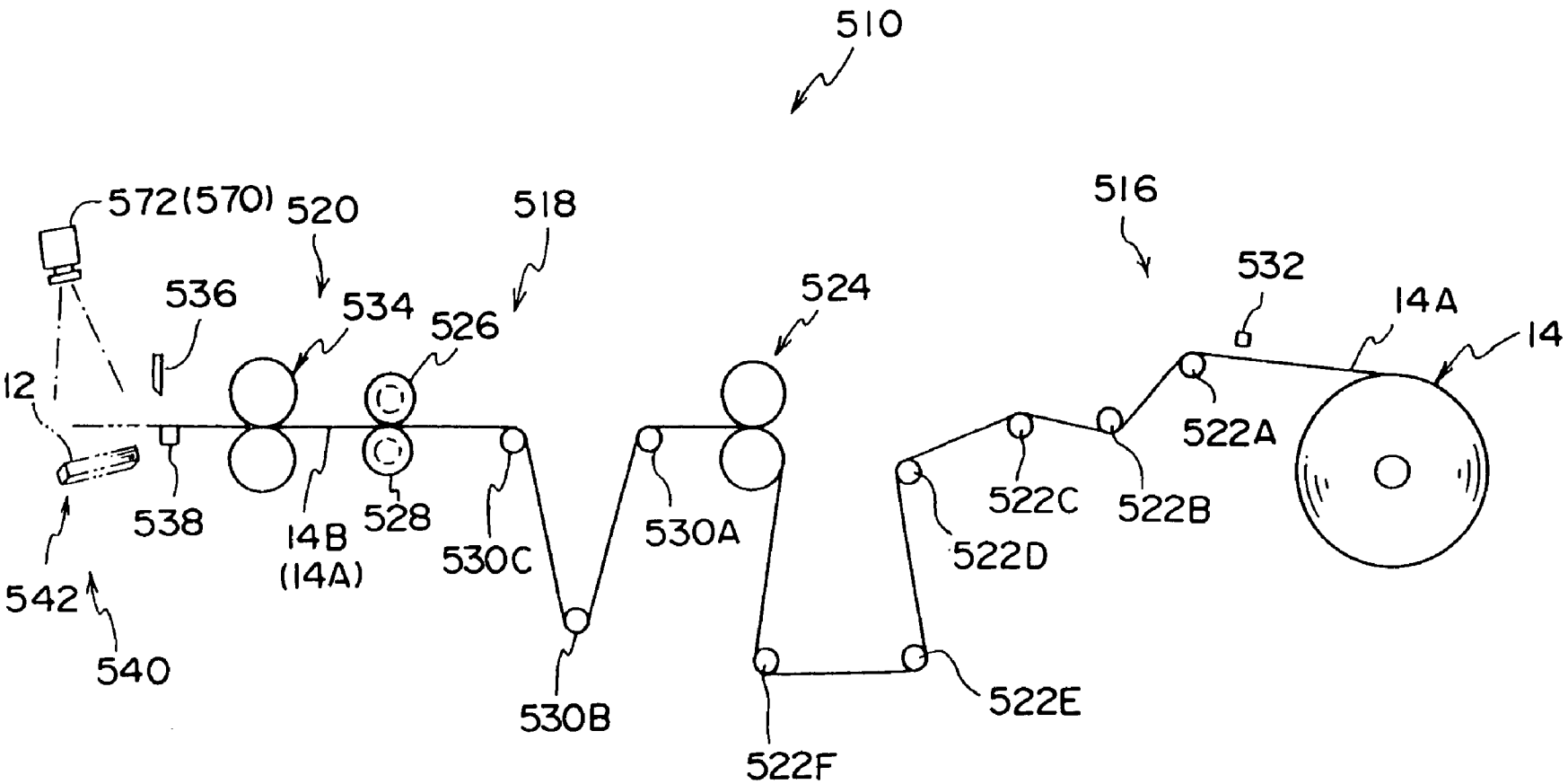
FIG. 22 is a schematic structural view of a processing system of a third embodiment.

FIG. 22 shows an example of a processing system which forms sheet bodies with a predetermined size. In a processing system 510, the web 14A, which is drawn out from the original web 14, is processed to sheet bodies of the predetermined size, and the sheet bodies are produced as the papers 12, which are inkjet paper or the like, in various sizes such as L-size, postcard size and the like. The papers 12 that are produced by the processing system 510 are not limited to inkjet paper, and various recording papers, printing papers, photographic light-sensitive materials such as film or the like, and the like may be utilized.

This processing system 510 is equipped with a feeding apparatus 516, a cutting apparatus 518 and a chopping apparatus 520.

The original web 14 is loaded at the feeding apparatus 516, and the web 14A is drawn out from the original web 14 by the feeding apparatus 516. A plurality of path rollers 522A, 522B, 522C, 522D, 522E and 522F is provided at the feeding apparatus 516. The web 14A is wound round the path rollers 522A to 522F in sequence. In the feeding apparatus 516, while the web 14A of the original web 14 is transported, curl is eliminated therefrom.

A pair of feed rollers 524 is provided at a downstream side of the path roller 522F. The web 14A that has passed the path roller 522F is nipped by these feed rollers 524.

The feed rollers 524 are driven to rotate by driving force of unillustrated driving means, and feed the web 14A at a certain speed. Thus, the web 14A is drawn out from the original web 14, is transported in the feeding apparatus 516, and is fed toward the cutting apparatus 518 at the downstream side.

At the cutting apparatus 518, slitting blades 526 and 528 are disposed in pairs sandwiching the transport path of the web 14A from above and below. Path rollers 530A, 530B and 530C are provided between the feed rollers 524 and the slitting blades 526 and 528.

The web 14A that has been drawn out through the feed rollers 524 is transported while being wound round the path rollers 530A, 530B and 530C, is fed in between the slitting blades 526 and 528, and is nipped by the slitting blades 526 and 528. The path roller 530B is moveable so as to lengthen/shorten the transport path of the web 14A. Hence, a predetermined tension is applied to the web 14A, and a difference in transport speed of the web 14A between the feeding apparatus 516 side (the feed rollers 524) and the cutting apparatus 518 and subsequent apparatuses can be absorbed.

The slitting blades 526 and 528 oppose one another at predetermined positions along the width direction of the web 14A. The slitting blades 526 and 528 are driven to rotate by unillustrated driving means, and cut (slit) the web 14A with a predetermined spacing by forming slits 526A in the original web 14 (see FIG. 23).

The slitting blades 526 and 528 are arranged as a plurality of pairs along the width direction of the original web 14, at intervals corresponding to the width dimension of the papers 12. Thus, in the cutting apparatus 518, the web 14A that has been drawn out from the original web 14 is cut in accordance with the width dimension of the papers 12, and a plurality of webs 14B is produced.

A web edge control sensor 532 is provided at the feeding apparatus 518. A position of the original web 14 along an axial direction thereof is controlled such that a width direction end portion of the web 14A, which is detected by this web edge control sensor 532, passes the web edge control sensor 532 at a certain position. Thus, constant positions along the width direction of the web 14A can be slitted by the slitting blades 526 and 528.

The chopping apparatus 520 is provided at the downstream side of the cutting apparatus 518. A pair of feed rollers 534 is provided at this chopping apparatus 520. The plurality of webs 14B, which have been formed by slitting by the slitting blades 526 and 528, are nipped by the feed rollers 534 as an integral unit.

These feed rollers 534 are driven to rotate by driving force of unillustrated driving means, and feed out the webs 14B in increments of a certain amount. Here, a certain tension can be applied to the web 14A such that slackness will not occur by moving the aforementioned path roller 530B in a direction of lengthening/shortening the length of the transport path of the web 14A. The feed amount of the webs 14B by the feed rollers 534 is an amount corresponding to the length of the papers 12.

An upper blade 536 and a lower blade 538 are provided as a pair at a downstream side of the feed rollers 534 in the chopping apparatus 520 (the leftward side in the drawing of FIG. 22). The lower blade 538 opposes the upper blade 536. The webs 14B are fed in between the upper blade 536 and the lower blade 538 by the feed rollers 534.

In a state in which a predetermined amount of the webs 14B has been fed between the upper blade 536 and the lower blade 538, the upper blade 536 descends toward the lower blade 538. As a result, the webs 14B are sandwiched between the upper blade 536 and the lower blade 538, and the webs 14B are chopped along the width direction as a unit.

Thus, in the processing system 510, pluralities of the papers 12 are produced in parallel.

Figure 23:
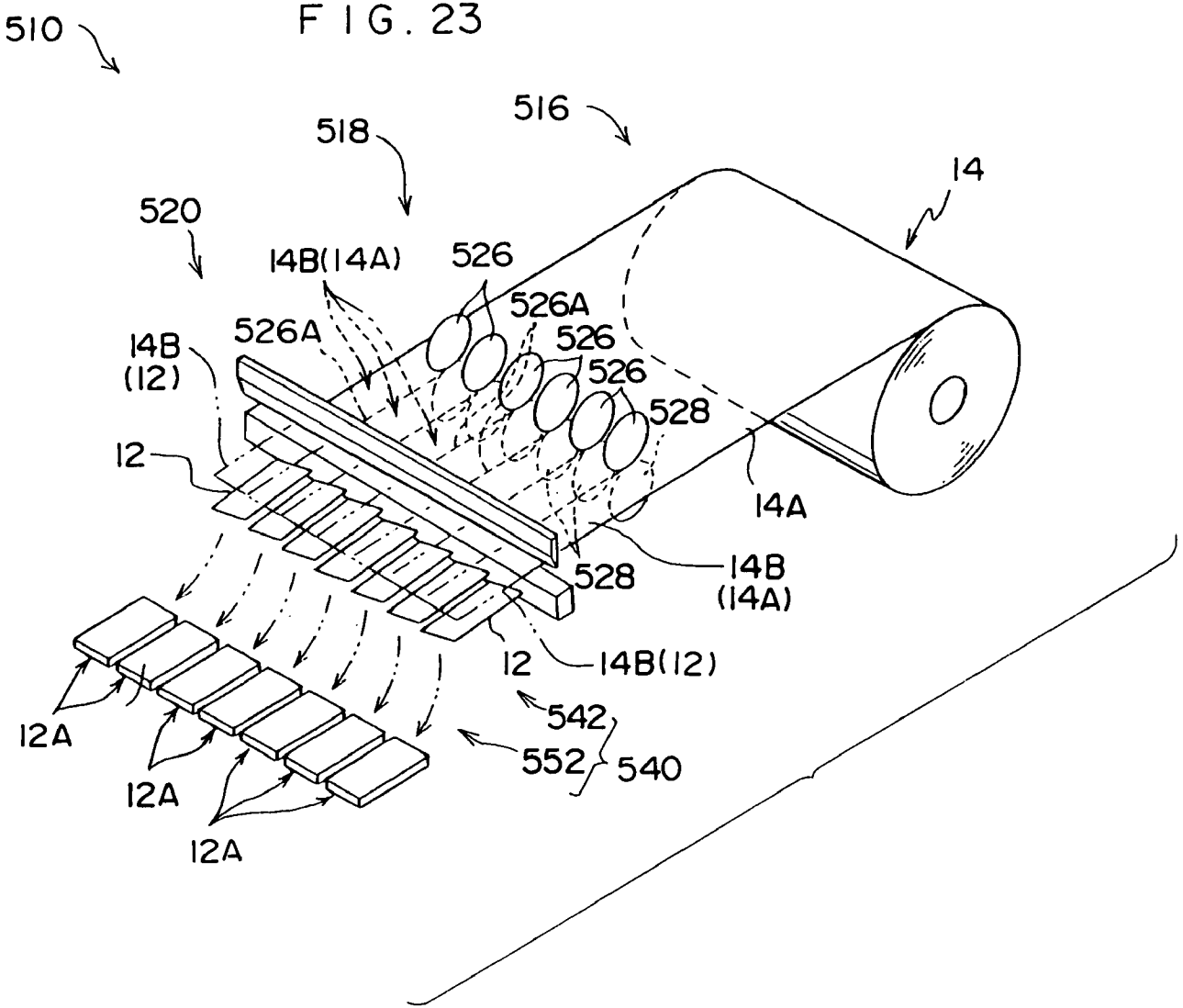
FIG. 23 is a schematic view of production of paper with this processing system.

That is, in the processing system 510, as shown in FIG. 23, the web 14A is drawn out from the original web 14 that has been loaded in the feeding apparatus 516, the web 14A is slitted to predetermined widths by the plurality of pairs of slitting blades 526 and 528 provided at the cutting apparatus 518 to produce the webs 14B, and the respective webs 14B are chopped by the upper blade 536 and lower blade 538 provided at the chopping apparatus 520 to produce the papers 12.

Here, because the webs 14B are formed by cutting to a size along the width direction, which is a direction intersecting the length direction of the papers 12, in the cutting apparatus 518 and are chopped to a size along the length direction of the papers 12 by the chopping apparatus 520, the length direction of the papers 12 corresponds to the length direction of the web 14A. Thus, when these papers 12 are loaded in, for example, a printer (such as an ink-jet printer) or the like, even if some curl remains in the papers 12, smooth printing processing of the papers 12 is possible.

In the present embodiment, six pairs of the slitting blades 526 and 528 are provided, as an example, and six of the slits 526A are formed. Accordingly, the papers 12 are produced in sets of seven sheets. However, production numbers of the papers 12 are not limited to this.

Next, stacking of the papers 12 that are produced by the processing system 510 will be described.

Figure 24:
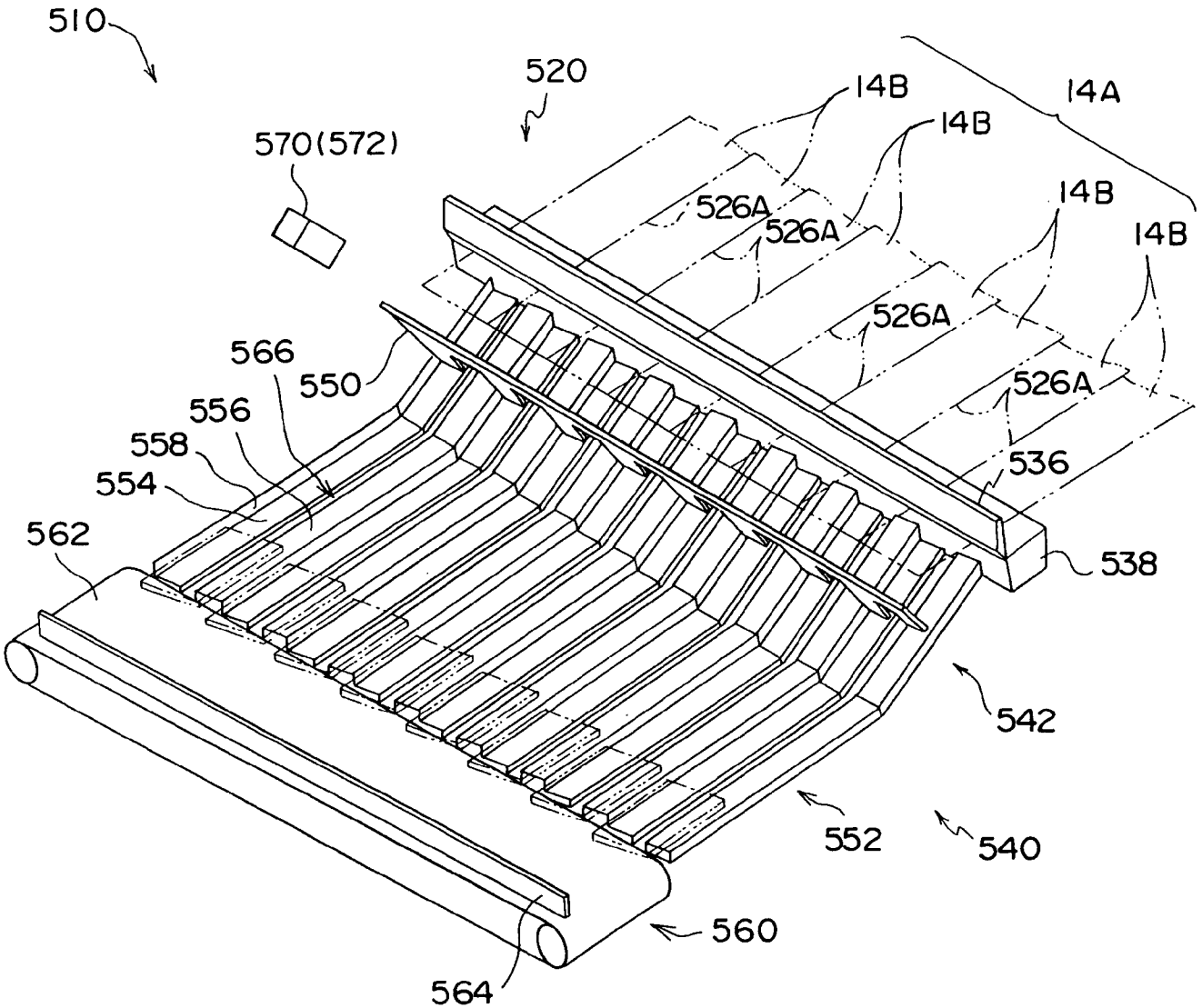
FIG. 24 is a perspective view of principal portions which shows general structure of a stacking apparatus provided at the processing system.

As shown in FIGS. 22 to 24, a stacking apparatus 540 is provided in the processing system 510, at a downstream side of the chopping apparatus 520. As shown in FIGS. 23 and 24, the stacking apparatus 540 is equipped with tray portions 542 in a number corresponding to the webs 14B that are produced by slitting at the cutting apparatus 518. The papers 12 that have been produced by chopping each of the webs 14B with the upper blade 536 and lower blade 538 of the chopping apparatus 520 are stacked in the tray portions 542, which are provided in respective correspondence with the webs 14B.

Figure 25:
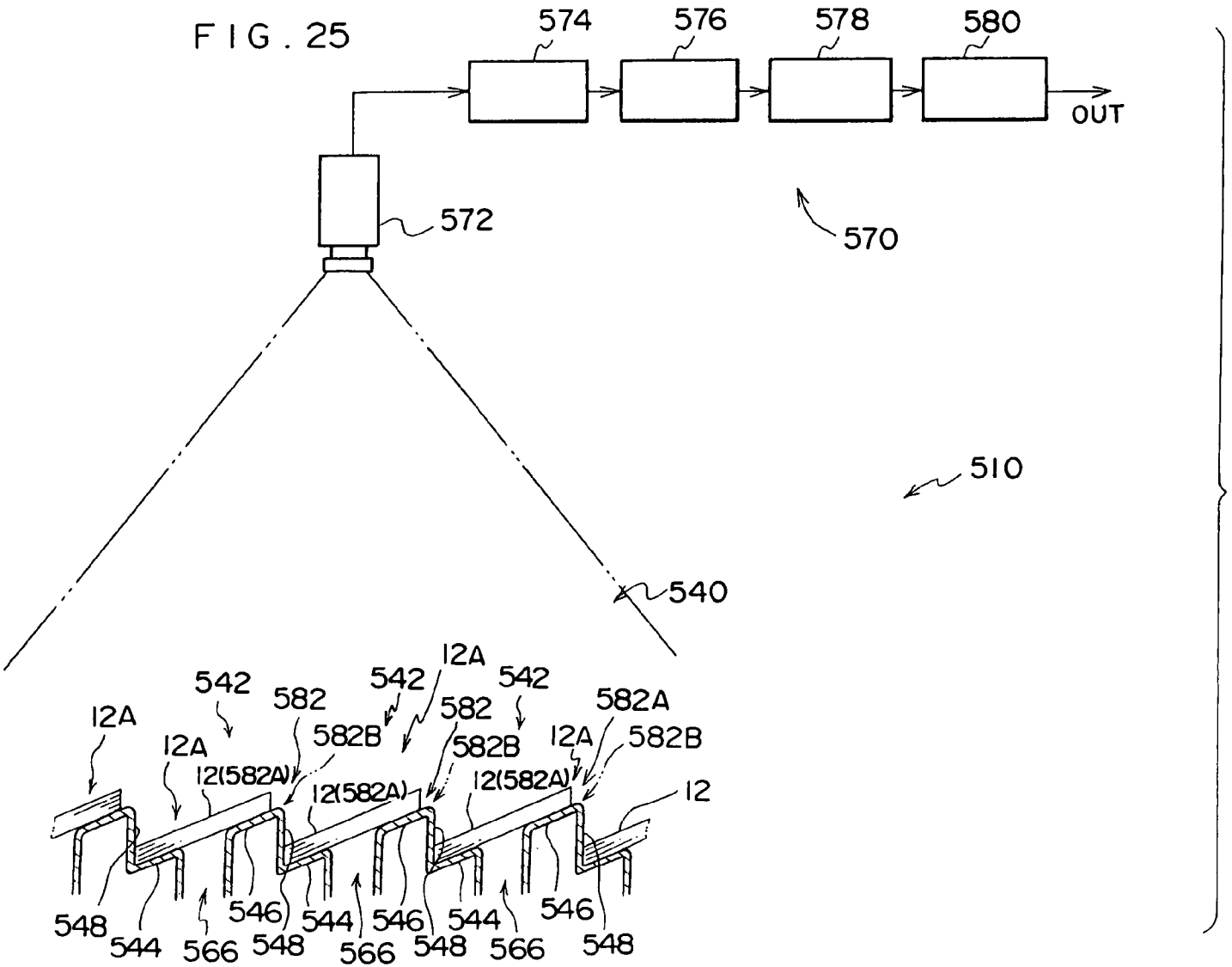
FIG. 25 is a schematic structural view of a detection apparatus provided at the stacking apparatus.

As shown in FIGS. 24 and 25, guide plates 544 and 546 are provided at the respective tray portions 542. These guide plates 544 and 546 are arranged in pairs in the width direction of the papers 12, which is the width direction of the webs 14B. Each of the papers 12 that have been produced by chopping the webs 14B with the chopping apparatus 520 (not shown in FIG. 25) is placed to straddle between the guide plates 544 and 546.

At each of the tray portions 542, the guide plate 544 is inclined such that one end side thereof in the width direction of the webs 14B (which are not shown in FIG. 25) is lower.

Further, between a distal end of this guide plate 544 (i.e., a distal end thereof in the width direction of the papers 12) and a distal end of the guide plate 546 of the neighboring tray portion 542, a standing wall 548 is formed so as to join the guide plate 544 and the guide plate 546.

Consequently, when the papers 12 drop to the respective tray portions 542 and are placed on the guide plates 544 and 546, the papers 12 move along the inclinations of the guide plates 544 and 546 toward the standing walls 548. Width direction end portions of the papers 12 abut against the standing walls 548, and thus the papers 12 are aligned in the width direction for stacking.

As shown in FIG. 24, the guide plates 544 and 546 are inclined in the length direction of the papers 12 such that a side thereof which is further away from the chopping apparatus 520 (i.e., the upper blade 536 and the lower blade 538) is lower. Thus, the papers 12 can move along this inclination on the guide plates 544 and 546.

A stopper 550 is provided at the stacking apparatus 540, at a downstream side of the inclinations of the guide plates 544 and 546. This stopper 550 straddles the tray portions 542 provided in the stacking apparatus 540. The stopper 550 is moveable in a direction of approaching/moving away from upper faces of the guide plates 544 and 546, by unillustrated raising/lowering means employing an air cylinder or the like.

At the stacking apparatus 540, when the papers 12 are to be stacked in the tray portions 542, the stopper 550 is brought close to the guide plates 544 and 546, and respective length direction distal ends of the papers 12 that are placed on the guide plates 544 and 546 abut against the stopper 550. Thus, the papers 12 are stacked in the tray portions 542 in a state in which the length direction distal ends thereof are aligned.

Thus, the tray portions 542 enable stacking of the papers 12 while the papers 12 are aligned in the width direction and the length direction.

Hence, at the tray portions 542, when the stopper 550 is moved away from the guide plates 544 and 546, the papers 12 can move downward along the inclination of the guide plates 544 and 546.

In the stacking apparatus 540, when predetermined numbers of the papers 12 have been stacked in the tray portions 542 and the sheaves 12A of the papers 12 have been formed, the stopper 550 is withdrawn upward, and the sheaves 12A of the papers 12 are fed out from the tray portions 542.

Further, in the stacking apparatus 540, transport guide portions 552 are formed continuously with the tray portions 542. The transport guide portions 552 are provided with guide plates 554 and 556, which are disposed so as to be continuous with the guide plates 544 and 546 of the tray portions 542, and with standing walls 558, which join so as to be continuous with the standing walls 548 between the tray portions 542.

At the transport guide portions 552, the guide plates 554 and 556 are inclined along the width direction of the papers 12 such that the guide plate 554 sides (the standing wall 558 sides) thereof are lower. Consequently, the sheaves 12A can move on the guide plates 554 and 556 while one end sides in the width direction of the papers 12 slidingly contact the standing walls 558.

The inclinations of the guide plates 554 and 556 gradually ease off in accordance with distance from the tray portions 542. Therefore, when the papers 12 move on the guide plates 554 and 556, inclinations of the papers 12 along the width direction gradually ease off and the papers 12 are returned to a substantially horizontal state.

At a downstream side of the transport guide portions 552, for example, a transport conveyor 560 is provided. The sheaves 12A of the papers 12 are respectively fed out from the transport guide portions 552 to a conveyor belt 562 of the transport conveyor 560. At the transport conveyor 560, a stopper 564 is provided on the conveyor belt 562. When the length direction end portions of the papers 12 abut against this stopper 564, the sheaves 12A of the papers 12 are positioned, and are placed on the conveyor belt 562 in a state in which the papers 12 are aligned in the length direction. The sheaves 12A of the papers 12 are fed out from the transport conveyor 560 to subsequent stages by driving of the conveyor belt 562.

Channel portions 566 are formed between the guide plates 554 and 556 of the transport guide portions 552, from between the guide plates 544 and 546 of the tray portions 542. Unillustrated pushers, which are provided to be protrudable/retractable in the channel portions 566, move from the tray portions 542 toward the transport conveyor 560. Consequently, the sheaves 12A of the papers 12 that have been stacked in the tray portions 542 are pushed by the pushers, move in the transport guide portions 552, and are fed out onto the conveyor belt 562 of the transport conveyor 560.

Anyway, as shown in FIGS. 22, 24 and 25, a detection apparatus 570 (not shown in FIG. 23) is provided at the processing system 510. The detection apparatus 570 detects stacking states of the papers 12 at the tray portions 542 of the stacking apparatus 540. The detection apparatus 570 is equipped with a CCD camera 572, which employs a CCD area sensor or the like as image-capturing means. Note that the image-capturing means is not limited to the CCD camera 572, and a freely selected structure which is capable of capturing images can be employed.

The CCD camera 572 is disposed to be capable of image-capturing the guide plates 544 and 546 of the plurality of tray portions 542. Hence, the detection apparatus 570 is capable of image-capturing plan view images of a predetermined region which includes both the papers 12 (the sheaves 12A) that are stacked in the tray portions 542 and portions of the guide plates 544 and 546 that are exposed at surroundings of the papers 12.

As shown in FIG. 25, the detection apparatus 570 is also equipped with an image acquisition section 574 and a binarization processing section 576. Image data of a plan view image of the tray portions 542 that has been image-captured by the CCD camera 572 is converted to digital data, and is them converted to binary data on the basis of, for example, a pre-specified threshold value.

At the tray portions 542, the guide plates 544 and 546 and the like have color tones which contrast with the papers 12. As a result, when the image that is captured by the CCD camera 572 is converted to binary data, regions which are the papers 12 and regions which are not the papers 12 are clearly distinguished.

Figure 26:
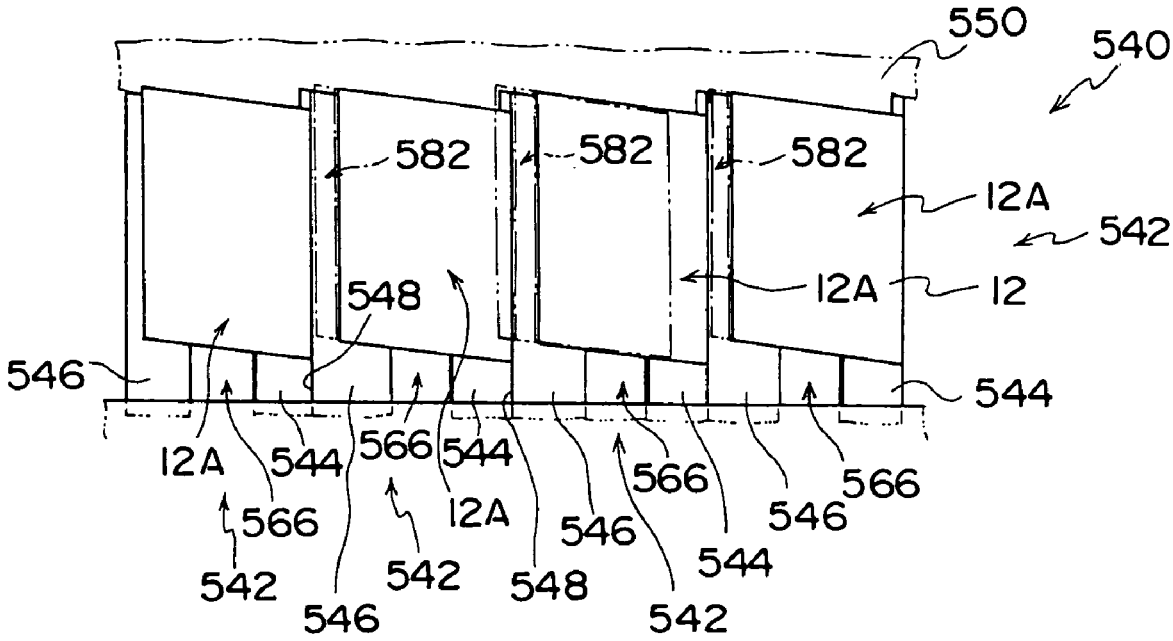
FIG. 26 is a schematic view of a tray section, viewed from a CCD camera side (an upper side).

As shown in FIGS. 25 and 26, because, at the tray portions 542, the guide plates 544 and 546 are inclined along the paper 12 width direction and the papers 12 are stacked thereon, there are predetermined gaps between the papers 12 that are stacked in neighboring tray portions 542.

Figure 27A:
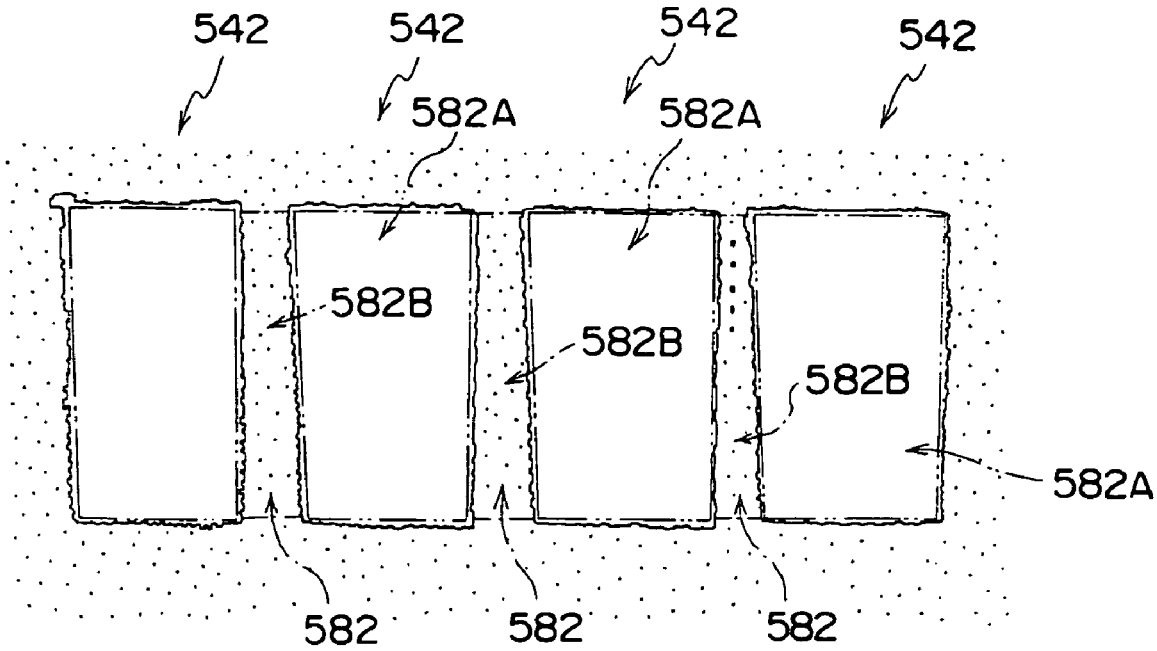
FIG. 27A is a schematic view in which an image captured by the CCD camera has been binarized, and is a view showing an example of a satisfactory stacking state.

That is, when the papers 12 are properly aligned and stacked in the tray portions 542, predetermined regions of the guide plates 546 are exposed. Further, as shown in FIG. 27A, these regions are clearly distinguished when the image data of the image captured by the CCD camera 572 is binarized.

Now, when the papers 12 are stacked at the tray portions 542, if one of the papers 12 is out of alignment, this paper 12 will stick out over the guide plate 546 that is usually exposed.

Figure 27B:
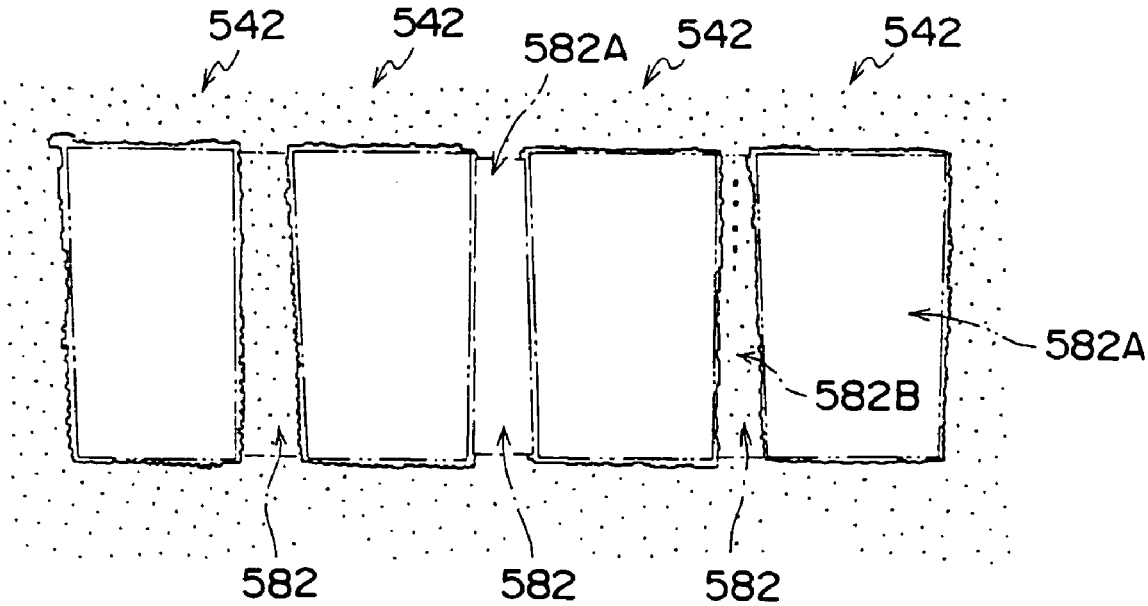
FIG. 27B is a schematic view in which an image captured by the CCD camera has been binarized, and is a view showing an example of a state in which a stacking failure has occurred.

Therefore, as shown in FIG. 27B, in the image captured by the CCD camera 572, the area of a region which is the papers 12 is larger, and the area of a region which is not the papers 12 is smaller. In particular, if the paper 12 sticks out in the width direction, the area of a region which is not the papers 12 and which corresponds to the guide plate 546 is smaller.

As shown in FIG. 25, an area calculation section 578 and a comparison and judgment section 580 are provided at the detection apparatus 570. The comparison and judgment section 580 judges whether or not stacking states of the papers 12 are satisfactory on the basis of calculation results from the area calculation section 578.

On the basis of the binary data, this area calculation section 578 calculates areas of regions that are not the papers 12 at width direction end portions of the papers 12. Here, the area calculation section 578 calculates, within a predetermined region of each guide plate 546 that should be exposed when the papers 12 are properly aligned and stacked (a region shown by broken lines in FIG. 26, which is below referred to as "judgment region 582"), the area of a region which is the papers 12 (below referred to as paper portion 582A), and/or the area of a region which is not the papers 12 (below referred to as non-paper portion 582B). The area calculation section 578 also calculates a ratio of the area of the paper portion 582A to the area of the non-paper portion 582B, or a proportion of the area of the paper portion 582A in the judgment region 582 (see FIGS. 27A and 27B).

At this time, if the papers 12 have been properly stacked, as shown in FIG. 27A, the area of the papers 12 that stick out into the judgment region 582 (the paper portion 582A) is virtually zero. However, if the papers 12 are misaligned, as shown in FIG. 27B, the area of the paper portion 582A sticking out into the judgment region 582 of the corresponding tray portion 542 will be larger.

At the comparison and judgment section 580, the proportional area of the paper portion 582A that has been calculated by the area calculation section 578 is compared with a reference value determined in advance for when the papers 12 are stacked in a satisfactory state (a threshold value), and it is judged whether or not the stacking state of the papers 12 is within a satisfactory range.

Now, when a plan view image of the plurality of tray portions 542 is captured by the single CCD camera 572, the areas of the judgment regions 582 differ according to the positions of the tray portions 542 relative to the CCD camera 572. Accordingly, the areas of the judgment regions 582 and the threshold values are specified separately for each of the tray portions 542.

Furthermore, in the processing system 510, the sizes of the papers 12 that are produced can be altered by changing the cutting widths of the web 14A at the cutting apparatus 518 (the widths of the webs 14B that are produced) and/or the chopping intervals of the webs 14B at the chopping apparatus 520. At the stacking apparatus 540, the tray portions 542 and the like are changed in accordance with the sizes of the papers 12 that are to be produced.

Hence, at the detection apparatus 570, specifications of the judgment regions 582, and of the threshold values relating to the proportional areas of the paper portions 582A in the judgment regions 582, are changed in accordance with the sizes of the papers 12 that are to be stacked in the stacking apparatus 540.

Results of judgments at the comparison and judgment section 580 are inputted to, for example, an unillustrated production management computer or the like which administers operations of the processing system 510 and production of the papers 12. If it is judged by the comparison and judgment section 580 that a stacking state of the papers 12 is unsatisfactory, processing of the papers 12 is stopped temporarily or the like, and error processing is carried out.

Next, operation of the present embodiment will be described.

In the processing system 510, the web 14A that has been drawn out from the original web 14 loaded at the feeding apparatus 516 is fed toward the cutting apparatus 518 at a constant speed by the feed rollers 524.

The cutting apparatus 518 nips the web 14A with the slitting blades 526 and 528 and feeds the web 14A out to the chopping apparatus 520. In the cutting apparatus 518, the webs 14B with predetermined widths are produced by slitting the web 14A with the slitting blades 526 and 528. These webs 14B are fed out to the chopping apparatus 520 as a unit.

The chopping apparatus 520 nips the webs 14B with the feed rollers 534 and feeds the webs 14B between the upper blade 536 and lower blade 538 in units of a predetermined amount, while preventing the webs 14B from overlapping with one another. Also at the chopping apparatus 520, the upper blade 536 is operated synchronously with the transport of the webs 14B by the feed rollers 534.

Thus, the webs 14B are respectively chopped to the predetermined length, and the papers 12 of the predetermined size are produced.

Further, in the processing system 510, the stacking apparatus 540 is provided at the downstream side of the chopping apparatus 520. At the stacking apparatus 540, the tray portions 542 are provided in respective correspondence with the webs 14B that are produced at the cutting apparatus 518. The respective pluralities of the papers 12 that are produced in parallel by the chopping apparatus 520 are stacked by dropping into the tray portions 542.

At the tray portions 542, the papers 12 are placed on the guide plates 544 and 546, which are inclined such that one end sides thereof in the width direction of the papers 12 are lower. Further, the guide plates 544 and 546 are respectively inclined such that a length direction side thereof in the length direction of the papers 12 (the downstream side in the transport direction of the web 14A) is lower. The stopper 550 is also provided at the tray portions 542.

Therefore, the width direction one end sides of the papers 12 that have fallen to the tray portions 542 abut against the standing walls 548, and the length direction one end sides of these papers 12 abut against the stopper 550. Thus, these papers 12 are stacked by being aligned in the width direction and the length direction and placed on the guide plates 544 and 546.

At the stacking apparatus 540, when predetermined numbers of the papers 12 have been stacked in the tray portions 542, the stopper 550 is raised and the sheaves 12A of these papers 12 move to the transport guide portions 552. Subsequently, the sheaves 12A of the papers 12 are pushed and moved on the guide plates 554 and 556 of the transport guide portions 552 toward the transport conveyor 560 by the unillustrated pushers. At this time, width direction end portions of the papers 12 move while sliding against the standing walls 558, so the sheaves 12A move whilst width directions thereof remain aligned.

In accordance therewith, the inclinations along the paper 12 width direction of the sheaves 12A of the papers 12 that are moving on the guide plates 554 and 556 gradually level off, and the sheaves 12A of the papers 12 are pushed out onto the conveyor belt 562 of the transport conveyor 560. At this time, each of the plurality of sheaves 12A is aligned in the length direction by the stopper 564, and is placed on the conveyor belt 562 at a predetermined position. The sheaves 12A of the papers 12 are respectively fed out in order to subsequent stages, by driving of the conveyor belt 562, and are subjected to processing for packing and the like.

Thus, in the processing system 510, production of the papers 12 with predetermined sizes from the web 14A that is drawn out from the original web 14, stacking of the papers 12 that have been produced, and feeding of the papers 12 that have been stacked can be carried out automatically.

Anyway, when automation of stacking of the papers 12 and feeding of the stacked papers 12 is implemented, and the sheaves 12A of the papers 12 are packed and made into a finished product, if there are misalignments of the papers 12 within the sheaves 12A, reductions in product quality, due to transport problems, packing problems and the like, will occur.

In order to prevent such reductions of product quality, it is necessary to at least confirm whether or not the papers 12 are uniformly aligned and stacked.

Herein, the detection apparatus 570 is provided in the processing system 510, and the stacking states of the papers 12 in the respective tray portions 542 of the stacking apparatus 540 are detected.

The detection apparatus 570 is equipped with the CCD camera 572. At the detection apparatus 570, a plan view image of the plurality of tray portions 542 in which the papers 12 are stacked is captured by the CCD camera 572.

Both the image acquisition section 574 and the binarization processing section 576 are also provided at the detection apparatus 570. A plan view image captured by the CCD camera 572 is acquired with a predetermined timing, and the acquired plan view image is converted to digital signals and is processed for binarization. Hence, the paper portion 582A and non-paper portion 582B are clearly distinguished for each of the tray portions 542.

At each of the tray portions 542 of the stacking apparatus 540 employed in the present embodiment, the guide plates 544 and 546 on which the papers 12 are placed are colored to contrast with the papers 12. Accordingly, the detection apparatus 570 can clearly identify regions which are the papers 12 and regions which are not the papers 12. Note that, in the detection apparatus 570 which is employed in the present embodiment, the binarization processing is performed after the image captured by the CCD camera 572 has been acquired.

At the stacking apparatus 540, when the papers 12 are stacked at the proper positions in the tray portions 542, the non-paper portions 582B are formed with predetermined areas at one end sides in the paper 12 width direction. In such a case, the areas of the non-paper portions 582B substantially correspond to the areas of the judgment regions 582.

In the area calculation section 578 provided at the detection apparatus 570, the area of the paper portion 582A and the area of the non-paper portion 582B in the judgment region 582 corresponding to each tray portion 542 are calculated from the binarization-processed image data. From the results of these calculations, a proportional area of the paper portion 582A is calculated.

In the comparison and judgment section 580, it is judged whether or not the area of the paper portion 582A calculated in the area calculation section 578 exceeds a pre-specified proportion, that is, whether or not the proportional area of the paper portion 582A exceeds a pre-specified threshold value, and hence whether or not there is a misalignment of the papers 12 stacked in the corresponding tray portion 542.

That is, as shown in FIGS. 25 and 26, when the papers 12 are aligned and stacked within a predetermined area, the guide plate 546 is exposed at the paper 12 width direction one end side. Accordingly, as shown in FIG. 27A, when the papers 12 are in the properly stacked state, of the image of the tray portion 542 that is obtained by the image capture by the CCD camera 572 and the binarization processing, the area of the paper portion 582A is virtually zero or extremely small, and the area of the non-paper portion 582B is large.

In contrast, if the papers 12 are such that the area of the papers 12 is aberrant and there is a misalignment among the stacked papers 12, as shown by broken lines in FIG. 26, this paper 12 protrudes over the guide plate 546 corresponding to the tray portion 542.

Therefore, as shown in FIG. 27B, in the image that has been captured by the CCD camera 572 and binarization-processed, the paper portion 582A protrudes into the judgment region 582 and the area of the non-paper portion 582B is smaller.

Hence, when the area of the paper portion 582A within the judgment region 582 is calculated for the respective tray portion 542 and this area of the paper portion 582A exceeds the pre-specified value, it is judged by the detection apparatus 570 that a failure in stacking of the papers 12 has occurred at the corresponding tray portion 542.

Here, erroneous judgments due to noise and the like can be reliably prevented by suitably specifying the threshold values of the ratios of the areas of the paper portions 582A to the areas of the judgment regions 582, and it is possible to judge the stacking states of the papers 12 in the tray portions 542 reliably.

In the processing system 510, when a stacking failure of the papers 12 at any of the tray portions 542 is detected by the detection apparatus 570, an operation specified for error processing, such as, for example, halting drawing out of the web 14A from the original web 14, halting transport of the web 14A (and webs 14B) by the feed rollers 524 and 534 and temporarily halting production of the papers 12, is carried out.

Hence, it is possible to carry out error processing, such as taking out paper from any of the tray portions 542 in which stacking failures have occurred, rectifying stacking states or the like. When this error processing has been completed, production of the papers 12 is resumed. Thus, the occurrence of reductions in product quality of the papers 12 that are produced can be reliably prevented.

Incidentally, because, at the detection apparatus 570, the image capture region of the CCD camera 572 covers the plurality of tray portions 542, it is easy to reserve space for provision of the CCD camera 572 at the stacking apparatus 540. That is, if the CCD camera 572 was provided separately for each of the plurality of tray portions 542, this would lead to an increase in costs of the detection apparatus 570, and it would be necessary to reserve separate spaces for provision of the CCD cameras 572. However, because an image of the plurality of tray portions 542 can be captured by the single CCD camera 572, the CCD camera 572 can be disposed in a relatively small space.

Note that the present embodiment as described above does not limit structures of the present invention. For example, in the present embodiment, the judgment regions 582 are specified for the width direction end portions of the papers 12 that are stacked in the respective tray portions 542, and it is judged whether or not the stacking states of the papers 12 are satisfactory from the areas of the paper portions 582A that stick out into the judgment regions 582. However, in addition to the width direction of the papers 12, states in which the papers 12 stick out in the length direction may be detected too.

Figure 28:
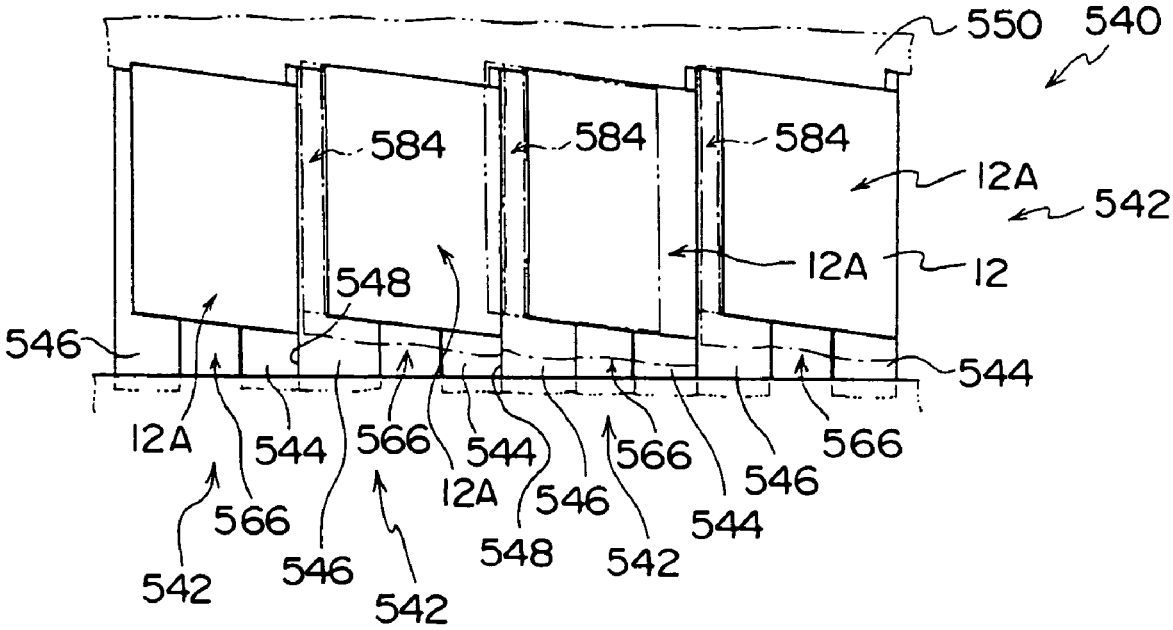
FIG. 28 is a schematic view of the tray section, viewed from an upper side, which shows another example of a detection region for judging stacking failures.

For example, as shown in FIG. 28, when the papers 12 are abutted against the standing walls 548 in the width direction and abutted against the stopper 550 in the length direction for stacking, predetermined regions which include outer sides in both the width direction and the length direction, at opposite sides of the papers 12 from the standing walls 548 and the stopper 550, may be specified as judgment regions 584, and stacking states can be judged from areas of the paper portions 582A in these judgment regions 584.

That is, it is possible to set the judgment regions 584 as detection windows, and to judge the stacking states of the papers 12 from areas or proportional areas of the paper portions 582A in these detection windows.

Further, for the present embodiment, an example has been described in which the stacking apparatus 540 is equipped with the tray portions 542 which are inclined along both the width direction and the length direction for stacking the papers 12. However, the present invention is not limited to this, and it is possible to employ stacking apparatuses which carry out stacking of the papers 12 using arbitrary stacking methods.

Further yet, the present embodiment has been described as utilizing the papers 12 as sheet members. However, the present invention is not limited thus, and may be applied to stacking of sheet bodies with arbitrary structures, such as sheet members and sheet bodies of various materials which are thinly formed utilizing photographic photosensitive materials such as photographic film, printing paper and the like, and metals, resins and the like, and photosensitive materials such as printing plates in which photosensitive layers are formed on such sheet bodies, and the like.

According to the present invention as described above, the following excellent effects are provided. Because stacking states of sheet bodies are judged from areas of sheet bodies in pre-specified judgment regions, within plan view images captured by image-capturing means, accurate judgment is possible. Furthermore, because plan view images of a plurality of sheet body stacking portions are captured by the image-capturing means, it is possible to simplify a detection structure and save space.

What is claimed is:

1. A sheet-processing apparatus comprising:

a cutting apparatus which slits a long sheet member into a plurality of narrower strips;

a chopping apparatus which chops the strips with a predetermined spacing, for forming pluralities of sheets;

a stacking apparatus which piles up a predetermined number of the sheets for each strip, for forming sheet sheaves, the stacking apparatus including an alignment section that transports the sheet sheeves in guide channels in a first direction while opening up a predetermined distance therebetween in a second direction, substantially perpendicular to the first direction;

a transport apparatus including a transport section which transports the sheet sheaves in the second direction while opening up a predetermined distance therebetween in the second direction; and a packing apparatus which packs the sheet sheaves.

2. The apparatus of claim 1, further comprising an application apparatus which applies a cover sheet to at least one of an upper face and a lower face of each sheet sheaf.

3. The apparatus of claim 2, wherein the application apparatus comprises:

a pair of cover sheet application devices which are each capable of applying a cover sheet to a face of the each sheet sheaf that is disposed at a vertical direction upper side of the sheet sheaf; and an inversion apparatus provided between the cover sheet application devices, which is capable of inverting the sheet sheaf.

4. The apparatus of claim 3, wherein the inversion apparatus comprises at least one gripping portion capable of pushing against upper and lower faces of the sheet sheaf and disengageably gripping the sheet sheaf.

5. The apparatus of claim 4, wherein the sheet sheaf is inverted by the gripping portion rotating about an axial line which extends in a direction intersecting a direction of transport of the sheet sheaves.

6. The apparatus of claim 1, wherein the transport apparatus further comprises:

a transfer section at a predetermined point on a transport path of the transport section, which changes a transport direction of the sheet sheaves from the second direction to the first direction, without altering a state of orientation of each sheet sheaf.

7. The apparatus according to claim 1, wherein said stacking apparatus includes a plurality of sheet-receiving portions, each sheet-receiving portion stacking the predetermined number of the sheets for each strip, which are fed therein in a first direction, for forming the sheet sheaves, each sheet being inclined in the plurality of sheet-receiving portions, and the plurality of sheet-receiving portions are disposed substantially in a row in the second direction, and said transport apparatus includes a transfer section that transports the sheet sheaves which are formed at each sheet-receiving portion in the second direction.

8. The apparatus of claim 7, wherein each sheet-receiving portion forms the sheet sheaf in which each sheet is inclined to one side in the first direction and is also inclined to one side in the second direction.

9. The apparatus of claim 7, wherein each sheet-receiving portion comprises a pair of guide plates on which the sheet sheaf is formed.

10. The apparatus of claim 7, wherein each sheet-receiving portion comprises a standing wall capable of abutting against and aligning a side face of the sheet sheaf at one side in the second direction.

11. The apparatus of claim 7, wherein each sheet-receiving portion comprises a corresponding stopping plate portion capable of abutting against and aligning a side face of the sheet sheaf at one side in the first direction.

12. The apparatus of claim 11, wherein the stopping plate portions are all structured by a single stopping plate.

13. The apparatus of claim 12, wherein the stopping plate is movable between an abutting position, at which abutting against the sheet sheaves of all the sheet-receiving portions is possible, and a withdrawn position, at which this abutting does not occur and the stopping plate does not obstruct transport of the sheet sheaves by the transport section.

14. The apparatus of claim 1, wherein the alignment section comprises a pushing movement apparatus capable of pushing the sheet sheaves of all the sheet-receiving portions for moving the sheet sheaves in parallel in the first direction.

15. The apparatus of claim 1, wherein the alignment section comprises a plurality of guide portions, each guide portion receiving the seat sheaf from the corresponding sheet-receiving portion and guiding the sheet sheaf in the first direction.

16. The apparatus of claim 15, wherein each guide portion comprises a pair of guide members which slide against and guide the sheet sheaf, the guide members being inclined to a first direction downstream side and also inclined to one side in the first direction.

17. The apparatus of claim 16, wherein the inclination to the one side in the second direction eases off in accordance with progress toward the first direction downstream side.

18. The apparatus of claim 7, wherein said transport section includes a transport belt for transporting the sheet sheaves, which is disposed at an outer side, in the first direction, of the transport section, and a stopping member for positioning the sheet sheaves on the transport belt substantially in a row along a direction of progress of the belt.

19. A sheet-processing apparatus comprising:

a cutting apparatus which slits a long sheet member into a plurality of narrower strips;

a chopping apparatus which chops the strips with a predetermined spacing, for forming pluralities of sheets;

a stacking apparatus which piles up a predetermined number of the sheets for each strip, for forming sheet sheaves, the stacking apparatus including an alignment section that transports the sheet sheeves in guide channels while opening up a predetermined distance therebetween, said stacking apparatus includes a plurality of sheet-receiving portions, each sheet-receiving portion stacking the predetermined number of the sheets for each strip, which are fed therein in a first direction, for forming the sheet sheaves, each sheet being inclined in the plurality of sheet-receiving portions, and the plurality of sheet-receiving portions are disposed substantially in a row in a second direction, which is substantially perpendicular to the first direction, in plan view;

a transport apparatus, said transport apparatus including:

a transport section which transports the sheet sheaves in the second direction while opening up a predetermined distance therebetween in the second direction; and a transfer section which moves the plurality of sheet sheaves from said transport section in the first direction; and a packing apparatus which packs the sheet sheaves wherein said stacking apparatus includes a plurality of sheet-receiving portions, each sheet-receiving portion stacking the predetermined number of the sheets for each strip, which are fed therein in a first direction, for forming the sheet sheaves, each sheet being inclined in the plurality of sheet-receiving portions, and the plurality of sheet-receiving portions are disposed substantially in a row in a second direction, which is substantially perpendicular to the first direction, in plan view, the transfer section moves the plurality of sheet sheaves in said second direction from said sheet receiving portions to said transport apparatus, and said transport apparatus transports the sheet sheaves which are formed at each sheet-receiving portion in a transport direction which is substantially parallel to the first direction.

* * * * *